US010077633B2

(12) United States Patent
Purkis et al.

(10) Patent No.: US 10,077,633 B2
(45) **Date of Patent: *Sep. 18, 2018**

(54) DOWNHOLE APPARATUS AND METHOD

(71) Applicant: Weatherford Technology Holdings, LLC, Houston, TX (US)

(72) Inventors: Daniel George Purkis, Aberdeen (GB); Oliver Webster, Aberdeenshire (GB); Damien Gerard Patton, Aberdeenshire (GB); Matthew Manning, Aberdeen (GB); Steve Corbett, Aberdeen (GB); Ian Duncan, Aberdeen (GB); Santiago Galvez Porta, Peterhead (GB)

(73) Assignee: Petrowell Limited, Aberdeen (GB)

( * ) Notice: Subject to any disclaimer, the term of this patent is extended or adjusted under 35 U.S.C. 154(b) by 307 days.

This patent is subject to a terminal disclaimer.

(21) Appl. No.: 14/610,510

(22) Filed: Jan. 30, 2015

(65) Prior Publication Data

US 2015/0167431 A1 Jun. 18, 2015

Related U.S. Application Data

(63) Continuation of application No. PCT/GB2013/052043, filed on Jul. 31, 2013.

(30) Foreign Application Priority Data

Jul. 31, 2012 (GB) ..... 1213574.5
Dec. 21, 2012 (GB) ..... 1223191.6

(51) Int. Cl.
*E21B 34/16* (2006.01)
*E21B 23/04* (2006.01)
(Continued)

(52) U.S. Cl.
CPC ..... *E21B 34/16* (2013.01); *E21B 23/04* (2013.01); *E21B 33/124* (2013.01); *E21B 34/08* (2013.01);
(Continued)

(58) Field of Classification Search
CPC ..... E21B 34/16; E21B 23/04; E21B 33/124; E21B 34/08; E21B 34/106; E21B 34/14;
(Continued)

(56) References Cited

U.S. PATENT DOCUMENTS 6,422,317 B1 7/2002 Williamson, Jr.
2006/0124312 A1 6/2006 Rytlewski et al.
(Continued)

FOREIGN PATENT DOCUMENTS

EP 2360347 A2 8/2011
GB 2478995 A 9/2011
(Continued)

OTHER PUBLICATIONS

International Search Report received in corresponding PCT Application No. PCT/GB2013/052043, dated Jul. 22, 2014.
(Continued)

*Primary Examiner* — Taras P Bemko
(74) *Attorney, Agent, or Firm* — Blank Rome, LLP

(57) ABSTRACT

A downhole tool (32) comprises a tool housing (34) defining a central bore (35) and including a fluid port (20), and a valve member (40) mounted within the housing (34) and being moveable from a closed position in which the fluid port (20) is blocked to an open position in which the fluid port (20) is opened. The tool (32) further comprises a catching arrangement (41) mounted within the housing (34) and comprising one or more radially moveable seat members (106), and being configurable from a free configuration in which the seat members (106) permit an object (48) to
(Continued)

pass through the tool (32), to a catching configuration in which the seat members (106) catch an object (48) passing through the tool (32).

35 Claims, 21 Drawing Sheets

(51) Int. Cl.

| | |
|---|---|
| ***E21B 34/14*** | (2006.01) |
| ***E21B 43/14*** | (2006.01) |
| ***E21B 43/26*** | (2006.01) |
| ***E21B 34/08*** | (2006.01) |
| ***E21B 34/10*** | (2006.01) |
| ***E21B 33/124*** | (2006.01) |
| ***E21B 47/00*** | (2012.01) |
| ***E21B 47/06*** | (2012.01) |
| ***E21B 47/09*** | (2012.01) |
| *E21B 34/00* | (2006.01) |

(52) U.S. Cl.
CPC ..... *E21B 34/106* (2013.01); *E21B 34/14* (2013.01); *E21B 43/14* (2013.01); *E21B 43/26* (2013.01); *E21B 47/0002* (2013.01); *E21B 47/06* (2013.01); *E21B 47/091* (2013.01); *E21B 2034/002* (2013.01); *E21B 2034/007* (2013.01)

(58) Field of Classification Search
CPC ..... E21B 43/14; E21B 43/26; E21B 47/0002; E21B 47/06; E21B 47/091; E21B 2034/002; E21B 2034/007
USPC ..... 166/373
See application file for complete search history.

(56) References Cited

U.S. PATENT DOCUMENTS

| | | | |
|---|---|---|---|
| 2009/0308588 | A1 | 12/2009 | Howell et al. |
| 2010/0132954 | A1 | 6/2010 | Telfer |
| 2011/0030976 | A1 | 2/2011 | King |
| 2011/0100647 | A1 | 5/2011 | King et al. |
| 2011/0192613 | A1 | 8/2011 | Garcia et al. |
| 2011/0240301 | A1 | 10/2011 | Robison et al. |
| 2012/0048556 | A1 | 3/2012 | O'Connell et al. |
| 2012/0132426 | A1 | 5/2012 | Xu et al. |

FOREIGN PATENT DOCUMENTS

| | | | | |
|---|---|---|---|---|
| GB | 2478998 | A | 9/2011 | |
| WO | 99/54590 | A1 | 10/1999 | |
| WO | 2011/100748 | | 8/2011 | |
| WO | 2011/117601 | A2 | 9/2011 | |
| WO | WO 2011117602 | A2 * | 9/2011 | ..... E21B 21/103 |
| WO | 2014/020335 | A2 | 2/2014 | |

OTHER PUBLICATIONS

Written Opinion received in corresponding PCT Application No. PCT/GB2013/052043, dated Jul. 22, 2014.
Search Report received in corresponding GB Appl. No. GB1313686.6, dated Jan. 23, 2014.
Search and Examination Report in corresponding EP Appl. EP15169697, dated Jul. 5, 2016.

* cited by examiner

DOWNHOLE APPARATUS AND METHOD

CROSS-REFERENCE TO RELATED APPLICATION

This application is being filed as a continuation of PCT/GB2013/052045 which was filed Jul. 31, 2013, which claims priority to GB1223191.6, which was filed Dec. 21, 2012, and GB1213574.5, which was filed Jul. 31, 2012. This application is also related to U.S. application Ser. No. 14/610,440 entitled "Downhole Apparatus and Method," which was filed concurrently herewith; U.S. application Ser. No. 14/610,483 entitled "Downhole Apparatus and Method," which was filed concurrently herewith; and U.S. application Ser. No. 14/610,550 entitled "Downhole Apparatus and Method," which was filed concurrently herewith. Each of the foregoing applications is hereby incorporated by reference in its entirety.

FIELD OF THE INVENTION

The present invention relates to downhole tools and methods, including mechanically actuated downhole tools and methods. In particular, but not exclusively, the present invention relates to downhole tools and methods associated with well fracturing.

BACKGROUND TO THE INVENTION

There are many situations in which downhole tools must be selectively actuated. For instance, during hydraulic fracturing of a multiple zone well, one or more tools are provided at each zone, and each tool needs to be actuated so that fluid is diverted to flow outwards to fracture the surrounding formation. It is often desirable for the actuation to be performed in a sequential manner to allow the formation to be progressively fractured along the length of the bore, without leaking fracture fluid out through previously fractured regions.

The most common approach to tool actuation is still fully mechanical. Typically, balls of ever increasing size are dropped down the well bore. The balls pass though the first and intermediate tools, which have a valve seat larger than the ball, until they reach a tool in the well with an appropriate size of valve seat. The ball then seats at the tool to block the main passage and cause transverse ports to open thus diverting the fluid flow. However, the use of ever increasing balls requires ever decreasing seats, and in some cases the smaller seats may define significant flow restrictions, which is undesirable.

WO 2011/117601 and WO 2011/117602 each describe an improved system which uses balls of a substantially similar size and a mechanical counting device associated with each tool. Each dropped ball causes the mechanical counting device to linearly progress along the main bore in a predetermined number of discrete steps until reaching an actuation site of the tool whereupon the tool is actuated. The mechanical counting device can be located at an appropriate position (number of steps from the actuation site) for each tool such that the downhole tools are sequentially actuatable. This system has been found to be highly effective.

In the oil and gas industry there is a significant drive to improve the effectiveness and reliability of tools which are deployed and operated in a downhole environment. This is to ensure that the tools operate at maximum efficiency, have minimum risk of failure or imprecise operation, can be flexible according to operator requirements, and minimise any necessary remedial action, associated time delays and costs.

SUMMARY OF THE INVENTION

Aspects of the present invention relate to a downhole actuator for actuating a downhole tool. Aspects of the present invention relate to a downhole tool, such as a downhole fracturing tool. Aspects of the present invention relate to a combination of a downhole actuator and downhole tool. An aspect of the present invention relates to a catching arrangement, for use in catching an object, such as a ball or dart. Further aspects of the present invention relate to methods of operating downhole actuators and tools, performing wellbore operations such as formation stimulation, fracturing, wellbore sealing, cementing, flow control and the like. Further aspects of the present invention relate to wellbore systems, such as completion systems, for example completion systems which permit or facilitate formation stimulation to be achieved, such as fracturing operations and the like to be performed. Aspects of the present invention relate to methods of manufacturing downhole tool components, such as a component for catching an object. Aspects of the present invention relate to an indexing sleeve for use in a downhole actuator. Aspects of the present invention relate to an inspection apparatus for use in inspecting or determining the position of an indexing sleeve within a housing of a downhole actuator.

These and other aspects may include any combination of features as presented below.

Embodiments of aspects of the present invention may be used in any downhole operation, such as in formation stimulation operations, sealing operations, flow control operations and the like.

A downhole actuator according to an aspect of the invention may comprise a housing and an indexing sleeve mounted within the housing. The indexing sleeve may be operated to move in a number of discrete linear movement steps along the housing towards an actuation site by passage of a corresponding number of actuation objects.

Suitable actuation objects may include balls, darts, plugs, any other object dropped or otherwise passed into a wellbore or wellbore infrastructure to perform a tool-actuation function, or any combination of these. An actuation object may form part of or be provided in combination with the downhole actuator.

The indexing sleeve may be configured to temporarily capture a passing actuation object to permit the object to drive the indexing sleeve a discrete movement step, and subsequently release the object upon completion of the discrete movement step.

The downhole actuator may be configured to permit the indexing sleeve to become disabled, such that an actuation object may pass through the actuator without causing the indexing sleeve to move. The indexing sleeve may become disabled by alignment, for example axial alignment, of said indexing sleeve with a disable region within the housing.

The downhole actuator may be configured to permit the indexing sleeve to become disabled at an actuation site. Such an arrangement may permit the indexing sleeve to become disabled following or during actuation of an associated tool, system, process or the like.

The downhole actuator may be configured to permit the indexing sleeve to become disabled at a location which is remote from an actuation site, Such an arrangement may permit the indexing sleeve to become disabled to prevent actuation of an associated tool, system, process or the like.

The indexing sleeve may comprise an engaging arrangement configured to be engaged by an actuation object passing through the downhole actuator to facilitate movement of the indexing sleeve. The indexing sleeve may be disabled by configuring the engaging arrangement.

The downhole actuator may actuate a downhole tool. The downhole tool may comprise an actuatable member.

The downhole tool may include any downhole tool, such as a valve, packer, inflow control device, choke, communication device, drilling assembly, pump, fracturing tool, catcher assembly, flow diverter or the like, or any suitable combination of downhole tools.

The downhole tool may include a tool housing and a valve member which is movable by the indexing sleeve. The valve member may be movable to open a fluid port, such as a fluid port in or through a wall of the tool housing. The valve member may be movable axially to open a fluid port. The valve member may be movable rotationally to open a fluid port. The valve member may be moveable both axially and rotationally to open a fluid port.

The downhole tool may include a catching arrangement. The catching arrangement may be configurable between a free configuration in which an actuation object may pass the catching arrangement, and a catching configuration in which an actuation object is caught or captured by the catching arrangement.

The catching arrangement may be operated by the downhole actuator. For example, the catching arrangement may be reconfigured to the catching configuration by the downhole actuator.

The catching arrangement may be reconfigured to the catching configuration by movement of the actuatable member of the downhole tool, for example movement of the valve member towards its open position.

The catching arrangement may be configured to release a previously caught object. The catching arrangement may be configured to release a previously caught object by establishing a condition, such as a pressure condition, flow condition or the like within the downhole tool. The catching arrangement may be configured to release a previously caught object by a change in flow direction, for example reverse flow through the downhole tool.

The catching arrangement may be configurable from its catching configuration to a release configuration in which a caught object may be released.

The catching arrangement may be reconfigured to the release configuration by action of a caught object acting against the catching arrangement.

The catching arrangement may be reconfigured to an intermediate release configuration, for example by action of a caught object acting against the catching arrangement. The catching arrangement may be reconfigured from an intermediate release position to a release configuration by a variation I a downhole condition, for example a variation in pressure, flow rate, flow direction or the like.

When the catching arrangement is configured in a release configuration, the catching arrangement may permit an object to pass. In such an arrangement the release configuration of the catching arrangement may also define a free configuration.

An aspect of the present invention relates to a downhole actuator.

The downhole actuator may be suitable for use in actuating a downhole tool, system and/or process.

The downhole actuator may actuate or operate a downhole tool. The downhole tool may comprise an actuatable member.

The downhole tool may include any downhole tool, such as a valve, packer, inflow control device, choke, communication device, drilling assembly, pump, fracturing tool, catcher assembly, flow diverter, by-pass tool or the like, or any suitable combination of downhole tools.

The downhole actuator may comprise a tubular housing which includes or defines an indexing profile on an inner surface thereof. An indexing sleeve may be mounted within the housing and may be arranged to progress, for example linearly progress, through or within the housing towards an actuation site in a predetermined number of discrete steps of movement, for example linear movement, by passage of a corresponding number of actuation objects through a central bore of the indexing sleeve.

The indexing sleeve may be arranged such that a final discrete step of linear movement positions said sleeve at the actuation site. The indexing sleeve may be arranged such that a final discrete step of linear movement of the indexing sleeve permits said sleeve to actuate, or at least initiate actuation of, an associated downhole tool.

In use, a required number of actuation objects may be passed through the indexing sleeve to cause said indexing sleeve to move in a corresponding number of discrete steps towards the actuation site, to facilitate actuation of an associated downhole tool. In such an arrangement actuation of an associated downhole tool may at least be initiated upon the indexing sleeve reaching the actuation site.

An associated downhole tool may be completely actuated upon the indexing sleeve reaching the actuation site.

In some embodiments an associated downhole tool may be partially actuated upon the indexing sleeve reaching the actuation site. Such partial actuation may comprise preparing an associated downhole tool to be subsequently actuated. In such an embodiment, actuation of an associated tool may be subsequently achieved or completed by an alternative or associated actuation arrangement. Such an alternative or associated actuation arrangement may be operated by an actuation object. Such an actuation object may include an actuation object which has also moved the indexing sleeve a discrete step towards the actuation site. Such an actuation object may include an actuation object which has also moved the indexing sleeve a final discrete step towards the actuation site. In one embodiment an alternative or associated actuation arrangement may be operated by an actuation object which has also moved the indexing sleeve a final discrete step towards the actuation site. As such, the actuation object may complete movement of the indexing sleeve towards the actuation site and then subsequently operate an alternative or associated actuation arrangement for performing or completing actuation or operation of an associated downhole tool.

In an alternative embodiment a different actuation object from that which has moved the indexing sleeve a discrete step may be used to actuate or complete actuation of an associated downhole tool. The indexing sleeve may be configured to be positioned at the actuation site by passage of n actuation objects, wherein an associate downhole tool may be actuated by passage of n+m actuation objects, wherein m is any positive integer.

Causing the indexing sleeve to move in one or more discrete steps of movement may permit the downhole actuator, and associated downhole tool, to be used as part of a downhole system, in which one or more actuation objects are used in combination with other downhole actuators or tools. In some embodiments such a downhole system may include, for example, between 2 and 150, or more, downhole actuators or tools. Such actuators or tools may be operated in any desired sequence. Further, in such a system different downhole tools may be actuated, in a desired sequence, by the downhole actuators.

The indexing sleeve may comprise an engaging arrangement configured to cooperate with the indexing profile of the housing to be engaged by an actuation object passing through the central bore of the indexing sleeve to drive the indexing sleeve one discrete step.

The engaging arrangement may comprise at least one engagement member which cooperate with the indexing profile of the housing to be engaged by an actuation object passing through the central bore of the indexing sleeve to drive the indexing sleeve one discrete step.

The engaging arrangement may comprise first and second axially spaced engagement members which cooperate with the indexing profile of the housing to be engaged by an actuation object passing through the central bore of the indexing sleeve to drive the indexing sleeve one discrete step. The engagement members may define engagement protrusions.

At least one of the first and second engagement members may be engaged by an actuation object passing through the central bore of the indexing sleeve to drive the indexing sleeve one discrete step. In some embodiments both of the first and second engagement members may be engaged by an actuation object passing through the central bore of the indexing sleeve to drive the indexing sleeve one discrete step. In some embodiments the first and second engagement members may cooperate with the indexing profile to be sequentially engaged by an actuation object passing through the central bore of the indexing sleeve to drive the indexing sleeve one discrete step.

The first and second engagement members may be arranged relative to each other to permit only a single actuation object to be positioned therebetween. This may assist to eliminate or reduce the possibility of an actuation object passing through the indexing sleeve without also moving the indexing sleeve a corresponding discrete movement step. For example, in the event of two actuation objects passing through the indexing sleeve in close proximity, for example in quick succession, only one will be permitted to be positioned between the first and second engagement members during such passage. This may require a leading actuation object to complete a discrete movement step of the indexing sleeve before a trailing actuation object may fully act on the indexing sleeve. Such an arrangement may assist to mitigate a circumstance in which an actuation object passes through an indexing sleeve without being registered, and thus without causing a discrete linear movement step. Such a circumstance may cause difficulties, such as causing downhole tools to be actuated out of a desired sequence, causing a disparity between the actual setting of the actuator and an operator's understanding, which may be based only on the number of objects delivered downhole, and the like.

The relative arrangement between the first and second engagement members may be selected in accordance with an actuation object which is utilised to actuate and move the indexing sleeve a discrete step through the housing.

An actuation object may be delivered downhole from surface.

An actuation object may be driven towards and through a downhole actuator according to the invention by a pressure differential defined across the actuation object. An actuation object may be driven towards and through a downhole actuator according to the invention by its own momentum or kinetic energy resulting from it being entrained with a fluid flow, such as fluid flow established by pumping equipment. Such fluid flow may comprise a treating fluid, such as a fracturing fluid. An actuation object may be driven towards and through a downhole actuator according to the invention by the action of gravity.

The relative arrangement between the first and second engagement members may be related to at least the geometry of an actuation object. The relative arrangement may be related to an axial separation of the first and second engagement members. The axial separation of the first and second engagement members may be less than or equal to twice the width, for example diameter, of an actuation object.

The relative arrangement may be related to a permitted radially inward movement of the engagement members into the central bore. The axial spacing of the first and second engagement members may be inversely related to a permitted radially inward movement. When an actuation object comprises a ball, the axial spacing of the first and second engagement members may substantially correspond to a chord of a longitudinally extending cross section of the ball in which the two points of the chord correspond to a predetermined radially inward extension.

In some embodiments the downhole actuator may define a counting device or apparatus, specifically a mechanical counting device or apparatus. That is, the downhole actuator may reflect the number of actuation objects which have passed based on the position, for example linear position, of the indexing sleeve along the housing. The downhole actuator may facilitate actuation of an associated downhole tool upon passage of the desired or predetermined number of actuation objects. Preventing the passage of an actuation object without also registering a count by moving the indexing sleeve a corresponding discrete movement step may allow the apparatus to very accurately reflect the number of actuation objects which have passed. This may provide a number of advantages, such as preventing any early or late actuation of an associated tool, providing an operator with confidence in their understanding of the configuration of the actuator and associated tool at any time, and the like.

The engagement members may be configured or arranged to be sequentially engaged by a passing actuation object. In this arrangement the engagement members may be defined as upstream and downstream engagement members relative to the direction of travel of a passing actuation object. As such, in use, cooperation with the indexing profile of the housing may permit an actuation object to first engage the upstream engagement member, and then continue to engage the downstream engagement member, to drive the indexing sleeve one discrete step. In such an arrangement, the upstream and downstream engagement members may be defined in relation to the direction of travel of an actuation object. That is, the direction of travel of an actuation object may be defined as a downstream direction.

Additionally, or alternatively, the indexing sleeve may cooperate with the indexing profile of the housing to be moved in a discrete step in any direction of travel of a passing actuation object. As such, the indexing sleeve may be permitted to be driven in reverse directions by discrete linear movement steps, depending on the direction of travel of an actuation object. As such, the indexing sleeve may be configured to be driven in a forward direction, and/or a reverse direction. In such an arrangement, the forward direction may include one of a downhole direction and an uphole direction, and a reverse direction may include the other of a downhole direction and an uphole direction. This arrangement may permit one or more actuation objects to be reverse flowed through the downhole actuator following said one or more objects being forward flowed through the tool, while registering corresponding reverse discrete movement steps or counts. Accordingly, the linear position of the indexing sleeve within the housing may continuously reflect the number and direction of passing actuation objects.

Reverse flow may be achieved by production of fluids from a subterranean reservoir. Alternatively, or additionally, reverse flow may be achieved by reverse circulation of fluid within an associated wellbore. For example, reverse flow may be achieved by circulating fluid through an annulus defined between the downhole actuator and a wall of a bore hole or tubing within which the downhole actuator is located, and subsequently through the housing of the actuator.

Reverse flow may be established to reposition the indexing sleeve in a desired location within the housing, for example to reset the downhole actuator or the like. Such an arrangement may permit in situ resetting of the indexing sleeve within the actuator.

Reverse flow may be established to move the indexing sleeve towards an alternative actuation site, for example to initiate actuation of a different associated downhole tool. In such an arrangement the actuator may be associated with two downhole tools on opposing axial sides thereof, wherein the indexing sleeve may be driven in any desired direction to initiation actuation of any one, or both, of the associated downhole tools.

Reverse flow may be present or established in the event of a blockage. For example, reverse flow may be established to remedy a blockage within the downhole actuator, an associated downhole tool, or an associated downhole system.

Reverse flow may be established to return objects to surface.

The indexing sleeve may be reconfigurable, in situ, to permit sequential engagement of the engagement members in reverse directions of a passing actuation object. Such in situ reconfiguration may be achieved by an initial passage of an actuation object.

The indexing sleeve may be arranged, for example during commissioning, to accommodate passage of an actuation object in a first direction, such that said object may sequentially engage the first and second engagement members and move the indexing sleeve a discrete step in said first direction. When in such an arrangement initial passage of an actuation object in a second, reverse direction, may reconfigure the indexing sleeve such that passage of a further actuation object in the second direction may sequentially engage the engagement members in this second direction. During such reconfiguration, the actuation object initially passing in the second direction may engage only one of the first and second engagement members to move the indexing sleeve a required distance in the second direction to reconfigure the engagement members by cooperation with the indexing profile and allow subsequent sequential engagement by a further actuation object in the second direction. The actuation object initially passing in the second direction may drive the indexing sleeve an equivalent discrete movement step.

The indexing sleeve may be formed of a unitary component. Alternatively, the indexing sleeve may be formed from multiple components and appropriately assembled or arranged together.

The first and second engagement members may define a confinement region therebetween, for temporarily accommodating an actuation object during passage of said object through the indexing sleeve. The confinement region may be configured to permit only a single actuation object to be accommodated therein at any time.

The first and second engagement members may be arranged on the indexing sleeve to be selectively moved radially by cooperation with the indexing profile on the housing during movement of the indexing sleeve through the housing. Such radial movement of the first and second engagement members may selectively extend and retract said members relative to the central bore of the indexing sleeve. That is, the engagement members may be moved radially outwardly to be radially extended from the central bore, and moved radially inwardly to be radially retracted into the central bore. This arrangement may permit the engagement members to be selectively presented into a path of travel of an actuation object through the central bore of the indexing sleeve to allow said sleeve to be driven through the housing by one discrete step. Such radial movement of the first and second engagement members may sequentially present said members into the central bore and a path of travel of an actuation object to permit said object to sequentially engage the engagement members to drive the indexing sleeve through the housing by one discrete step.

The radial position of the first and second engagement members may be cyclically varied by cooperation with the indexing profile during movement of the indexing sleeve through the housing. In particular, the radial position of the first and second engagement members may be varied over one full cycle during one discrete step of linear movement of the indexing sleeve. That is, at the end of a complete discrete movement step each engagement member may return to a starting radial position, in preparation for engagement by a subsequent passing actuation object.

In use, the first and second engagement members may cooperate with the indexing profile on the housing such that a passing actuation object first engages one of the first and second engagement members, which may thus be defined as an upstream engagement member, to move the indexing sleeve a portion of a discrete linear step before entering a region between the first and second engagement members, which may be defined by a confinement region, and then engaging the other of the first and second engagement members, which may thus be defined as a downstream engagement member, to move the indexing sleeve a final portion of a discrete linear step.

The radial position of the first and second engagement members may be varied out of phase relative to each other by cooperation with the indexing profile during movement of the indexing sleeve through the housing. That is, one of the engagement members may be positioned radially inwardly and thus radially refracted into the central bore, while the other engagement member may be positioned radially outwardly and thus radially extended from the central bore, with the position of each member varying in an out of phase manner as the indexing sleeve moves linearly through the housing. Such an arrangement may permit the first and second engagement members to be sequentially engaged by an actuation object passing through the indexing sleeve. That is, in an initial configuration one engagement member, which may be defined as an upstream engagement member, may be radially retracted into the central bore, and the other engagement member, which may be defined as a downstream engagement member, may be radially extended from the central bore. In such an arrangement, an actuation object may engage the upstream engagement member and initiate movement of the indexing sleeve, with cooperation of the engagement members with the indexing profile during this initial movement causing the upstream engagement member to move radially outwardly and the downstream member to move radially inwardly, thus allowing the actuation member to move past the upstream engagement member and engage the downstream engagement member and complete the discrete movement step of the indexing sleeve.

One or both of the first and second engagement members may be mounted within a slot extending through a wall structure of the indexing sleeve. Such an arrangement may permit the engagement member to cooperate with the indexing profile of the housing to be moved radially and become selectively extended and retracted relative to the central bore of the indexing sleeve.

One or both of the first and second engagement members may be biased in a preferred radial direction. In one embodiment one or both of the first and second engagement members may be biased in a radially outward direction. In such an arrangement one or both of the first and second engagement members may be biased in a direction to be retracted from the central bore of the indexing sleeve. Such a bias may function to retain the indexing sleeve at a set position relative to the housing in the absence of a passing actuation object.

One or both of the first and second engagement members may be mounted on a respective finger provided as part of the engaging arrangement of the indexing sleeve. The finger may define a collet finger, such that the indexing sleeve may define a collet sleeve. The finger may be deformable to permit appropriate radial movement of the associated engagement member upon cooperation with the indexing profile. The finger may be resiliently deformable to provide a desired bias. A proximal end of the finger may be secured, for example by integrally forming, with the indexing sleeve. A distal end of the finger may support, for example by integrally forming, the associated engagement member.

An engagement member may be of a greater radial thickness than an associated finger. That is, an engagement member by define a greater radial dimension than an associated finger.

The finger may extend longitudinally relative to the indexing sleeve. In some embodiments the finger may extend circumferentially relative to the indexing sleeve.

The finger may define a tapering thickness, for example radial thickness. Such a tapering thickness may assist to control stress and/or strain within the finger. For example, such a tapering thickness may assist to provide uniform stress distribution within the finger during deformation thereof. Further, such a tapering thickness may permit the finger to bend more uniformly along its length, rather than focusing deformation at a discrete location.

In some embodiments the thickness of the finger may taper from one end of the finger to an opposite end. The thickness may taper from a root of the finger to a tip of the finger.

The thickness of the finger may taper in a linear manner. The thickness of the finger may taper in a non-liner, such as a curved, manner.

The finger may define a constant width, for example circumferential width.

The finger may be contained within a slot formed in a wall structure of the indexing sleeve.

In one embodiment the indexing sleeve may comprise first and second fingers which support a respective one of the first and second engagement members.

The first and second fingers may extend in a common direction. In this arrangement the first and second fingers may be arranged circumferentially relative to each other. In such an arrangement the first and second fingers may overlap in an axial direction.

The first and second fingers may extend in opposing directions. In one embodiment respective distal ends of the first and second fingers may be positioned adjacent each other. In alternative embodiments respective proximal ends of the first and second fingers may be positioned adjacent each other.

The engaging arrangement may comprise an array of first engagement members. The array of first engagement members may be arranged circumferentially. The array of first engagement members may be evenly circumferentially distributed. Alternatively, the array of first engagement members may be unevenly distributed. The array of first engagement members may be manipulated collectively, for example simultaneously, by cooperation with the indexing profile of the housing. Each first engagement member may be mounted on a respective first finger.

The array of first engagement members may define gaps therebetween. That is, adjacent first engagement members may define a gap therebetween. The array of first engagement members may define gaps therebetween when said first engagement members are positioned radially inwardly to be engaged by an actuation object. Such gaps may facilitate fluid transfer between the individual first engagement members. This may permit a degree of fluid bypass even when an actuation object is engaged with or against the first engagement members. Such fluid bypass may allow fluid to continue to circulate through the actuator even during passage of an actuation object. This may facilitate swift translation of an actuation object through the actuator. This may provide advantages in terms of allowing an actuation object to swiftly move through a downhole actuator, and subsequently onward to another downhole actuator or other tool for further actuation purposes.

In an alternative embodiment the array of first engagement members may be configured to be positioned in close proximity to each other, or engaged with each other, at least when the first engagement members are positioned radially inwardly to be engaged by an actuation object. That is, adjacent first engagement members may be configured to be engaged or positioned in close proximity. Such an arrangement may minimise fluid passage between individual first engagement members, for example when an actuation object is engaged with the first engagement members. Such an arrangement may provide a degree of sealing, which may permit a pressure differential to be established across an actuation object when engaged with the first seat members, to permit said actuation object to drive the indexing sleeve.

In some embodiments the housing may define an outer diameter in the region of 114.3 mm (4.5"), and the engagement arrangement may comprise eight (8) first engagement members. In such an embodiment the engagement members may be distributed around the indexing sleeve such that two engagement members are provided in each quadrant of the indexing sleeve.

In an alternative embodiment the housing may define an outer diameter in the region of 139.7 mm (5.5"), and the engagement arrangement may comprise twelve (12) first engagement members. In such an embodiment the engagement members may be distributed around the indexing sleeve such that three engagement members are provided in each quadrant of the indexing sleeve.

The engaging arrangement may comprise an array of second engagement members. The array of second engagement members may be arranged circumferentially. The array of second engagement members may be evenly circumferentially distributed. Alternatively, the array of second engagement members may be unevenly distributed. The array of second engagement members may be manipulated collectively, for example simultaneously, by cooperation with the indexing profile of the housing. Each second engagement member may be mounted on a respective second finger.

The array of second engagement members may define gaps therebetween. That is, adjacent second engagement members may define a gap therebetween. The array of second engagement members may define gaps therebetween when said second engagement members are positioned radially inwardly to be engaged by an actuation object. Such gaps may facilitate fluid transfer between the individual second engagement members. This may permit a degree of fluid bypass even when an actuation object is engaged with or against the second engagement members. Such fluid bypass may allow fluid to continue to circulate through the actuator even during passage of an actuation object. This may facilitate swift translation of an actuation object through the actuator.

In an alternative embodiment the array of second engagement members may be configured to be positioned in close proximity to each other, or engaged with each other, at least when the second engagement members are positioned radially inwardly to be engaged by an actuation object. That is, adjacent second engagement members may be configured to be engaged or positioned in close proximity. Such an arrangement may minimise fluid passage between individual second engagement members, for example when an actuation object is engaged with the second engagement members. Such an arrangement may provide a degree of sealing, which may permit a pressure differential to be established across an actuation object when engaged with the second seat members, to permit said actuation object to drive the indexing sleeve.

In some embodiments the housing may define an outer diameter in the region of 114.3 mm (4.5"), and the engagement arrangement may comprise eight (8) second engagement members. In such an embodiment the engagement members may be distributed around the indexing sleeve such that two engagement members are provided in each quadrant of the indexing sleeve.

In an alternative embodiment the housing may define an outer diameter in the region of 139.7 mm (5.5"), and the engagement arrangement may comprise twelve (12) second engagement members. In such an embodiment the engagement members may be distributed around the indexing sleeve such that three engagement members are provided in each quadrant of the indexing sleeve.

In some embodiments the array of first engagement members may define gaps therebetween, and the array of second engagement members may also define gaps therebetween. Such an arrangement may facilitate swift passage of an actuation object.

In some embodiments a flow rate of, for example, between 5 and 70 barrels per minute may be provided to advance an actuation object. The provision of fluid bypass past the first and/or second engagement members may permit such flow rates to be substantially maintained during passage of an actuation object. For example, a flow rate of 15 to 50 barrels per minute may be provided to advance an actuation object.

The first and second engagement members may each define a seat arrangement for allowing an actuation object to engage and seat against during passage through the indexing sleeve. An actuation object may drive the indexing sleeve through the housing when engaged and seated against a seat arrangement. The engagement members may define a seat arrangement on one axial side thereof. This may permit an actuation object to engage and seat against the engagement members in a single direction of movement. In some embodiments the engagement members may define a seat arrangement on opposing axial sides thereof. This may permit an actuation object to engage and seat against the engagement members in reverse directions of movement.

One or both of the first and second engagement members may define a seat surface to be engaged by an object. The seat surface may be arranged to provide a substantially continuous or complete engagement with an object.

The seat surface may be arranged to provide discontinuous or incomplete engagement with an object. Such an arrangement may permit non-sealing engagement to be achieved between the seat surface and an actuation object, for example to permit flow by-pass. In one embodiment a seat surface may comprise or define an axially extending slot or channel.

The seat surface may define a curved seat surface, such as a convex seat surface. Such an arrangement may be provided in combination with use of an actuation object having a curved, such as convex surface. Providing a curved seat surface, and in particular a convex seat surface, may assist to prevent or at least mitigate the swaging, jamming or otherwise lodging of an actuation object relative to the engagement members.

Providing a curved seat surface, and in particular a convex seat surface may permit a greater degree of control over the transmission of load forces between an actuation object and the associated engagement member, when engaged, and to other components of, or operatively associated with, the indexing sleeve. For example, such greater control may advantageously permit a preferred transmission of forces from an actuation object and via the individual engagement members into the indexing profile of the housing. Such a preferred transmission may be selected to minimise bending moments, for example, on the indexing sleeve, such as on individual fingers which support the engagement members.

The indexing sleeve may be advanced along the housing in a discrete movement step by energy provided by the object, for example kinetic energy.

The indexing sleeve may be advanced along the housing in a discrete movement step by impact of an actuation object against one or both of the first and second engagement members, for example sequential impact against the first and second engagement members. Such an arrangement may utilise the momentum of a passing actuation object to advance the indexing sleeve. This may permit the indexing sleeve to be driven by a relatively rapid advancement of an actuation object through said sleeve. Further, relying on an impact force of an actuation object against the first and second engagement members to advance the indexing sleeve may not necessarily require a fluid seal to be achieved between the object and the respective engagement members. In some embodiments, one or both of the first and second engagement members may be configured to provide a degree of fluid bypass when engaged by an actuation object, to facilitate substantially continuous flow through the downhole actuator, which may assist with rapid or swift translation of an actuation object, and corresponding rapid operation of the downhole apparatus. Such rapid translation of an actuation object may provide advantages in systems in which the actuation object is used to operate multiple actuators and/or tools.

The use of an impact force to advance the indexing sleeve may facilitate monitoring of the position of the indexing sleeve from a remote location. For example, impact of an actuation object against the engagement members may create an acoustic signal, which may be monitored from a remote location.

In some embodiments, although sealing may not be necessary between an object and the respective engagement members, a certain degree of flow restriction may be created during engagement with an object with the engagement members, which may create a variation in the pressure of a fluid flowing within the downhole actuator, for example a fluid used to drive the object through the downhole actuator. In some embodiments such a variation in pressure may facilitate monitoring from a remote location, by monitoring the variation in pressure.

In some embodiments the indexing sleeve may be advanced along the housing in a discrete step by a differential pressure applied between upstream and downstream sides of the indexing sleeve. Such a differential pressure may be created upon engagement of the object with each of the first and second engagement members. In one embodiment an actuation object may sequentially sealingly engage the first and second engagement members to facilitate creation of a differential pressure. Alternatively, an actuation object may sequentially engage the first and second engagement members to create a flow restriction and thus create a back pressure. Such a flow restriction may be provided between or around a point of contact of an actuation object and an engagement member. Alternatively, or additionally, such a flow restriction may be provided between the indexer and the housing when an actuation object is engaged with an engaging member.

The use of a differential pressure to advance the indexing sleeve may permit monitoring of the downhole actuator to be achieved from a remote location, for example by monitoring a variation in pressure and associating this variation with appropriate engagement of an actuator object with the engagement members. For example, upon and during engagement of an actuation object with an engagement member a pressure increase or spike may occur upstream of the object. This pressure increase may function to drive the actuation object and indexing sleeve within the housing. When an actuation object is released or is permitted to pass an engagement member, pressure may fall. Such a pressure variation may permit an operator to obtain an understanding of the progress of an actuation object.

In some embodiments the downhole actuator may be provided with or in combination with a monitoring apparatus or system, such as an acoustic monitoring apparatus or system, pressure monitoring apparatus or system, flow rate monitoring apparatus or system or the like.

The downhole actuator may comprise an anti-rotation arrangement provided between the indexing sleeve and the housing. The anti-rotation arrangement may comprise a key and key-way arrangement. In one embodiment the indexing sleeve may comprise one or more keys, such as longitudinal ribs, and the housing may comprise a key-way, such as a longitudinal slot configured to receive a key. Such an arrangement may permit relative longitudinal movement of the indexing sleeve through the housing, while preventing relative rotational movement.

The indexing sleeve may comprise a key provided, for example by integrally forming, on an outer surface of a wall structure between adjacent slots which contain circumferentially adjacent engagement members.

The anti-rotation arrangement may permit a milling operation to be performed on the indexing sleeve, for example to mill through the indexing sleeve as part of a remedial operation.

The downhole actuator may comprise a stand-off arrangement radially positioned between the tubular housing and the indexing sleeve. The stand-off arrangement may be configured to define a radial separation gap between the housing and the indexing sleeve. The stand-off arrangement may provide such a radial separation gap during movement of the indexing sleeve relative to the housing.

The radial separation gap may be provided to assist in preventing binding of the indexing sleeve within the housing, for example by debris, such as proppant material, adversely accumulating or becoming trapped between the housing and indexing sleeve.

The width of the radial separation gap may be provided at a preferred minimum gap width. Such a preferred minimum gap width may be selected in accordance with a fluid being communicated through the tool. In one embodiment a preferred minimum gap width may be defined or selected in accordance with the dimension of a particle or particles, such as proppant, being carried by a fluid communicated through the actuator. In such an arrangement the minimum gap width may be selected in accordance with the inability of individual particles to bridge the radial gap between the housing and the indexing sleeve.

In one embodiment the preferred minimum radial gap width between the housing and indexing sleeve may be defined in accordance with a mean dimension of particles, such as proppant, being carried by a fluid communicated through the tool. A preferred minimum gap width may be selected to be in the region of 1 to 20 times the mean particle diameter, for example in the region of 1 to 10 times the mean particle diameter, such as between 1 to 5 times the mean particle diameter. In one embodiment a preferred minimum gap width may be in the region or at least twice the mean particle diameter.

The stand-off arrangement may permit the indexing sleeve to be substantially concentrically positioned within the housing.

The stand-off arrangement may permit a substantially uniform gap to be provided between the indexing sleeve and the housing, for example to define a uniform annulus area.

The stand-off arrangement may comprise at least one rib positioned between the housing and the indexing sleeve.

The stand-off arrangement may comprise a plurality of circumferentially arranged ribs positioned between the housing and the indexing sleeve.

At least one rib may extend axially.

At least one rib may be provided on the indexing sleeve, for example mounted on the sleeve, integrally formed with the sleeve or the like.

At least one rib may be provided on the housing, for example mounted on the housing, integrally formed with the housing or the like.

At least one rib may define a v-shape profile at one or opposite axial ends thereof. Such a profile may permit the rib to readily drive or plough throw debris or material which may be present between the indexing sleeve and the housing.

At least one rib may define a tapering thickness, such as a tapering radial thickness. Such an arrangement may improve material flow around the at least one rib. The tapering thickness may define a ramp profile. One or both axial end regions of at least one rib may define a tapering thickness. The thickness may taper linearly, or alternatively non-linearly.

The downhole actuator may permit the indexing sleeve to be disabled, such that the indexing sleeve, when disabled, may not be moved upon passage of an actuation object. This arrangement may still allow an actuation object to pass through the indexing sleeve, for example for use in a further downhole actuator and downhole tool. The indexing sleeve may be disabled in accordance with a relative positioning within the housing. In this respect, the indexing sleeve may be moved from an enabled configuration to a disabled configuration.

The downhole actuator may be configured such that the indexing sleeve may be disabled at the actuation site. As such, upon reaching the actuation site to actuate an associated downhole tool, the indexing sleeve may also become disabled. This may prevent any further movement of the indexing sleeve following performance of its actuation function. Permitting the indexing sleeve to become disabled at the actuation site may maintain an associated downhole tool in an actuated state. For example, the indexing sleeve may function as a latch.

The downhole actuator may be configured such that the indexing sleeve may be disabled at a location remote from the actuation site. This arrangement may permit the indexing sleeve to be disabled prior to actuation of an associated downhole tool. For example, in some cases although a downhole tool and actuator may be installed downhole, for example as part of a completion, an operator may subsequently decide that the tool should not be activated, and the ability to disable the indexing sleeve at a location remote from the actuation site may permit this to be achieved. As such, the downhole actuator may provide additional flexibility for an operator. The indexing sleeve may be disabled at an uphole position relative to the actuation site.

In one embodiment the indexing profile may facilitate the indexing sleeve to become disabled. The indexing profile may comprise a disabled region, wherein alignment of the indexing sleeve with the disabled region of the indexing profile permits the indexing sleeve to become disabled.

The indexing profile may comprise a disabled region which coincides with the actuation site of the actuator. As such, the indexing sleeve may eventually be aligned with the disabled region by passage of an appropriate number of actuation objects through the indexing sleeve.

The indexing profile may comprise a disabled region which is remote from the actuation site. The indexing sleeve may be configured to be moved in an uphole direction to be moved towards the remote disabled region. The indexing sleeve may be moved to this remote disabled region by physical intervention, for example by use of a shifting tool or the like deployed into the downhole actuator. The indexing sleeve may define a profile to facilitate engagement by a shifting tool.

The indexing profile may define a disabled region at opposing axial ends of said indexing profile. As such, the indexing sleeve may be disabled when located at either end region of the indexing profile.

At least a portion of the indexing profile of the housing may be formed in the inner surface of said housing. At least a portion of the indexing profile of the housing may be formed in an insert which is mounted within the housing.

The indexing profile may define a longitudinal variation in the inner diameter of the housing.

The indexing profile of the housing may comprise a plurality of annular recesses arranged longitudinally along the housing.

Each annular recess may define a location of increased inner diameter of the indexing region of the housing. An intermediate surface between adjacent annular recesses may define a location of reduced inner diameter of the indexing region of the housing. Accordingly, the presence of a plurality of annular recesses may provide a variation of the inner diameter along the length of the housing, such that movement of the indexing sleeve through the housing permits the radial position of at least one engagement member, for example the first and second engagement members, of the engaging arrangement to be accordingly varied, and thus permit appropriate engagement by a passing actuation object.

During movement of the indexing sleeve longitudinally through the housing each engagement member may be sequentially received within adjacent annular recesses. When received within a recess an engagement member may be positioned radially outwardly and extended from the central bore of the indexing sleeve. When positioned intermediate adjacent recesses an engagement member may be positioned radially inwardly and thus retracted into the central bore of the indexing sleeve and thus presented into a path of travel of an actuation object through the indexing sleeve. Accordingly, a passing actuation object may act on the engagement members in accordance with cooperation of the engagement members with the annular recesses of the housing.

One or more annular recesses may comprise tapered or ramped sides to allow cooperation with the engagement members to move said engagement members radially upon linear movement of the indexing sleeve through the housing. Such tapered or ramped sides may assist with transition of the engagement members between radially outward and inward positions as the indexing sleeve is moved linearly through the housing. One or move annular recesses may define a ramp angle relative to a longitudinal axis of the housing. A ramp angle may be between 10 and 80 degrees, for example between 25 and 55 degrees, such as around 45 degrees.

At least one pair of annular recesses may be arranged at a different axial spacing than the first and second engagement members. At least one pair of adjacent annular recesses may be arranged at a different axial spacing than the first and second engagement members. Such an arrangement may permit the first and second engagement members to be alternately, for example in an out of phase manner, moved radially outwardly and inwardly during movement of the indexing sleeve through the housing.

The indexing profile may comprise multiple annular recesses arranged longitudinally along the housing at a common axial separation or pitch. Such an arrangement may permit an indexing sleeve to be moved in a number of equal discrete steps of movement. The common axial separation or pitch may differ from the axial separation of the first and second engagement members. In some embodiments a plurality of annular recesses may be longitudinally arranged at a common separation pitch, wherein the axial separation of the first and second engagement members differs from this separation pitch or an integer multiple of this separation pitch.

The indexing profile may comprise at least one pair of annular recesses which are arranged at an axial spacing which is equivalent to the axial spacing of the first and second engagement members. In such an arrangement appropriate positioning of the indexing sleeve within the housing may permit both the first and second engagement members to be simultaneously positioned within a respective recess and thus positioned radially outwardly and extended from the central bore, thus effectively disabling the indexing sleeve.

One axial end region of the indexing profile may comprise a pair of annular recesses provided at an axial spacing which is equivalent to the axial spacing of the first and second engagement members. In such an arrangement, upon reaching the axial end region of the indexing profile the indexing sleeve may become disabled. This axial end region may comprise or define an actuation site. This axial end region may comprise or define an end region which is remote from an actuation site.

Opposing axial end regions of the indexing profile may comprise a pair of annular recesses with an axial spacing which corresponds to the axial spacing of the first and second engagement members of the indexing sleeve. Such an arrangement may permit the indexing sleeve to be disabled upon location at either axial end region of the indexing profile.

The indexing sleeve may be initially positioned, for example during commissioning, at any desired location along the indexing profile. Such an initial position along the indexing profile may determine the required number of actuation objects, and thus required discrete steps of movement, to drive the indexing sleeve to the actuation site and actuate an associated downhole tool. Such ability to initially position the indexing sleeve at a desired position may permit improved flexibility of the downhole actuator. In some embodiments such flexibility may permit multiple downhole actuators to be provided as part of an actuation system, in which multiple downhole tools must be actuated, for example in a desired sequence, by common actuation objects. That is, the indexing sleeve of different downhole actuators within a common system may be initially set to reach an actuation site upon passage of a different number of actuation objects. This arrangement may provide advantages in many downhole operations. For example, in some well fracturing operations it may be desirable to sequentially fracture discrete regions along the length of a formation. As such, fracturing tools in different regions may be sequentially actuated by an associated downhole actuator which includes an appropriately set or positioned indexing sleeve. Further, in some wellbore operations different types of tool may require actuation at different times. For example, in some embodiments one or more packers may require to be actuated and set, prior to subsequent actuation of one or more different tools, such as fracturing tools or the like. Appropriate positioning of individual indexing sleeves associated with the various downhole tools may permit the desired actuation sequence to be achieved.

The housing may be provided as a single component.

The housing may be modular. The housing may comprise multiple housing modules connected together, for example by a threaded connection, to collectively define the housing. Individual modules may define a portion of the indexing profile, such that when the individual modules are connected together the entire indexing profile is formed. One or more individual modules may form part of a downhole tool.

Adjacent housing modules may be secured together such that an indexing profile feature is defined at an interface therebetween. Adjacent housing modules may each define a portion of a profile feature such that when connected the complete profile feature is formed. Such an arrangement may assist to ensure that when individual modules are connected together the complete indexing profile is arranged as originally desired, and the possibility of forming an incorrect profile geometry is minimised.

In one embodiment adjacent housing modules may define a portion of an annular recess, such that when connected a complete annular recess may be defined.

Adjacent housing modules may be configured to be connected together via male and female connectors, typically threaded connectors.

A sealing arrangement may be provided between adjacent housing modules

The provision of a modular housing may permit the downhole actuator to be readily modified according to a precise required use. Further, such an arrangement may minimise the requirement for bespoke systems, and may allow multiple specific situations to be accommodated with a basic inventory of individual modules. For example, one downhole actuator may require an indexing profile which accommodates ten discrete movement steps of an indexing sleeve, and another downhole actuator, which may be part of the same downhole system, may require an indexing profile which accommodates fifteen discrete movement steps of an indexing sleeve. In such a case an inventory of housing modules each defining a portion of an indexing profile with five discrete steps may permit each actuator requirement to be fulfilled. Of course, any specific system with a desired number of movement steps may be accommodated in this manner, in combination with an advantageous ability to initially position the indexing sleeve at any position within the housing.

Further aspects of the present invention relate to a kit of parts which may be assembled to provide a downhole actuator. The kit of parts may comprise a plurality of housing modules which include connectors to permit connection of the modules together to define a housing with an indexing profile on an inner surface thereof for cooperation with an indexing sleeve mounted within the housing. The kit of parts may include an indexing sleeve. The kit of parts may include any other component, system or arrangement as defined herein.

The downhole actuator may permit inspection prior to running into a wellbore to confirm the location of the indexing sleeve relative to the indexing profile of the housing. Such inspection may avoid or minimise the risk of deploying an actuator which has the indexing sleeve located at an incorrect position. Also, where multiple downhole actuators are to be installed as part of a common system, the ability to readily inspect each actuator can minimise the risk of the actuators being deployed out of a desired sequence.

The downhole actuator may be provided in combination with an inspection apparatus for determining or confirming an initial location of the indexing sleeve. An aspect of the present invention relates to such an inspection apparatus.

The inspection apparatus may comprise an inspection object mounted on an elongate member. In use, the inspection apparatus may be inserted into the downhole actuator, for example from one end of the housing, until the inspection object engages the indexing sleeve and the elongate member extends from the housing. When the inspection apparatus is in this fully inserted position the apparatus may provide a user with a reference, for example a visual reference, which permits the location of the indexing sleeve within the housing to be identified or determined.

The elongate member may comprise one or more user identifiable graduations or markings, such as surface markings or the like. Such markings may assist a user to determine the location of the indexing sleeve relative to the housing. For example, a marking aligned with a reference feature on the housing, such as a terminating end of the housing, may allow a user to determine the relative location of the indexing sleeve.

The elongate member may be composed of a single component. Alternatively, the elongate member may be composed of multiple components secured together in end-to-end relation. This modular arrangement of the elongate member may facilitate flexibility and compatibility with multiple sizes of actuator and the like.

The inspection object may be engageable with one of the first and second engagement members.

The inspection object may replicate or be in a similar form as an actuation object.

The inspection apparatus may be configured to be inserted into the housing when said housing is connected to a further apparatus, such as a downhole tool.

The inspection apparatus may be arranged to be inserted into a downhole end of the actuator.

The inspection apparatus may be similar to an apparatus configured to install the indexing sleeve within the housing and positioned the indexing sleeve with the engagement members at a predetermined position within the housing. In one embodiment the inspection apparatus may define or form part of an assembly apparatus, for use in assembling the indexing sleeve within the housing, and allowing a user to readily identify the position of the indexing sleeve relative to the housing during assembly.

The downhole actuator may be provided separately from a downhole tool to be actuated. In such an arrangement the downhole actuator may be connected to or otherwise arranged adjacent to a downhole tool to permit the actuator to actuate the downhole tool.

In some embodiments the downhole actuator may be deployable into a wellbore independently of a downhole tool to be actuated. For example, the downhole actuator may be deployed and arranged adjacent to a previously deployed downhole tool.

The downhole actuator may be deployable into a wellbore in combination with a downhole tool. For example, the downhole actuator and downhole tool may form part of a common tool string.

The downhole actuator may be provided in combination with a downhole tool, for example as part of a common downhole tool string or assembly. The downhole actuator may comprise a downhole tool.

In some embodiments the housing of the downhole actuator may define a housing, or at least a portion of a housing of a downhole tool.

The downhole actuator may be for use in actuating a downhole valve. The downhole actuator may be for use in actuating a downhole fracturing valve. The downhole actuator may be for use in actuating a flow by-pass valve. The downhole actuator may be for use in actuating an inflow control valve.

The downhole actuator may be for use in actuating a downhole catching arrangement. Such a catching arrangement may be for use in catching an object, such as an object used to operate the downhole actuator.

The downhole actuator may be for use in actuating one or more slips, such as anchor slips. For example, the downhole actuator may directly and mechanically manipulate or operate one or more slips. Alternatively, or additionally, the downhole actuator may function to provide a degree of fluid communication control, for example to permit selective hydraulic operation of one or more slips.

The downhole actuator may be for use in actuating one or more downhole seals, such as packers. For example, the downhole actuator may directly and mechanically manipulate or operate a packer, for example by providing a mechanical force, such as an axial force, compression force or the like, to set, or unset, a packer. Alternatively, or additionally, the downhole actuator may function to provide a degree of fluid communication control, for example to permit selective hydraulic operation of a packer, for example to establish fluid communication between a packer assembly and a source of hydraulic power. For example, the downhole actuator may establish communication between a packer assembly and local hydrostatic pressure within a wellbore.

The downhole actuator may be for use in actuating one or more explosive charges, such as might be used in a perforation gun.

The downhole actuator may be for use in actuating one or more downhole switches, for example to reconfigure one or more downhole tools.

The downhole actuator may be for use in releasing on object, substance, chemical or the like from a downhole storage position. For example, the downhole actuator may be for use in releasing an object, such as an RFID tag or component, from a downhole location, to be subsequently transported within a wellbore system. The downhole actuator may be for use in releasing a chemical, such as a tracer chemical or the like from a downhole location.

An aspect of the present invention relates to a downhole actuator, comprising:

a tubular housing; and an indexing sleeve mounted within the housing and comprising an engaging arrangement which is engageable by an actuation object passing through a central bore of the indexing sleeve to drive the indexing sleeve one discrete step of movement through the housing towards an actuation site;

wherein the indexing sleeve is configured to be disabled when located at a disable region within the housing, such that the indexing sleeve, when disabled, is not moved upon passage of an actuation object.

The indexing sleeve may be configured to be disabled at the actuation site.

The indexing sleeve may be configured to function as a latch for a downhole tool when said indexing sleeve is disabled at the actuation site.

The indexing sleeve may be configured to be disabled at a location remote from the actuation site.

The tubular housing may define an indexing profile on an inner surface thereof, wherein the engaging arrangement of the indexing sleeve cooperates with said indexing profile to be engaged by an actuation object.

The indexing profile may facilitate the indexing sleeve to become disabled.

The indexing profile may comprise a disabled region, wherein alignment of the indexing sleeve with the disabled region of the indexing profile may permit the indexing sleeve to become disabled.

The indexing profile may comprise a disabled region which coincides with the actuation site of the actuator.

The indexing profile may comprise a disabled region which is remote from the actuation site.

The indexing sleeve may be configured to be moved towards the remote disabled region by use of a shifting tool.

The indexing sleeve may define a shifting profile to facilitate engagement by a shifting tool.

An aspect of the present invention relates to an indexing sleeve. Such an indexing sleeve may be as defined herein.

The indexing sleeve may be configured to be driven by one or more actuation objects, such as balls, darts or the like.

The indexing sleeve may be configured to be driven in a discrete movement step by an actuation object. The indexing sleeve may be configured to be driven in a number of discrete movement steps by a corresponding number of actuation objects.

The indexing sleeve may be configured to cooperate with an indexing profile on a separate object or structure. The indexing sleeve may be configured to cooperate with an indexing profile on a housing within which the indexing sleeve is mounted.

The indexing sleeve may include an engaging arrangement to permit engagement with an actuation object. The engaging arrangement may permit engagement with an indexing profile. In one embodiment cooperation and engagement between the engaging arrangement, actuation object and indexing profile may permit the indexing sleeve to be driven by a discrete movement step.

The engaging arrangement may include at least one engagement member. The at least one engagement member may be radially moveable. Such radial movement may permit the at least one engagement member to be moved radially inwardly and outwardly to be selectively engaged by an actuation object and optionally an indexing profile. Such an actuation object may pass through the indexing sleeve.

The engaging arrangement may comprise first and second engagement members. The first and second engagement members may be axially spaced from each other. The first and second engagement members may be configured to be sequentially engaged by an actuation object passing through the indexing sleeve to drive the indexing sleeve a discrete movement step.

The first and second engagement members may be arranged relative to each other to permit only a single actuation object to be positioned therebetween.

The indexing sleeve may be used in any suitable arrangement. For example, such an indexing sleeve may be used in an actuator, such as a downhole actuator. For example, the indexing sleeve may be moved in one or more discrete movement steps towards an actuation site. Upon reaching an actuation site actuation of an associated tool may be initiated.

An aspect of the present invention relates to a downhole system comprising a downhole actuator and a downhole tool to be operated by the downhole actuator. The downhole actuator may be as defined above.

The downhole system may comprise multiple downhole actuators, each configured to operate one or more downhole tools.

An aspect of the present invention relates to a downhole tool. The downhole tool may comprise a tool housing defining a central bore and including a fluid port, such as a fluid port in a wall of the tool housing. The fluid port may define a transverse fluid port. The fluid port may be configured to permit fluid communication between the central bore and a location external to the housing. The fluid port may extend in any suitable direction. The fluid port may extend generally perpendicularly relative to the central bore. In some embodiments the fluid port may extend generally obliquely relative to the central bore. The fluid port may extend in varying directions, for example portions of the fluid port may extend at least one of perpendicularly, parallel and obliquely relative to the central bore. The fluid port may be circular. The fluid port may be elongate, for example elongate in a longitudinal direction of the housing.

A valve member may be mounted within the housing. The valve member may be moveable from a closed position in which the fluid port is blocked to an open position in which the fluid port is opened.

The valve member may comprise a valve sleeve. The valve member may comprise a ball valve, flapper, gate or the like. The valve member may be rotatably movable. The valve member may be linearly or axially movable.

The fluid port may be opened to provide fluid communication between the central bore of the tool and an external downhole location, such as an annulus, a surrounding formation or the like. The fluid port may be arranged to accommodate one or both of outflow and inflow.

A catching arrangement, such as a catching sleeve, may be mounted within the housing, for example on a downhole side of the valve sleeve. The catching arrangement may comprise one or more radially moveable seat members. The catching arrangement may be configurable from a free configuration in which the seat members permit an object to pass through the tool, to a catching configuration in which the seat members catch an object passing through the tool.

The catching arrangement may be reconfigured by movement of the valve member towards its open position. In such an arrangement movement of the valve member towards its open position may function to initiate opening of the fluid port and also reconfigure the catching arrangement into its catching configuration.

When the catching arrangement is configured in its catching configuration an object passing through the downhole tool may seat against the seat members and become caught in the downhole tool. Where the catching arrangement is located downhole of the valve member, the catching arrangement may function to catch an object on a downhole side of the valve member and the fluid port.

When an object is caught by the catching arrangement, the object may at least partially block flow through the central bore. This may function to divert flow through the fluid port when opened.

When an object is caught by the catching arrangement the object may function to cause movement, such as axial movement of the catching arrangement. Such movement may function to provide further actuation within the downhole tool, such as further actuation of the valve member, to further reconfigure the catching arrangement, or the like.

In one embodiment the fluid port may be opened to permit a treating fluid to be delivered from the central bore to an external location via the fluid port. Such a treating fluid may be for use in treating a surrounding formation. The treating fluid may comprise a fracturing fluid for use in fracturing a surrounding formation, for example hydraulically fracturing a formation. The treating fluid may comprise a proppant.

The treating fluid may comprise an acid, for example for acid matrix stimulation of a surrounding formation.

The downhole tool may define a fracturing tool.

A treating fluid may be for use in treating a wellbore, such as a wall surface of a wellbore, wellbore infrastructure or the like.

The fluid port may be opened to permit a sealing fluid, such as cement, a swellable slurry or the like to be delivered from the central bore to an external location, for example for use in annulus isolation. The fluid port may be opened to permit a loss-circulation material to be circulated outwardly from the tool.

The fluid port may be opened to permit inflow of a fluid into the central bore of the tool.

The downhole tool may be configured to permit an object to be caught in the catching sleeve substantially simultaneously with or after the fluid port has been opened. In such an arrangement an object may be caught by the catching arrangement after the fluid port has been opened. This may permit a fluid flowing through the central bore of the tool housing to be substantially arrested or restricted upon the object seating against the seat members and thus rapidly ejected through the fluid port. Such rapid ejection may provide an impulse or fluid hammer effect which may assist with initial penetration of the fluid into a surrounding formation. This may have particular application in fracturing operations, in which initial rapid ejection of fluid from the fluid port may assist with initial fracture of the surrounding formation.

In some embodiments this initial rapid ejection of fluid may permit monitoring of the tool to be achieved. For example, a monitored pressure spike followed by a relatively quick reduction in pressure upstream of the downhole tool, such as upstream of the catching arrangement, may provide an indication that the fluid port has been successfully opened and an object has been caught in the catching arrangement.

The downhole tool may be configured to permit an object to be caught in the catching arrangement prior to opening, or prior to complete opening, of the fluid port. In such an arrangement an object may be caught by the catching arrangement before the fluid port has been opened or fully opened. Once the object is caught, the fluid port may subsequently be opened or fully opened, for example by actuation by the catching arrangement, by gradual increase of the fluid port area or the like. This arrangement may permit increased control over ejection of fluid through the fluid port. Further, this arrangement may avoid or minimise any initial rapid ejection of fluid through the fluid port at the time the object lands within the catching arrangement. That is, in this arrangement fluid flowing through the tool may be substantially arrested or restricted by the object when seated against the seat members of the catching arrangement, with the fluid port closed or only partially open, thus minimising any significant rapid ejection through the fluid port. The port may then be opened, allowing gradual initiation of full ejection rates through the port. This may be advantageous in certain applications where an operator may wish to avoid rapid ejection, for example to avoid damage to downhole systems or equipment or to the surrounding formation.

In some embodiments rapid initial ejection may cause an initial period of pressure fluctuations before a steady state condition is achieved. For example, rapid initial ejection may cause an initial pressure spike, followed by a subsequent pressure reduction below an intended operational pressure, prior to a more steady state pressure being achieved. In some cases this dynamic pressure variation or profile may provide adverse effects, for example by causing premature release of a caught object or the like. For example, should release of an object from the catching arrangement be in response to a force or sequence of force events, then establishing initial pressure fluctuations within the tool may inadvertently replicate such a force or sequence of force events, and prematurely release an object. As such, avoiding rapid fluid ejection, for example as defined above, may be advantageous in this regard also. For example, avoiding rapid initial ejection of fluid through the fluid port may permit the pressure within the tool to be controlled in a more uniform or steady state manner, which may avoid any pressure fluctuations which could otherwise adversely affect any downhole systems or operations.

The downhole tool may comprise a choke arrangement associated with the fluid port. Such a choke arrangement may function to choke flow through the fluid port once opened.

The downhole tool may comprise a variable choke arrangement associated with the fluid port. The variable choke arrangement may be configured to provide a varying degree of choking to a flow through the fluid port once opened. The variable choke arrangement may be configured to provide a decreasing degree of choking to a flow through the fluid port once opened. In such an arrangement, a maximum choking effect may be achieved upon opening of the fluid port, with the degree of choking decreasing over time. Such an arrangement may permit the pressure within the tool to be initially increased upon opening of the fluid port, but then gradually reduced following opening of the fluid port.

The variable choke arrangement may permit monitoring of the tool to be achieved. For example, upon opening of the fluid port the presence of the choke arrangement may provide a pressure increase followed by a gradual reduction in pressure. This may allow an operator monitoring the pressure to identify correct operation of the tool, for example that the fluid port has opened sufficiently.

The variable choke arrangement may comprise a valve arrangement.

The variable choke arrangement may comprise the valve member. For example, the valve member may provide a variable opening of the fluid port to achieve variable flow choking The choke arrangement may comprise a choke member associated with, for example mounted over or within, the fluid port. The choke arrangement may define a variable orifice to provide variable choking to flow through the fluid port. The choke arrangement may define a variably increasing orifice to provide a variably decreasing choking effect.

The choke arrangement may comprise a dissipating member associated with the fluid port. The dissipating member be arranged to dissipate in response to flow through the fluid port. The dissipating member may define an orifice, wherein said orifice is enlarged in response to flow through the fluid port. In such an arrangement, dissipation of the dissipating member may provide a reducing fluid choking effect.

The dissipating member may be dissipated by erosion, and as such the dissipating member may be erodible. Such an erodible dissipating member may be of particular use in combination with a fracturing fluid which includes proppant.

The dissipating member may be dissipated by disintegration, for example by being broken up.

The choke arrangement may comprise a curved plate which is mounted on the tool housing. The choke arrangement may be mounted on an outer surface of the housing. In embodiments where multiple fluid ports are provided a single or a plurality of choke arrangements may be provided to operate in conjunction with the multiple fluid ports.

The valve member may be moveable from its closed position towards its open position in response to an object passing through the downhole tool in a downhole direction. The same object which causes movement of the valve member towards its open position may be caught by the catching arrangement. Alternatively, a different object may be caught.

The valve member may be axially movable by an actuation member or arrangement mounted on an uphole side of the valve member. The actuation member may move the valve member in a downhole direction.

The valve member may be axially moveable by an indexing sleeve. The indexing sleeve may be provided as described above. The indexing sleeve may be provided in accordance with a collet as disclosed in WO 2011/117601 and/or WO 2011/117602. The disclosure provided in WO 2011/117601 and WO 2011/117602 is incorporated herein by reference.

The indexing sleeve may form part of the downhole tool. The indexing sleeve may form part of a downhole actuator, which may be provided in combination with, or integrally with the downhole tool.

The indexing sleeve may be located on an uphole side of the valve member. In such an arrangement the indexing sleeve may function to move the valve member in a downhole direction. In one embodiment the indexing sleeve may be engageable, directly or indirectly, with the valve member.

The indexing sleeve may be operated to move linearly through the housing by passage of an object. In one embodiment the indexing sleeve may be operated to move in a single discrete linear movement step to move the valve member towards its open position.

In some embodiments the indexing sleeve may be operated to move in a number of discrete linear movement steps by passage of a corresponding number of objects.

A plurality of discrete movement steps of the indexing sleeve may function to move the valve member towards its open configuration. In such an arrangement a final discrete movement step of the indexing sleeve may function to move the valve member sufficiently to reconfigure the catching arrangement to its catching configuration.

A final discrete movement step of the indexing sleeve may initiate movement of the valve member towards its open position, and thus allow the catching arrangement to become reconfigured during this final discrete movement step. The indexing sleeve may be brought into engagement with the valve member during a final discrete movement step of the indexing sleeve.

Thus, following a final discrete step of linear movement of an indexing sleeve caused by a passing object, the valve member may be moved towards its open position and the catching arrangement may be arranged in its catching configuration. The catching arrangement may thus be arranged to catch an object, such as the object which caused the final discrete movement step of the indexing sleeve.

In use, the indexing sleeve may be configured to temporarily capture a passing object to permit the object to drive the indexing sleeve a discrete movement step, and subsequently release the object upon completion of the discrete movement step. During a final discrete movement step of the indexing sleeve by a temporarily captured object, the valve member may be moved sufficiently to reconfigure the catching arrangement to its catching configuration, such that the object may be caught by the catching arrangement following release from the indexing sleeve.

The valve member and indexing sleeve may be arranged relative to each other such that the valve member may be completely moved to its open position during the final discrete movement step of the indexing sleeve. In such an arrangement the fluid port may be opened, for example partially or fully opened, during the final discrete movement step of the indexing sleeve.

The indexing sleeve may be configured to release an object substantially simultaneously with or subsequent to the valve member being positioned to open the fluid port and reconfigure the catching arrangement to its catching configuration. In such an arrangement the released object may be caught by the catching arrangement after the fluid port has been opened. This may permit a fluid flowing through the central bore of the tool housing to be substantially arrested or restricted upon the object seating against the seat members and thus rapidly ejected through the fluid port. Such rapid ejection may provide a fluid hammer effect.

Alternatively, the valve member and the indexing sleeve may be arranged relative to each other such that the valve member may be partially moved towards its open position during the final discrete movement step of the indexing sleeve. In such an arrangement the fluid port may remain closed, or be only partially open, following the final discrete movement step of the indexing sleeve. In such an arrangement movement of the valve member to its open configuration may be completed by an alternative arrangement. For example, movement of the valve member may be completed by the catching arrangement and a caught object. In one embodiment an object seated against the seat members of the catching arrangement may permit the catching arrangement to be moved axially within the housing, for example by a fluid pressure differential across the interface between the object and the seat members. Such axial movement of the catching arrangement may cause further axial movement of the valve member to complete opening of the fluid port.

The indexing sleeve may be configured to release an object following positioning of the valve member to reconfigure the catching arrangement to its catching configuration with the fluid port still closed or only partially open. In such an arrangement the released object may be caught by the catching arrangement before the fluid port has been opened or fully opened. Once the object is caught, the fluid port may subsequently be fully opened, for example by actuation by the catching arrangement. This arrangement may permit increased control over ejection of fluid through the fluid port. Further, this arrangement may avoid or minimise any initial rapid ejection of fluid through the fluid port at the time the object lands within the catching arrangement.

In one embodiment the valve member may reconfigure the catching arrangement to its catching configuration upon the valve member reaching its open position. In such an arrangement the catching arrangement may be permitted to catch an object after the fluid port in the tool housing has been opened. This may permit a fluid flowing through the central bore of the tool housing to be arrested or restricted within the central bore of the tool upon an object seating against the seat members and thus rapidly ejected through the fluid port.

In one embodiment the valve member may reconfigure the catching arrangement into its catching configuration prior to said valve member reaching its open position. Such an arrangement may permit more controlled opening of the fluid port, which may minimise rapid initial ejection of fluid. In one embodiment the valve member may be fully actuated to open the fluid port by the catching arrangement. In such an arrangement the catching arrangement may be operated to move by the caught object.

The valve member may be secured relative to the housing via a releasable connection. Such a releasable connection may be provided to releasably secure the valve member at its closed position. The releasable connection may be releasable to permit movement of the valve member towards its open position, for example axial movement of the valve member towards its open position. The releasable connection may be releasable upon application of a predetermined force, such as a predetermined axial force. The releasable connection may comprise a shear arrangement, such as one or more shear pins or the like.

The catching arrangement may be reconfigured to its catching configuration by axial movement of the catching arrangement within the housing.

The catching arrangement may be secured relative to the housing via a releasable connection. Such a releasable connection may be provided to releasably secure the catching arrangement in its free configuration. The releasable connection may be releasable to permit axial movement of the catching arrangement to become reconfigured towards its catching configuration. The releasable connection may be releasable upon application of a predetermined force, such as a predetermined axial force. The releasable connection may comprise a shear arrangement, such as one or more shear pins or the like.

The catching arrangement may be arranged to be axially moved by the valve member.

The valve member may axially engage the catching arrangement to move the catching arrangement. Such axial engagement may be achieved by abutment of the valve member and catching arrangement in an axial direction. Such abutment may be achieved by respective load profiles on the valve member and catching arrangement. A load profile may comprise an end face, load shoulder or the like.

The downhole tool may comprise a lost motion arrangement provided between the valve member and the catching arrangement. Such a lost motion arrangement may permit the valve member to move a desired distance relative to the catching arrangement before initiating axial movement of the catching arrangement. The lost motion arrangement may be defined by an initial axial separation of respective load profiles of the valve member and catching arrangement. The lost motion arrangement may be adjustable.

The lost motion arrangement may permit an appropriate timing of reconfiguring the catching arrangement to be achieved. For example, the lost motion arrangement may permit an appropriate timing of reconfiguring the catching arrangement in accordance with opening of the fluid port. Such timing may be provided in accordance with release of an object from an associated indexing sleeve or the like. Such timing of events may be as described above.

The valve member and catching arrangement may be axially engaged and connected when one of the valve member and catching arrangement is moved in a direction towards the other. Such an arrangement may permit the valve member to move the catching arrangement in the same direction of travel as the valve member. The valve member and catching arrangement may be axially disengaged when one of the valve member and catching arrangement is moved in a direction away from the other. Such an arrangement may permit independent axial movement of the valve member and catching arrangement when moved away from each other. Such an arrangement may facilitate independent actuation of the catching arrangement, for example to be reconfigured towards a release configuration in which a caught object may be released.

The valve member and the catching arrangement may be rigidly secured together in an axial direction. In such an arrangement axial movement of the valve member in any direction may cause corresponding axial movement of the catching arrangement. Furthermore, such a rigid connection may permit axial movement of the catching arrangement in any direction to cause corresponding axial movement of the valve member. Such an arrangement may be advantageous where the catching arrangement must axially move the valve member, for example to complete movement of the valve member to its open position. A rigid connection between the valve member and the catching arrangement may be releasable, for example in response to a predetermined force applied between said valve member and catching arrangement. Such an arrangement may permit the valve member and catching arrangement to become axially separated, at least in one relative axial direction. Such axial separation may permit the catching arrangement to be independently actuated relative to the valve member, if desired, for example to further reconfigure the catching arrangement, such as towards a release configuration, without disturbing the valve member.

The valve member may comprise an axially extending shroud which extends into the catching arrangement from one axial end thereof. In such an arrangement the end region, which may be the uphole end region of the catching arrangement may sit radially behind or on the outside of the valve member shroud, and thus isolated from the central bore. Such an arrangement may function to protect the end of the catching arrangement, for example from engagement by an object travelling through the tool. Otherwise, an object passing through the tool may engage an exposed end face of the catching arrangement, which could provide adverse effects, such as damaging the catching arrangement, causing premature activation of the catching arrangement and the like.

The shroud may extend only partially through the catching arrangement. The shroud may terminate above the seat members to avoid interference with said seat members.

The shroud may extend into the catching arrangement at least when the catching arrangement is configured in its free configuration.

The shroud may be generally cylindrical.

The shroud may comprise one or more ribs or fingers extending axially from the valve member.

The shroud may be integrally formed with the valve member. Alternatively, the shroud may be separately formed and subsequently secured or arranged with the valve member.

The shroud may define a proximal end which is engaged with the valve member, for example integrally formed with the valve member. The shroud may further define a distal or free end which is arranged to extend into the catching arrangement.

The valve member may define a load shoulder in the region of the proximal end of the shroud for engaging a corresponding load face, such as an axial end face, of the catching arrangement.

The valve member may define an annular notch formed in an outer surface and extending from one end thereof, such as a downhole end. An adjacent axial end, such as an uphole end of the catching arrangement may be received within this annular notch. As such, the annular notch may define a shroud.

The annular notch may include a load shoulder, such as an annular load shoulder for engaging the catching arrangement.

The annular notch may define a portion of a lost motion arrangement. For example, the catching arrangement may be initially positioned relative to the valve member such that an axial separation exists between the catching arrangement and a load shoulder of the annular notch, wherein this separation is closed upon relative movement of the valve member towards the catching arrangement.

The seat members may be radially moveable to be radially extended and retracted relative to the central bore. That is, the seat members may be moveable radially inwardly to be retracted into the central bore to define a reduced inner diameter. The seat members may be moveable radially outwardly to be radially extended from the central bore to define an increased inner diameter. When the seat members are positioned radially inwardly and retracted into the central bore said members may be positioned into the path of an object passing through the tool. When in such a configuration the seat members may be engaged by an object. When the seat members are positioned radially outwardly and extended from the central bore said members may be outside the path of an object travelling through the tool.

The seat members may be biased in a radial direction.

In one embodiment the seat members may be biased radially outwardly. In such an arrangement the seat members may require to be positively moved against this bias to be moved radially inwardly and be retracted into the central bore to be engaged by an object. Thus, when the catching arrangement is in its free configuration an object may freely pass through the tool without or with minimal engagement with the seat members. The catching arrangement may be reconfigured into its catching configuration by positively moving the seat members radially inwardly into the central bore against the bias to catch an object.

Biasing the seat members radially outwardly may minimise the exposure of the seat members to objects or fluid passing through the tool when the catching arrangement is in its free configuration. This may minimise energy losses of a fluid and/or objects flowing through the tool. Also, this may minimise erosion or other damage to the seat members. For example, in some proposed uses of the tool a fluid carrying highly abrasive particles, such as proppant, may flow through the tool, which may erode the seat members.

In one embodiment the seat members may be biased radially inwardly. In such an arrangement the seat members may require to be positively moved against this bias to be moved radially outwardly and be extended from the central bore to allow passage of an object, when required. Such outward radial movement of the seat members may be caused by an object acting against the seat members during passage of the object through the tool when the catching arrangement is configured in its free configuration.

The catching arrangement may be reconfigured to its catching configuration by radially supporting the seat members in a radially inward position such that outward radial movement is prevented. In such a configuration an object passing through the tool may become seated against the radially supported seat members.

When the seat members are biased radially inwardly the catching arrangement may be reconfigured to its catching configuration by supporting the seat members in this biased radially inward position.

When the seat members are biased radially outwardly the catching arrangement may be reconfigured to its catching configuration by both positively moving the seat members radially inwardly against the bias, and radially supporting the seat members to be retained in this inward position.

The downhole tool may define or comprise a first region within the housing having a first inner diameter which permits the seat members to move radially outwardly and be extended form the central bore when aligned with said first region. In such an arrangement the catching arrangement may be provided in its free configuration when the seat members are aligned with the first region.

The first region may comprise a recess or profile, such as an annular recess or profile, configured to receive the seat members when said seat members are moved radially outwardly and extended form the central bore. The recess may define a profile which substantially corresponds to a profile of the seat members. The recess may define a profile configured to assist with transition of the seat members between radially extended and retracted positions. For example, the recess may define a ramp structure configured to permit or assist with transition of the seat members, for example during relative axial movement between the seat members and the recess.

The downhole tool may define or comprise a second region within the housing having a second inner diameter which permits the seat members to be radially supported when positioned radially inwardly and retracted into the central bore, when aligned with said second region. The second region may define a smaller inner diameter than the first region. In such an arrangement the catching arrangement may be provided in its catching configuration when the seat members are aligned with the second region.

The first and second regions of the tool may be moved axially relative to the catching arrangement to permit the catching arrangement to be reconfigured to its catching configuration.

The catching arrangement may be axially moveable within the housing, for example driven by the valve member, to realign the seat members from the first region to the second region, and thus present the catching arrangement in its catching configuration.

The catching arrangement may be reconfigurable from the catching configuration to a release configuration in which the seat members permit release of a previously caught object.

In one embodiment the catching arrangement may be reconfigurable to the release configuration by de-supporting the seat members. When the seat members are de-supported a bias force may act to move the seat members radially outwardly and extend the seat members from the central bore. Alternatively, or additionally, when the seat members are de-supported displacement of an object, for example by fluid pressure, may deflect the seat members radially outwardly, thus allowing the object to pass.

The catching arrangement may be axially movable within the housing, for example in a downhole direction to permit said catching arrangement to be reconfigured to the release configuration. Such axial movement may be achieved by action of an object seated against the seat members, for example by action of a differential pressure permitted to be established across the interface between the object and the seat members, by action of kinetic energy or the momentum of an object or the like.

The catching arrangement may be axially moveable to align the seat members with a region of increased inner diameter, thus permitting the seat members to be moved radially outwardly. The catching arrangement may be axially moveable to re-align the seat members with the first region of the housing. Alternatively, the catching arrangement may be axially moveable to be aligned with a third region within the housing, wherein said third region defines a greater inner diameter than the second region. Alternatively further, the second region within the housing may be rearranged or modified to present an enlarged diameter which permits the seat members to be moved radially outwardly.

The downhole tool may comprise a release arrangement. Such a release arrangement may be actuated by axial movement of the catching arrangement, for example in a downhole direction. The release arrangement may be configured to facilitate de-supporting of the seat members to permit the catching arrangement to be configured in its release configuration.

The downhole tool may comprise a release member, such as a sleeve, mounted within the housing. The release member may be moveable between a supporting position in which the release member may radially support the seat members in the radially inward or retracted position, towards a de-supporting position in which the release member removes the radial support to the seat members, allowing the seat members to be moved radially outwardly.

The release member may be located in its supporting position at the second region within the housing. Accordingly, the release member may define the second inner diameter.

The downhole tool may comprise or define a release recess within the housing. The release member may cover this release recess when said release member is located within its supporting position. The release member may be moved axially within the housing towards its release position to uncover the release recess and thus permit the seat members to be moved radially outwardly and received within the release recess to permit release of an object.

The release member may be moved axially by an actuator.

The release member may be moved axially by the catching arrangement.

The release member may define a load profile, such as a load shoulder, configured to be engaged by the catching arrangement.

The catching arrangement may define a load profile configured to engage a load profile on the release member to permit the catching arrangement to apply a force on the release member.

One or more seat members may comprise a load profile, such as a notch, configured to engage a load profile on the release member to permit the release member to be moved by the catching arrangement. One or more seat members may comprise a load profile on a radially outer surface thereof and configured to engage a corresponding load profile, such as an annular shoulder, on a radially inner surface of the release member.

Each seat member may comprise a load profile, wherein when said seat members are moved radially inwardly the individual load profiles define a substantially circumferentially continuous load profile.

The catching arrangement may be biased in a preferred axial direction. In one embodiment the catching arrangement may be biased in a direction opposite to the direction in which the release member is moved to be positioned within its release position. Such an arrangement may permit the catching arrangement to be axially returned, following actuation of the release member, to a position at which the seat members are aligned with an the uncovered release recess.

The catching arrangement may be associated with a bias arrangement. The bias arrangement may act between the catching arrangement and the housing. In some embodiments, the catching arrangement may be rotatably secured relative to the housing by a bias arrangement. Such an arrangement may permit the catching arrangement to be machined when in situ, for example by a milling operation. In one embodiment one end of a bias arrangement may be rotatably secured to the catching arrangement, and an opposite end of the bias arrangement may be rotatably secured to the housing The catching arrangement may define a bias profile, such as a shoulder, configured to be engaged by a bias arrangement. The bias profile may include a connection profile to permit rotatable connection between the catching arrangement and the bias arrangement. Such a connection profile may include an axially extending slot or the like, wherein said slot may receive an axially extending portion of the bias arrangement.

The catching arrangement may be biased by a spring arrangement, such as a coiled spring member or the like.

The seat members may collectively define a substantially complete annular structure when positioned radially inwardly and retracted into the central bore (for example when the catching arrangement is configured in its catching configuration). In such an arrangement each seat member may be engaged or be brought into very close proximity with two circumferentially adjacent seat members when positioned radially inwardly.

The ability to provide a substantially complete annular structure may permit a high degree of sealing to be achieved between the seat members and an object when seated against the seat members. Such sealing may permit a pressure to be elevated on the object side of the seat members, for example to facilitate certain downhole operations. Such sealing may permit a pressure differential to be established axially across the object. Such sealing may permit the object, when seated against the seat members, to function as an efficient flow diverter, preventing or substantially minimising flow bypassing the object.

Adjacent seat members may be configured to define a gap therebetween when the seat members are positioned radially inwardly (for example when the catching arrangement is configured in its catching configuration). The width of the gap between adjacent set members may be provided below a preferred maximum gap width. Such a preferred maximum gap width may be selected in accordance with a fluid being communicated through the tool. In one embodiment a preferred maximum gap width may be defined or selected in accordance with the dimension of a particle or particles, such as proppant, being carried by a fluid communicated through the tool. In such an arrangement the maximum gap width may be selected in accordance with the ability of individual particles to bridge the gap between adjacent seat members to facilitate improved sealing.

In one embodiment a preferred maximum gap width between adjacent seal members when positioned radially inwardly (for example when the catching sleeve is configured in its catching configuration) may be defined in accordance with a mean dimension of particles, such as proppant, being carried by a fluid communicated through the tool. A maximum preferred maximum gap width may be selected to be in the region of 1 to 20 times the mean particle diameter, for example in the region of 1 to 10 time the mean particle diameter, such as between 1 to 5 times the mean particle diameter. In one embodiment a preferred maximum gap width may be in the region or twice the mean particle diameter.

In some embodiments the seat members may be arranged to permit a degree of fluid bypass when an object is seated against said seat members. Such fluid bypass may be provided to establish a desired back pressure within the tool. Such fluid by-pass may provide a degree of contingency, for example in the event of an object failing to be released.

The ability to provide a substantially complete annular structure may permit a more robust structure to be formed, which may facilitate improved mechanical response to the operational forces, such as impact forces upon engagement by an object, actuation forces by an object seated against the seat members and the like.

One or more seat members may define a seat surface on one axial side thereof. Such a seat surface may be configured to be engaged by an object.

The seat surface of a seat member may be arranged to provide a substantially continuous or complete engagement with an object. Such an arrangement may permit sealing engagement to be achieved between the seat surface and an object. In one embodiment the seat surface may define a circumferential profile which corresponds to a circumferential profile of an object.

The seat surface of a seat member may be arranged to provide discontinuous or incomplete engagement with an object. Such an arrangement may permit non-sealing engagement to be achieved between the seat surface and an object, for example to permit flow by-pass. In one embodiment a seat surface may comprise or define an axially extending slot or channel. Such a slot or channel may facilitate fluid communication axially along the seat surface even with an object engaged against said surface.

One or more seat members may define a curved seat surface. One or more seat members may define a convex seat surface. Such an arrangement may be provided in combination with use of an object having a curved, such as convex surface.

Providing a curved seat surface, and in particular a convex seat surface, may assist to prevent or at least mitigate the swaging, jamming or otherwise lodging of an object relative to the seat members. This may permit the object to be subsequently readily removed, if desired.

Providing a curved seat surface, and in particular a convex seat surface may permit a greater degree of control over the transmission of load forces between an object and the associated seat member, when engaged, and to other components of, or operatively associated with, the catching arrangement. For example, in embodiments of the invention the engagement between the seat members and an object may be configured so that the load path of a resultant force transmitted to the seat members may be controlled or selected to maximise the transmission of load forces along a particular vector in order to activate another component of, or operatively associated with, the downhole tool and/or to eliminate or mitigate moment forces.

A curved seat surface, and in particular a convex seat surface may function to minimise the contact area between the seat and the object; in contrast to conventional arrangements which seek to maximise the contact area between a seat and the object.

The seat surface of a seat member may be configured to provide a line or point engagement between the associated seat member and an object.

The seat surface of a seat member may comprise a hemi-toroidal surface, d-shaped in longitudinal section or the like.

The seat surface of a seat member may comprise a linear convex surface. For example, the seat surface may comprise a toroidal polyhedron surface, triangular in longitudinal section or the like.

One or more seat members may be configured to be engaged by an object from opposing axial directions. Such an arrangement may permit an object to be caught or arrested when passing in either axial direction. For example, in some embodiments reverse flow through the tool may cause an object which has previously passed in a forward direction to be engaged or seated against the seat members. Further, such an arrangement may permit the catching arrangement to be actuated to move in opposing axial directions in response to engagement by an object passing through the tool in either axial direction. Such an arrangement may facilitate remedial action, for example in the event of the catching arrangement becoming jammed or the like, wherein release of the catching arrangement may be achieved by reverse flow of an object from below or downhole of the tool. Such an arrangement may permit a degree or re-setting of the tool to be achieved, for example to return the valve member to a closed or partially closed position, to return the catching arrangement to its free configuration or the like.

One or more seat members may comprise a first seat surface on one axial side thereof, and a second seat surface on an opposing axial side thereof.

The seat surfaces may be defined as above.

In one embodiment both the first and second seat surfaces may be configured similarly. For example both the first and second seat surfaces may be configured to permit sealing engagement to be achieved when engaged by an object from either axial side of the catching arrangement. Further, both the first and second seat surfaces may be configured to permit non-sealing engagement to be achieved when engaged by an object.

In one embodiment, one of the first and second seat surfaces may permit sealing engagement to be achieved, and the other of the first and second seat surfaces may be configured to permit non-sealing engagement to be achieved. In one embodiment a seat surface on an uphole side of a seat member may be configured to permit sealing engagement, and a seat surface on a downhole side of the seat member may be configured to permit non-sealing engagement.

The catching arrangement may comprise or define a collet sleeve. The collet sleeve may comprise a tubular portion and a plurality of collet fingers supported by the tubular portion. The tubular portion and the collet fingers may be integrally formed.

Each collet finger may support a respective seat member. Each collet finger may be integrally formed with a respective seat member. A distal end of each collet finger may support a respective seat member. Each collet finger may be radially deformable to permit the respective seat members to be moved radially outwardly and inwardly. The collet fingers may be elastically deformable to provide a desired radial bias.

At least one and in some embodiments all collet fingers may define a tapering radial width. Such a tapering radial width may assist to control stress and/or strain within a collet finger. For example, such a tapering radial width may assist to provide uniform stress distribution within a collet finger during deformation thereof. Further, such a tapering radial width may permit a collet finger to bend more uniformly along its length, rather than focusing deformation at a discrete location.

In some embodiments the radial width may taper from one end of a collet finger to an opposite end. The radial width may taper such that a region of a collet finger adjacent the tubular portion defines a greater radial width than a region adjacent an associated seat member.

The radial width of a collet finger may taper in a linear manner. The radial width of a collet finger may taper in a non-liner, such as a curved, manner.

The collet fingers may extend in a downhole direction from the tubular portion. The tubular portion may be provided on an uphole side of the collet sleeve.

The tubular portion may be positioned adjacent the valve member. The tubular portion may be configured to be engaged by the valve member, for example to permit the valve member to axially move the catching arrangement. A shroud portion of the valve member may be arranged to be received within the tubular portion.

The collet sleeve may be formed as a unitary component.

In one embodiment the collet sleeve may be manufactured or formed as a single collet component with the seat members initially provided as a unitary annular structure. Such a unitary collet component may be initially formed by casting, machining or the like. In one embodiment the collet may be initially formed from a raw stock material, such as a cylindrical billet, bloom or the like. The unitary annular structure may be formed with a geometry which represents a radially inwardly retracted position of the seat members.

The unitary collet component may be initially formed with the tubular portion, the single unitary annular structure, and a plurality of rib structures extending between the tubular portion and the unitary annular structure. The rib structures may be generally tapered, for example conical. For example, the tubular portion may define a larger diameter, such as outer diameter, than the unitary annular structure, such that the ribs may be generally tapered. In some embodiments the rib structures may be provided as a unitary sleeve or conical shape structure.

The rib structures may define a tapering width.

The unitary annular structure may be subsequently divided to provide the individual seat members. Such division may be achieved by, for example, EDM machining, wire cutting, laser cutting, waterjet cutting, or any other suitable cutting or dividing process. Such cutting or division may involve minimal material removal such that the individual seat members may be presented in very close proximity when positioned within their radially inwardly retracted position. This arrangement of initially forming the seat members as a single component may assist to provide very accurate tolerances and include very detailed and accurate features within the catching arrangement/collet sleeve. Further, such a manufacturing arrangement or method may permit very close control over the form of the collective structure formed by the individual seat members when located within their radially inwardly retracted position.

Division of the unitary annular structure may also define the individual collet fingers. For example, following division of the unitary annular structure each rib structure may define a collet finger. Alternatively, individual collet fingers may be defined by division of a larger structure, such as a further sleeve or conical shaped structure.

Following division of the unitary annular structure the seat members may be retained in their initially divided configuration, that is, in close proximity to each other and defining their radially inwardly retracted position. In such an arrangement the seat members may be biased towards their radially inwardly retracted position.

In an alternative embodiment, following division of the unitary annular structure, the collet fingers may be plastically deformed radially outwardly. Such plastic deformation may be achieved by driving the seat members and associated fingers over a cone or mandrel. In such an arrangement the seat members may be initially provided in their radially outwardly extended position. As such, the seat members may be biased towards this radially outwardly extended position.

Aspects of the present invention relate to a method for manufacturing a collet sleeve, such as a catching arrangement, for example as described above.

The method may comprise forming a unitary component, for example from a single raw stock material, which includes a tubular portion and a single unitary annular structure which are axially interconnected via a connecting structure. The connecting structure may be tapered, for example conical.

The connecting structure may comprise a plurality of ribs. The ribs may define a tapering width.

The method may comprise dividing the unitary annular structure, for example by EDM machining, wire cutting, laser cutting, waterjet cutting, or any other suitable cutting or dividing process.

Such division of the single unitary annular structure may define individual collet fingers having a collet member, such as a seat member integrally formed at a distal or free end.

The method may comprise deforming the individual collet fingers radially outwardly.

The tool housing may comprise a plurality of fluid ports. Such fluid ports may be circumferentially distributed around the housing.

In some embodiments a plurality of fluid ports may be circumferentially distributed around the housing at an equal spacing.

The housing may define a plurality of port regions around its circumference. The port regions may be evenly distributed around the housing. Each port region may comprise a fluid port. At least one port region may be absent from a fluid port. In such an arrangement a port region without any port may provide a region for permitting other infrastructure, such as conduits or the like, to run along the housing, without interfering with a port. Such an arrangement may assist to minimise damage to any infrastructure running along the housing by fluid exiting the fluid ports.

The flow area of the fluid port or ports may be provided in a desired ratio relative to the central bore. In some embodiments the flow area of the fluid port or ports may be less than the flow area of the central bore.

In some embodiments the flow area of the fluid port or ports may be substantially equal to the flow area of the central bore.

In some embodiments the flow area of the fluid port or ports may be greater than the flow area of the central bore. Such an arrangement may facilitate efficient outflow of fluid from the central bore. Further, such an arrangement may facilitate a flow bias in an outflow direction.

The flow area of the fluid port or ports may be in the region of 1.05 to 1.5 times greater than the flow area of the central bore, for example in the range of 1.05 to 1.3 times greater. In one embodiment the flow area of the fluid port or ports may be in the region of 1.1 times greater than the flow area of the central bore.

The valve member may comprise a port or aperture in a side wall thereof. Alignment of the port of the valve member with the fluid port may permit the fluid port to be opened. Where the tool housing includes multiple fluid ports the valve member may include a corresponding number of ports or apertures. The port or aperture in the valve member may be circular. Alternatively, the port or aperture may be elongate. The port or aperture may be elongate in a direction in which the valve member is arranged to move to align said port or aperture with the fluid port in the housing. The port or aperture may be elongate in an axial direction relative to the valve member. Providing an elongate port or aperture may facilitate improved alignment between the port of the valve sleeve and the fluid port in the housing.

The valve member may be rotatably secured relative to the housing via a rotary coupling. The rotary coupling may prevent the valve member from rotating relative to the housing. The rotary coupling may permit relative axial movement of the valve member relative to the housing. The rotary coupling may comprise a spline arrangement. The rotary coupling may comprise a key and key-way arrangement. The rotary coupling may also function to rotatably secure other components relative to the housing, such as the catching arrangement. The rotary coupling may permit axial movement between components of the tool, such as the valve member, catching arrangement, housing or the like.

The rotary coupling may permit appropriate alignment of the fluid port with a port or aperture provided in the valve member.

The rotary coupling may facilitate milling or other rotary machining operation of the valve member in situ. Such an arrangement may permit the valve member to be milled through during a remedial operation or the like.

The tool may comprise one or more sealing arrangements provided on an outer surface thereof, for example on an outer surface of the housing. The seals may be configured to isolate a downhole region, for example an annular region, surrounding the tool. Such an arrangement may assist to facilitate focussing of any outflowing fluid from the tool to a precise location. In fracturing operations, such a sealing arrangement may assist to permit improved geological penetration of a fracturing fluid.

The tool may comprise a sealing arrangement on one, or alternatively on opposing axial sides of the fluid port. The sealing arrangement may be configured to provide sealing within an annulus which surrounds the tool. The sealing arrangement may be configured to provide complete sealing. The sealing arrangement may be configured to provide a flow restriction within the annulus. This may provide or permit an isolated or flow restricted region to be formed in the region of the fluid port.

One or more sealing arrangements may comprise a packer.

One or more sealing arrangements may be actuated by an actuator, or a plurality of actuators.

In some embodiments a plurality of sealing arrangements may be provided. In such an arrangement at least two sealing arrangements may be configured to be actuated independently of each other or dependently of each other. The sealing arrangements may be actuated in any desired sequence.

One or more sealing arrangements may be activated by outflow from the tool. One or more sealing arrangements may comprise or define a cup seal arrangement.

One or more sealing arrangements may comprise a flow restrictor.

One or more sealing arrangements may be provided in accordance with the flow restrictor disclosed in PCT application no. PCT/GB2012/051788, the disclosure of which is incorporated herein by reference.

The flow restrictor may be configured so as to permit the flow restrictor to slip over another body, for example but not exclusively the housing of the tool, associated connectors or the like. Permitting the flow restrictor to slip over the tool may allow the flow restrictor to be positioned in close proximity to the fluid port, which may provide advantages in terms of focusing flow from the fluid port at a desired region.

The flow restrictor may be of any suitable form or construction.

The flow restrictor may comprise a flow actuable flow restrictor.

The flow restrictor may be actuable by fluid flow over the flow restrictor. The flow restrictor may be actuable by fluid flow from the fluid port. Such an arrangement may eliminate or minimise the requirement to provide further dedicated actuation of the flow restrictor.

The flow restrictor may be actuable by fluid flow above a threshold flow rate.

The flow restrictor may be configured to hold a pressure differential within the annulus. The flow restrictor may be configured to hold a pressure of at least 3000 psi (20.7 MPa) in the annulus. The flow restrictor may be configured to hold a pressure of at least 5000 psi (34.5 MPa) in the annulus. The flow restrictor may be configured to hold a pressure of at least 7500 psi (51.7 MPa) in the annulus.

At least part of the flow restrictor may be configured to deform above the threshold flow rate to move the flow restrictor from a run-in configuration to a set configuration.

The flow restrictor may comprise a flow restrictor body. The flow restrictor body may be configured so as to permit the flow restrictor to slip over the tool, associated connector or the like. Alternatively, the flow restrictor may be provided on a sub configured for coupling to the tool.

The flow restrictor may comprise a restrictor assembly. The restrictor assembly may be mounted on the flow restrictor body.

The restrictor assembly may be actuable between a run-in configuration and a set configuration.

In the set configuration, at least a portion of the restrictor assembly may be radially splayed to substantially restrict flow in the annulus.

The flow restrictor may be actuable by fluid flow over the restrictor assembly.

At least part of the restrictor assembly may be configured to deform above the threshold flow rate to move the flow restrictor from the run-in configuration to the set configuration.

At least part of the flow restrictor may be configured to plastically deform such that the flow restrictor remains in the set configuration following actuation.

The value of the threshold flow rate may be selected to exceed the flow rates to which the flow restrictor is exposed while the tool is run-in to a bore.

The threshold flow rate over the restrictor assembly may be above 5 barrels per minute.

The flow restrictor can have a central axis and at least a part of the restrictor assembly may be inclined at an angle relative to the central axis.

The angle of incline of the flow restrictor relative to the central axis may be shallow to reduce the likelihood of premature setting of the flow restrictor.

The angle of incline of the restrictor assembly may be between one and fifteen degrees relative to the central axis.

The angle of incline may be between one and seven degrees relative to the central axis. The angle of incline may be around 3.5 degrees relative to the central axis.

The body may be tapered to define the angle of incline of the restrictor assembly mounted on the body. The body may be a mandrel or a tool shaft.

An aspect of the present invention relates to a downhole catching arrangement for catching an object. The object may comprise an actuation object. The object may comprise a ball, dart, or the like.

The catching arrangement may be configured to catch an object travelling downhole, for example travelling through a tubular structure positioned within a wellbore, such as a tubing string, tool string or the like. The catching arrangement may be configured to be located within a tubular structure. For example, the catching arrangement may be configured to be mounted within a housing of a downhole tool.

The catching arrangement may define or comprise a catching sleeve.

The catching arrangement may be as defined herein, for example as defined above.

The catching arrangement may be configured to function as a flow diverter when an object is caught.

The catching arrangement may be configured to function as an actuator when an object is caught. For example, the catching arrangement may be configured to actuate another component, structure, apparatus, tool or the like. For example, when an object is caught by the catching arrangement, the object may facilitate movement of the catching arrangement, for example by impact of the object against the catching arrangement, by a pressure differential established across the object/catching arrangement, or the like.

The catching arrangement may be configured to function as a bore plug when an object is caught, for example to isolate a region within a tubing structure. Such an arrangement may facilitate pressure to be controlled, for example elevated, in a section of a tubular structure. Such an arrangement may facilitate pressure actuation of a further component, structure, apparatus, tool or the like, such as packers, slips, rupture disks and the like.

The catching arrangement may be configured to function as a flow restrictor when an object is caught. For example, the catching arrangement may be configured to function as a choke.

The catching arrangement may include a plurality of radially moveable seat members configured to be engaged by an object.

The catching arrangement may be configurable between a free configuration in which the seat members permit an object to pass the catching arrangement, to a catching configuration in which the seat members catch an object.

The catching arrangement may be reconfigured between its free and catching configurations by an actuator. Any suitable actuator may be used to actuate and reconfigure the catching arrangement. For example, a valve member, such as a valve sleeve, arranged in proximity to the catching sleeve may function to reconfigure the catching arrangement. For example, opening and/or closing of a valve member may also reconfigure the catching arrangement.

An indexing sleeve, such as defined herein, may be used to reconfigure the catching arrangement. A collet as disclosed in WO 2011/117601 and/or WO 2011/117602 may be used to reconfigure the catching arrangement.

A piston assembly may be used to reconfigure the catching arrangement. A shifting tool, such as a coiled tubing or wireline deployed shifting tool may be used to reconfigure the catching arrangement.

The seat members may be radially moveable to be radially extended and refracted relative to a central bore of the catching arrangement. That is, the seat members may be moveable radially inwardly to be retracted into the central bore to define a reduced inner diameter. The seat members may be moveable radially outwardly to be radially extended from the central bore to define an increased inner diameter. When the seat members are positioned radially inwardly and retracted into the central bore said members may be positioned into the path of an object passing through the catching arrangement. When in such a configuration the seat members may be engaged by an object. When the seat members are positioned radially outwardly and extended from the central bore said members may be outside the path of an object travelling through the catching arrangement.

The seat members may be biased in a radial direction.

In one embodiment the seat members may be biased radially outwardly. In such an arrangement the seat members may require to be positively moved against this bias to be moved radially inwardly and be retracted into the central bore to be engaged by an object. Thus, when the catching arrangement is in its free configuration an object may freely pass through the catching arrangement without or with minimal engagement with the seat members. The catching arrangement may be reconfigured into its catching configuration by positively moving the seat members radially inwardly into the central bore against the bias to catch an object.

In one embodiment the seat members may be biased radially inwardly. In such an arrangement the seat members may require to be positively moved against this bias to be moved radially outwardly and be extended from the central bore to allow passage of an object, when required. Such outward radial movement of the seat members may be caused by an object acting against the seat members during passage of the object through the catching arrangement when the catching arrangement is configured in its free position.

The catching arrangement may be reconfigured to its catching configuration by radially supporting the seat members in a radially inward position such that outward radial movement is prevented. In such a configuration an object passing through the catching arrangement may become seated against the radially supported seat members.

The catching arrangement may be axially moveable to be configured between its free and catching configurations.

The catching arrangement may be configured to release a previously caught object. The catching arrangement may be configured to release a previously caught object by establishing a condition, such as a pressure condition, flow condition or the like within the downhole tool. The catching arrangement may be configured to release a previously caught object by a change in flow direction, for example reverse flow through the downhole tool.

The catching arrangement may be reconfigurable from the catching configuration to a release configuration in which the seat members permit release of a previously caught object.

The catching arrangement may be reconfigured to an intermediate release configuration, for example by action of a caught object acting against the catching arrangement. The catching arrangement may be reconfigured from an intermediate release position to a release configuration by a variation I a downhole condition, for example a variation in pressure, flow rate, flow direction or the like.

When the catching arrangement is configured in a release configuration, the catching arrangement may permit an object to pass. In such an arrangement the release configuration of the catching arrangement may also define a free configuration.

In one embodiment the catching arrangement may be reconfigurable to the release configuration by de-supporting the seat members. When the seat members are de-supported a bias force may act to move the seat members radially outwardly and extend the seat members from the central bore. Alternatively, or additionally, when the seat members are de-supported displacement of an object, for example by fluid pressure, may deflect the seat members radially outwardly, thus allowing the object to pass.

The catching arrangement may be axially movable to permit said catching arrangement to be reconfigured to the release configuration. Such axial movement may be achieved by action of an object seated against the seat members, for example by action of a differential pressure permitted to be established across the interface between the object and the seat members.

The catching arrangement may be axially moveable to align the seat members with a region of increased inner diameter, thus permitting the seat members to be moved radially outwardly.

The catching arrangement may be provided in combination with a release arrangement. The catching arrangement and the release arrangement may form part of a catching system according to an aspect of the present invention. The release arrangement may be actuated by axial movement of the catching arrangement, for example in a downhole direction. The release arrangement may be configured to facilitate de-supporting of the seat members to permit the catching arrangement to be configured in its release configuration.

The release arrangement may comprise a release member, such as a release sleeve. The release member may be moveable between a supporting position in which the release member may radially support the seat members in the radially inward or retracted position, towards a de-supporting position in which the release member may remove the radial support to the seat members, allowing the seat members to be moved radially outwardly.

The release member may cover a release recess, for example formed within a tubing structure, when said release member is located within its supporting position. The release member may be moved axially towards its release position to uncover the release recess and permit the seat members to be moved radially outwardly and received within the release recess to permit release of an object.

The release member may be moved axially by an actuator.

The release member may be moved axially by the catching arrangement.

The release member may define a load profile, such as a load shoulder, configured to be engaged by the catching arrangement.

The catching arrangement may define a load profile configured to engage a load profile on the release member to permit the catching arrangement to apply a force on the release member.

One or more seat members may comprise a load profile, such as a notch, configured to engage a load profile on the release member to permit the release member to be moved by the catching arrangement. One or more seat members may comprise a load profile on a radially outer surface thereof and configured to engage a corresponding load profile, such as an annular shoulder, on a radially inner surface thereof.

Each seat member may comprise a load profile, wherein when said seat members are moved radially inwardly the individual load profiles define a substantially circumferentially continuous load profile.

The catching arrangement may be biased in a preferred axial direction. In one embodiment the catching arrangement may be biased in a direction opposite to the direction in which the release member is moved to be positioned within its release position. Such an arrangement may permit the catching arrangement to be axially returned, following actuation of the release member, to a position at which the seat members may be aligned with an the uncovered release recess.

An aspect of the present invention relates to a downhole actuator for actuating a downhole tool, comprising:

a tubular housing including an indexing profile on an inner surface thereof; and an indexing arrangement mounted within the housing and arranged to progress linearly through the housing towards an actuation site in a predetermined number of discrete steps of linear movement by passage of a corresponding number of actuation objects through a central bore of the indexing arrangement, wherein the indexing arrangement comprises an engaging arrangement including first and second engagement members which cooperate with the indexing profile of the housing to be selectively engaged by an actuation object passing through the central bore of the indexing arrangement to drive the indexing arrangement one discrete step, wherein the engagement members are arranged relative to each other to permit only a single actuation object to be positioned therebetween.

An aspect of the present invention relates to a method for downhole actuation using any downhole actuator and/or tool as described herein.

An aspect of the present relates to a method for downhole actuation, comprising:

providing an indexing arrangement defining a central bore and including an engaging arrangement including first and second engagement members;

locating the indexing arrangement within a housing defining an indexing profile configured to cooperate with the first and second engagement members of the indexing arrangement to cause said engagement members to be selectively moved radially relative to the central bore of the indexing arrangement;

locating the indexing arrangement and housing in a wellbore; and delivering an object through the indexing arrangement to selectively engage at least one of the first and second engagement members to drive the indexing arrangement at least one discrete movement step towards an actuation site.

An aspect of the present invention relates to a downhole actuation system comprising a plurality of downhole actuators such as described herein. At least two downhole actuators may be configured to permit actuation of respective associated downhole tools upon passage of a different number of actuation objects.

At least two downhole actuators may be configured to permit actuation of similar downhole tools.

At least two downhole actuators may be configured to permit actuation of different downhole tools.

The plurality of downhole actuators may be arranged to permit operation of their associated downhole tools in any desired sequence.

An aspect of the present invention relates to a downhole tool, comprising:

a tool housing defining a central bore and including a fluid port;

a valve member mounted within the housing and being moveable from a closed position in which the fluid port is blocked to an open position in which the fluid port is opened; and a catching arrangement mounted within the housing on a downhole side of the valve member and including a plurality of radially moveable seat members, wherein movement of the valve member towards its open position reconfigures the catching arrangement from a free configuration in which the seat members permit an object to pass through the tool, to a catching configuration in which the seat members catch an object passing through the tool.

An aspect of the present invention relates to a downhole tool, comprising:

a tool housing defining a central bore and including a fluid port; and a catching arrangement mounted within the housing and including a plurality of radially moveable seat members, wherein the catching arrangement is configurable between a free configuration in which the seat members permit an object to pass through the tool, to a catching configuration in which the seat members catch an object passing through the tool to divert flow through the fluid port.

An aspect of the present invention relates to a method for treating a subterranean region, such as a formation. Treating may comprise fracturing, acid stimulation or the like. The method for treating may comprise use of any downhole actuator and/or tool as described herein.

An aspect of the present invention relates to a mechanical counting device locatable at each of a plurality of downhole tools arranged within and along a well bore, each tool having a main bore corresponding to the well bore, and each tool being actuatable to open one or more fluid ports which are transverse to the main bore, the mechanical counting device comprising:

a linear indexing arrangement adapted to cause the mechanical counting device to linearly progress along the main bore by a predetermined distance in response to receiving an object dropped down the well bore until reaching an actuation site of the tool whereupon the tool is actuated, wherein the linear indexing arrangement is configured to only allow progress along the main bore by the predetermined distance in response to receiving a single object dropped down the well bore.

An aspect of the present invention relates to a valve actuator for a downhole tool having a main bore corresponding to the well bore, the tool being actuatable to open one or more fluid ports which are transverse to the main bore, the actuator comprising:

a catching device mountable within the main bore and having a first configuration in which the device allows the passage of an object dropped down the well bore and a second configuration in which the device catches the dropped object;

a switching arrangement which is operable to switch the catching device from the first to the second configuration, wherein the catching device is biased towards the first configuration.

An aspect of the present invention relates to a method for actuating a valve of a downhole tool, the tool having a main bore corresponding to the well bore and one or more fluid ports which are transverse to the main bore, the valve being actuatable to open the transverse ports, the method comprising:

mounting a catching device within the main bore, the catching device having a first configuration in which the device allows the passage of an object dropped down the well bore and a second configuration in which the device catches the dropped object;

configuring the valve to open the transverse ports when the catching device is at the second configuration;

dropping the object down the well bore;

switching the catching device from the first to the second configuration so that the dropped object is caught; and biasing the catching device towards the first configuration.

An aspect of the present invention relates to a downhole system, comprising:

a tool string to be arranged within a wellbore;

a plurality of downhole actuators arranged along the tool string, wherein each downhole actuator comprises an indexing arrangement to progress through the tool string towards an actuation site in a predetermined number of discrete steps of movement by passage of a corresponding number of actuation objects through the indexing arrangement; and a plurality of downhole tools arranged along the tubing string, wherein each downhole tool is arranged to be actuated by at least one downhole actuator, wherein at least two downhole tools are different.

Accordingly, a common form of a downhole actuator may be used within the tool system to operate various types of tool. Such an arrangement may assist to minimise the requirement to provide bespoke actuation of different types of downhole tools. This may minimise complexities of wellbore systems, and associated costs and reliability issues.

The downhole system may comprise a downhole actuator according to any other aspect.

At least two downhole actuators may be initially configured to actuate respective associated downhole tools by passage of a different number of objects. Such an arrangement may permit at least two tools to be actuated at different times or in a desired sequence.

In some embodiments at least two downhole actuators may be initially configured to actuate respective associated downhole tools by passage of the same number of objects.

Any sequence of operation of the downhole tools may be achieved depending on the initial configuration of the actuators.

The downhole tool may comprise at least two tools of the same type.

The downhole tool may comprise at least two tools of a first type, and at least two tools of a second type.

The downhole system may comprise at least one downhole tool according to any other aspect.

At least one downhole tool may comprise a downhole valve.

At least one downhole tool may comprise a downhole sealing tool, such as a packer.

At least one downhole tool may comprise a catching arrangement, such as a catching arrangement which may be actuated to catch, and/or release, an object, such as an object used to operate one or more downhole actuators. At least one downhole tool may comprise a catching arrangement according to any other aspect.

At least one downhole tool may comprise a fracturing tool, configured to facilitate outflow of a fracturing fluid.

At least one downhole tool may comprise a flow control valve, such as an inflow control device (ICD).

At least one downhole tool may comprise a perforation gun.

In some embodiments the downhole system may comprise a first downhole actuator associated with a first downhole tool, and a second downhole actuator associated with a second downhole tool. The first downhole tool may comprise a packer. The second downhole tool may comprise a fracturing tool.

The first downhole actuator may be configured to actuate the first downhole tool upon passage of a first number of objects, and the second downhole actuator may be configured to actuate the second downhole tool upon passage of a second number of objects. In some embodiments the first number of objects may be lower than the second number of objects.

The downhole system may comprise first and second axially adjacent packers, and a valve located intermediate said first and second packers. The valve may comprise or define a fracturing valve.

The downhole system may comprise a first downhole actuator associated with the first packer, a second downhole actuator associated with the second packer, and a third downhole actuator associated with the fracturing valve.

The third downhole actuator may be configured to actuate the fracturing valve following passage of a greater number of objects than the first and second downhole actuators require to actuate the respective first and second packers.

The first and second downhole actuators may be configured to actuate their respective first and second packers upon passage of the same number of objects. Alternatively, the first and second downhole actuators may be configured to actuate their respective first and second packers upon passage of a different number of objects.

According to an aspect of the present invention there is provided a downhole method, comprising:

arranging a tool string within a wellbore, wherein the tool string includes a plurality of downhole actuators and a plurality of downhole tools arranged along the tubing string, wherein each downhole tool is arranged to be actuated by at least one downhole actuator, and at least two downhole tools are different;

arranging an indexing arrangement within each downhole actuator to be progressed through the tool string towards an actuation site in a predetermined number of discrete steps of movement by passage of a corresponding number of actuation objects through the indexing arrangement; and passing objects along the tool string to cause actuation of the downhole tools.

According to an aspect of the present invention there is provided a downhole system, comprising:

a tool string;

a first downhole tool arranged in the tool string;

a first downhole actuator associated with the first downhole tool and being configured to actuate the first downhole tool in response to the passage of a predetermined number of objects in a downstream direction;

a second downhole tool arranged in the tool string downstream of the first downhole tool;

a second downhole actuator associated with the second downhole tool and being configured to actuate the second downhole tool in response to the passage of a predetermined number of objects in the downstream direction; and a catching arrangement located downstream of the second downhole actuator and configured to selectively catch an object passing through the system in a downstream direction.

The first and second downhole actuators may be provided in accordance with any other aspect.

In one embodiment at least one or both of the first and second actuators may comprise an indexing arrangement, such as an indexing sleeve, arranged to progress through the tool string towards an actuation site in a predetermined number of discrete steps of movement by passage of a corresponding number of actuation objects. Upon reaching the actuation site the indexing arrangement may actuate a respective downhole tool.

One or both of the first and second tools may be provided in accordance with any other aspect.

One or both of the first and second tools may comprise a fracturing tool.

In one embodiment at least one of the first and second downhole tools may comprise a valve member, such as a valve sleeve, configured to be moved by an associated downhole actuator. The valve member may be moveable to selectively vary opening/closing of a fluid port within the tool string.

In one embodiment both the first and second downhole tools may comprise a valve member, such as a valve sleeve, configured to be moved by the first and second downhole actuators, respectively. Each valve member may be moveable to selectively vary opening/closing of a respective fluid port within the tool string.

In an embodiment where both the first and second downhole tools comprise a valve member for selectively opening a respective fluid port, the catching arrangement may function to catch an object to divert flow within the tool string through the associated fluid ports when opened. In this way, only a single catching arrangement may be utilised to accommodate the appropriate functionality of both the first and second downhole tools.

In some embodiments the downhole system may comprise a third or further downhole tools and associated downhole actuators. The third or further downhole tools may be located upstream of the catching arrangement.

The catching arrangement may be configurable from a free configuration in which an object is free to pass the catching arrangement, to a catching configuration in which a passing object may be caught. The catching arrangement may be reconfigured from its free to catching configuration by the second downhole tool, for example by a valve member of the second downhole tool. In one embodiment the catching arrangement may be reconfigured by an associated downhole actuator.

The catching arrangement may comprise a catching sleeve.

The catching arrangement may comprise one or more radially moveable seat members. The catching arrangement may be configurable from it free configuration in which the seat members permit an object to pass through the tool string, to a catching configuration in which the seat members catch an object passing through the tool string.

When the catching arrangement is configured in its catching configuration an object passing through the tool string may seat against the seat members and become caught.

According to an aspect of the present invention there is provided a method for downhole actuation, comprising:

arranging first and second downhole tools along a tool string in a wellbore;

arranging a first downhole actuator within the tool string to actuate the first downhole tool in response to the passage of a predetermined number of objects in a downstream direction;

arranging a second downhole actuator within the tool string to actuate the second downhole tool in response to the passage of a predetermined number of objects in the downstream direction;

arranging a catching arrangement downstream of the first and second downhole actuator; and passing a predetermined number of objects along the tool string to actuate both the first and second tools; and configuring the catching arrangement to catch an object after the first and second tools have been actuated.

A downhole tool according to a further aspect of the invention comprises: a housing; an actuatable member; a catching arrangement; and a coupling arrangement configured to provide a rotary coupling between the actuatable member and the catching arrangement and/or the housing and configured to permit relative axial movement of at least one of the actuatable member and the catching arrangement relative to the housing.

Embodiments of the present invention beneficially provide a downhole tool having a coupling which transmits rotational movement of one component of a downhole tool, such as the actuatable member, to at least one of the other components of the downhole tool, such as the catching arrangement and/or the housing, while permitting axial movement between the components.

The catching arrangement may be arranged to be axially moved by the actuatable member.

The transmission of rotational movement may provide a rotational lock for example. Alternatively, or additionally, the transmission of rotational movement may ensure rotational alignment of the actuatable member and the catching arrangement and/or the housing.

The coupling arrangement may be configured to transmit a force between the actuatable member and the catching arrangement and/or the housing.

The coupling arrangement may be configured to transmit an axial force from the actuatable member to the catching arrangement.

The coupling arrangement may be configured to transmit an axial force from at least one of the catching arrangement and the housing.

The coupling arrangement may define, comprise or form part of a timing arrangement of a downhole tool or system, such as the timing arrangement defined in other aspects of the invention.

The coupling arrangement may be configured to permit relative axial movement of the actuatable member and the housing.

The coupling arrangement may be configured to permit relative axial movement of the actuatable member and the catching arrangement.

The coupling arrangement may be configured to permit axial movement of the actuatable member and catching arrangement relative to the housing.

The actuatable member may, for example, comprise a valve member and in particular embodiments, the actuatable member may comprise a valve sleeve.

The catching arrangement may comprise a catching member and in particular embodiments the catching arrangement may comprise a catching sleeve. The catching arrangement may be moveable between a free configuration and a catching configuration.

Axial movement of the actuatable member, e.g. the valve sleeve, may move the catching arrangement, e.g. the catching sleeve, from the free configuration to the catching configuration.

The coupling arrangement may be of any suitable form and construction.

The coupling arrangement may comprise a key.

The key may comprise a single key element.

The key may be disposed in a recess or groove in the actuatable member.

Alternatively, and in particular embodiments, the key may comprise a plurality of key elements. The key elements may be located about the actuatable member, and may be circumferentially spaced around the actuatable member.

The coupling arrangement may comprise a slot or groove in the housing.

The coupling arrangement may comprise a single slot or groove in the housing.

The coupling arrangement may comprise a single key element extending into or through the slot or groove in the housing.

Alternatively, the coupling arrangement may comprise a plurality of slots or grooves in the housing.

The coupling arrangement may comprise a plurality of key elements, each extending into or through a corresponding slot or groove.

In embodiments where the coupling arrangement comprises a plurality of slots or grooves in the housing, the slots or grooves may be circumferentially arranged.

The coupling arrangement may comprise a slot or groove in the catching arrangement.

The coupling arrangement may comprise a single slot or groove in the catching arrangement.

Alternatively, the coupling arrangement may comprise a plurality of slots or grooves in the catching arrangement.

In embodiments where the coupling arrangement comprises a plurality of slots or grooves in the catching arrangement, the slots or grooves may be circumferentially arranged.

The key may be disposed in the slot or recess.

In particular embodiments, the tool may comprise a plurality of key elements, each of the key elements extending through a slot in the catching arrangement and into a groove in the housing.

The catching arrangement slot or groove and the housing slot or groove may at least partially axially overlap.

The tool may be configured to provide a positive indication that an event, such as an activation event, has occurred. The activation event tool may comprise opening a port. The positive indication may comprise a pressure drop.

An aspect of the present invention relates to a downhole actuator, comprising:

a tubular housing which includes an indexing profile on an inner surface thereof; and an indexing sleeve mounted within the housing and comprising an engaging arrangement including first and second axially spaced engagement members which cooperate with the indexing profile of the housing to be sequentially engaged by an actuation object passing through a central bore of the indexing sleeve to drive the indexing sleeve one discrete step of movement through the housing towards an actuation site.

The indexing sleeve may be arranged to progress within the housing towards the actuation site in a predetermined number of discrete steps of movement by passage of a corresponding number of actuation objects through the central bore of the indexing sleeve.

The downhole actuator may be configured to permit the indexing sleeve to be disabled, such that the indexing sleeve, when disabled, may not moved upon passage of an actuation object.

The indexing sleeve may be configured to be disabled at the actuation site.

The indexing sleeve may be configured to function as a latch for a downhole tool when said indexing sleeve is disabled at the actuation site.

The indexing sleeve may be configured to be disabled at a location remote from the actuation site.

The indexing profile may facilitate the indexing sleeve to become disabled.

The indexing profile may comprise a disabled region, wherein alignment of the indexing sleeve with the disabled region of the indexing profile may permit the indexing sleeve to become disabled.

The indexing profile may comprise a disabled region which coincides with the actuation site of the actuator.

The indexing profile may comprise a disabled region which is remote from the actuation site.

The indexing sleeve may be configured to be moved towards the remote disabled region by use of a shifting tool.

The indexing sleeve may define a shifting profile to facilitate engagement by a shifting tool.

The indexing profile may define a disabled region at opposing axial ends of said indexing profile.

The indexing profile of the housing may comprise a plurality of annular recesses arranged longitudinally along the housing. The annular recesses may provide a variation of the inner diameter along the length of the housing, such that movement of the indexing sleeve through the housing may permit the radial position of first and second engagement members to be varied.

The indexing sleeve may be configured to cooperate with the indexing profile of the housing such that during movement of the indexing sleeve longitudinally through the housing each engagement member may be sequentially received within adjacent annular recesses, such that when received within a recess an engagement member may be positioned radially outwardly and extended from the central bore of the indexing sleeve, and when positioned intermediate adjacent recesses an engagement member may be positioned radially inwardly and thus retracted into the central bore of the indexing sleeve and thus presented into a path of travel of an actuation object through the indexing sleeve.

At least one pair of annular recesses may be arranged at a different axial spacing than the first and second engagement members.

The indexing profile may comprise multiple annular recesses arranged longitudinally along the housing at a common axial separation or pitch.

The indexing profile may comprise at least one pair of annular recesses which are arranged at an axial spacing which is equivalent to the axial spacing of the first and second engagement members.

The indexing sleeve may be configured to become disabled when the first and second engagement members are received within a pair of annular recesses which are arranged at the same axial spacing.

One axial end region of the indexing profile may comprise a pair of annular recesses provided at an axial spacing which is equivalent to the axial spacing of the first and second engagement members.

Opposing axial end regions of the indexing profile may comprise a pair of annular recesses with an axial spacing which corresponds to the axial spacing of the first and second engagement members of the indexing sleeve.

The first and second engagement members may be arranged relative to each other to permit only a single actuation object to be positioned therebetween.

The relative arrangement between the first and second engagement members may be selected in accordance with an actuation object which is utilised to actuate and move the indexing sleeve a discrete step through the housing.

The relative arrangement between the first and second engagement members may be selected in accordance with the geometry of an actuation object which is utilised to actuate and move the indexing sleeve a discrete step through the housing.

The relative arrangement between the first and second engagement members may be related to an axial separation of the first and second engagement members.

The axial separation of the first and second engagement members may be less than or equal to twice the width of an actuation object.

The actuation object may comprise a ball, and the axial separation of the first and second engagement members may be less than or equal to twice the diameter of the ball.

The relative arrangement between the first and second engagement members may be related to a permitted radially inward movement of the engagement members into the central bore.

The first and second engagement members may define a confinement region therebetween, for temporarily accommodating an actuation object during passage of said object through the indexing sleeve.

The confinement region may be configured to permit only a single actuation object to be accommodated therein at any time.

A final discrete step of linear movement of the indexing sleeve may permit said sleeve to initiate actuation of an associated downhole tool.

The indexing sleeve may be configured to completely actuate a downhole tool upon the indexing sleeve reaching the actuation site.

The indexing sleeve may be configured to partially actuate a downhole tool upon the indexing sleeve reaching the actuation site.

The indexing sleeve may cooperate with the indexing profile of the housing to be moved in a discrete step in any direction of travel of a passing actuation object.

The indexing sleeve may be movable in reverse directions by discrete linear movement steps in accordance with the direction of travel of an actuation object.

The indexing sleeve may be reconfigurable, in situ, to permit sequential engagement of the first and second engagement members in reverse directions of a passing actuation object. Said in situ reconfiguration may be achieved by an initial passage of an actuation object in a reverse direction.

The first and second engagement members may be arranged on the indexing sleeve to be selectively moved radially by cooperation with the indexing profile on the housing during movement of the indexing sleeve through the housing.

The radial movement of the first and second engagement members may selectively extend and retract said members relative to the central bore of the indexing sleeve to permit the engagement members to be selectively presented into a path of travel of an actuation object through the central bore of the indexing sleeve to allow said sleeve to be driven through the housing by one discrete step.

The radial movement of the first and second engagement members may sequentially present said members into the central bore and a path of travel of an actuation object to permit said object to sequentially engage the engagement members to drive the indexing sleeve through the housing by one discrete step.

The radial position of the first and second engagement members may be cyclically varied by cooperation with the indexing profile during movement of the indexing sleeve through the housing.

The radial position of the first and second engagement members is varied out of phase relative to each other by cooperation with the indexing profile during movement of the indexing sleeve through the housing.

One or both of the first and second engagement members may be biased in a preferred radial direction.

One or both of the first and second engagement members may be biased in a radially outward direction to be retracted from the central bore of the indexing sleeve.

The downhole actuator may comprise first and second fingers which support a respective one of the first and second engagement members on distal ends of said fingers.

The fingers may be deformable to permit the engagement members to move radially upon cooperation with the indexing profile.

The first and second fingers may extend in opposing directions, for example opposing axial directions.

The engaging arrangement may comprise an array of first engagement members arranged circumferentially around the indexing sleeve.

Each first engagement member may be mounted on a respective first finger.

The engaging arrangement may comprise an array of second engagement members arranged circumferentially around the indexing sleeve.

Each second engagement member may be mounted on a respective second finger.

The indexing sleeve may be configured to be moved a discrete movement step when an actuation object is driven by a fluid flow at a flow rate of between 5 and 70 barrels per minute.

The first and second engagement members may each define a seat arrangement for allowing an actuation object to engage and seat against during passage through the indexing sleeve.

The first and second engagement members may define a seat arrangement on opposing axial sides thereof to permit an actuation object to engage and seat against the engagement members in reverse directions of movement.

One or both of the first and second engagement members may define a convex seat surface to be engaged by an object.

The indexing sleeve may be arranged to be advanced along the housing in a discrete movement step by sequential impact of an actuation object against the first and second engagement members.

The indexing sleeve may be configured to be advanced along the housing in a discrete step by a differential pressure applied between upstream and downstream sides of the indexing sleeve. The differential pressure may be created upon engagement of the object with each of the first and second engagement members.

The downhole actuator may comprise a monitoring arrangement for monitoring the passage of an actuation object through the indexing sleeve.

The monitoring arrangement may comprise an acoustic monitoring arrangement configured to identify an acoustic signal generated by impact of an actuation object against the first and second engagement members.

The monitoring arrangement may comprise a pressure monitoring system configured to identify a pressure variation generated during engagement of an actuation object with the first and second engagement members.

The downhole actuator may comprise an anti-rotation arrangement provided between the indexing sleeve and the housing.

One of the housing and the indexing sleeve may comprise a key, and the other of the housing and the indexing sleeve may comprise a key-way configured to receive said key.

The downhole actuator may comprise a stand-off arrangement radially positioned between the housing and the indexing sleeve to define a radial separation gap between the housing and the indexing sleeve.

The width of the radial separation gap may be provided at a preferred minimum gap width.

The preferred minimum gap width may be selected in accordance with the dimension of a particle or particles carried by a fluid communicated through the actuator.

The preferred minimum radial gap width between the housing and indexing sleeve may be at least twice the mean particle diameter of particles carried by a fluid communicated through the actuator.

The stand-off arrangement may align the indexing sleeve substantially concentrically within the housing.

The stand-off arrangement may comprise at least one rib positioned between the housing and the indexing sleeve.

The stand-off arrangement may comprise a plurality of circumferentially arranged ribs positioned between the housing and the indexing sleeve.

The indexing sleeve may be configured to be initially positioned at any desired location along the indexing profile to determine the required number of actuation objects, and thus required discrete steps of movement, to drive the indexing sleeve to the actuation site.

The housing may be modular and may comprise multiple housing modules connected together to collectively define the housing. Individual housing modules may define a portion of the indexing profile, such that when the individual modules are connected together the entire indexing profile may be formed.

Adjacent housing modules may be secured together such that an indexing profile feature may be defined at an interface therebetween.

Adjacent housing modules may each define a portion of a profile feature such that when the adjacent housing modules are connected the complete profile feature may be formed.

The indexing sleeve may be configured to engage an actuatable member of a downhole tool.

An aspect of the present invention relates to a method for downhole actuation, comprising:

arranging a downhole actuator according to any preceding claim relative to a downhole tool;

passing a predetermined number of actuation objects through the downhole actuator to cause the indexing sleeve to move in a corresponding number of discrete steps of movement through the housing towards an actuation site to actuate the downhole tool.

The method may comprise disabling the indexing sleeve within the housing, such that the indexing sleeve, when disabled, may not moved upon passage of an actuation object.

The method may comprise preventing more than one actuation object to be positioned between the first and second engagement members of the indexing sleeve at any one time.

An aspect of the present invention relates to a downhole actuator, comprising:

a tubular housing; and an indexing sleeve mounted within the housing and comprising an engaging arrangement which is engageable by an actuation object passing through a central bore of the indexing sleeve to drive the indexing sleeve one discrete step of movement through the housing towards an actuation site;

wherein the indexing sleeve is configured to be disabled when located at a disable region within the housing, such that the indexing sleeve, when disabled, is not moved upon passage of an actuation object.

An aspect of the present invention relates to an inspection apparatus for use in inspecting or determining the position of an indexing sleeve within a housing of a downhole actuator, comprising:

an inspection object configured to engage the indexing sleeve;

an elongate member connected to the engagement member and configured to be inserted into the housing from one end thereof to engage the inspection object with the indexing sleeve with a portion of the elongate member extending from the housing; and a visual reference provided on the elongate member to provide a user with a visual indication for use in determining the location of the indexing sleeve within the housing.

An aspect of the present invention relates to an indexing sleeve for use in a downhole actuator, comprising:

an engaging arrangement including first and second axially spaced engagement members for cooperating with an indexing profile of a housing to be sequentially engaged by an actuation object passing through a central bore of the indexing sleeve to drive the indexing sleeve one discrete step of movement through the housing towards an actuation site.

An aspect of the present invention relates to a downhole system, comprising:

a downhole actuator according to any other aspect; and a downhole tool arranged relative to the downhole actuator, wherein the downhole actuator is operable to actuate the downhole tool.

The downhole system may comprise a plurality of downhole actuators and a plurality of downhole tools, wherein each actuator may be configured to actuate at least one tool.

At least two downhole actuators may be configured to actuate an associated downhole tool upon passage of a different number of actuation objects.

At least one downhole tool may comprise a valve.

At least one downhole tool may comprise a fracturing valve.

At least one downhole tool may comprise a packer.

An aspect of the present invention relates to a method for downhole actuation, comprising:

providing an indexing arrangement defining a central bore and including an engaging arrangement including first and second engagement members;

locating the indexing arrangement within a housing defining an indexing profile configured to cooperate with the first and second engagement members of the indexing arrangement to cause said engagement members to be selectively moved radially relative to the central bore of the indexing arrangement;

locating the indexing arrangement and housing in a wellbore; and delivering an object through the indexing arrangement to selectively engage at least one of the first and second engagement members to drive the indexing arrangement at least one discrete movement step towards an actuation site.

Features defined in relation to one aspect may be provided in combination with any other aspect.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
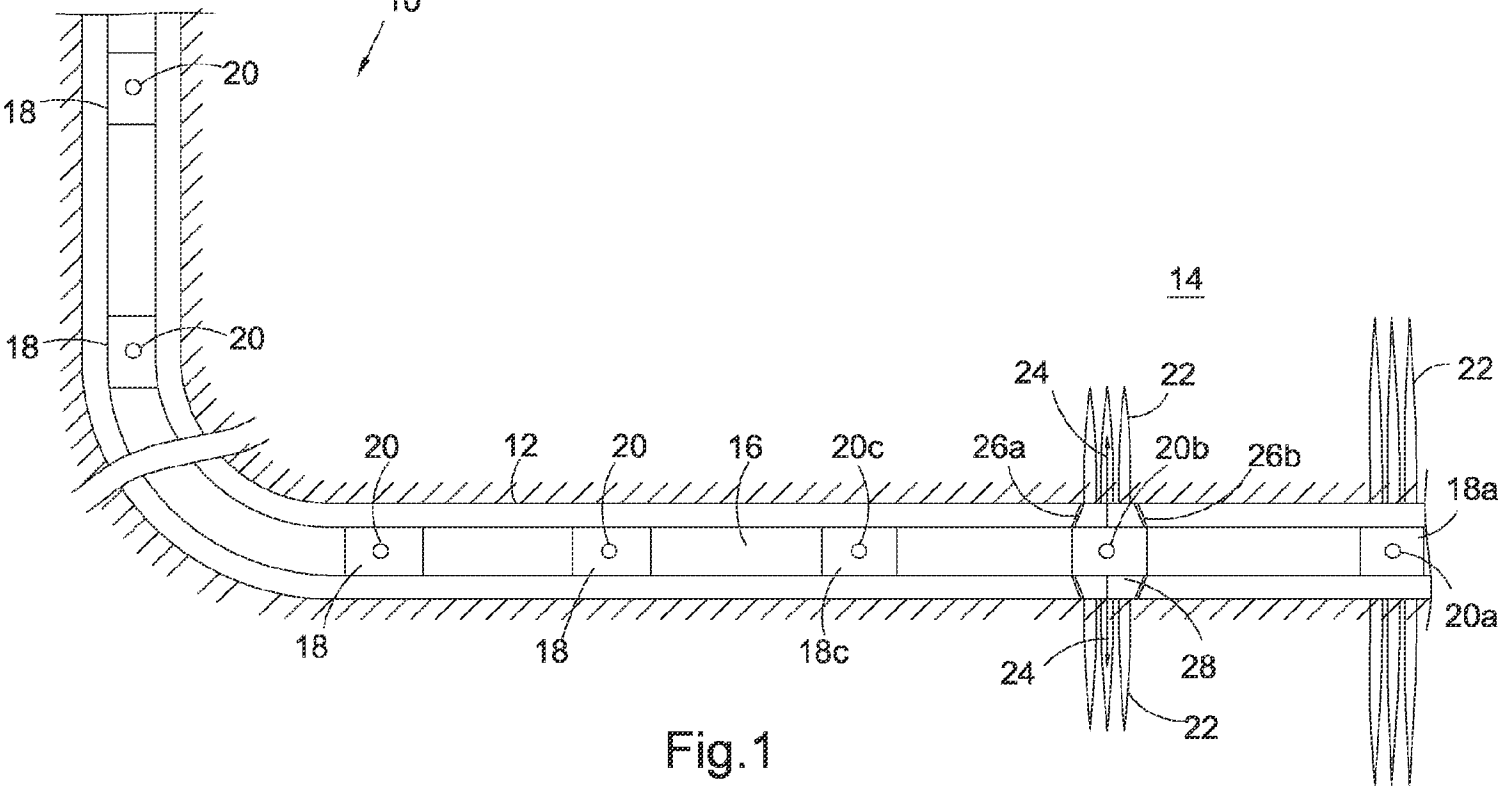
FIG. 1 is a diagrammatic view of a wellbore system which includes a completion/fracturing string including a number of fracturing tools according to an embodiment of the present invention.

FIG. 1 provides a diagrammatic illustration of a well bore system 10 including a drilled borehole 12 which intercepts a subterranean reservoir or formation 14. The formation 14 may contain hydrocarbons to be produced to surface via the well system 10. Alternatively, or additionally, the subterranean formation 14 may define a target for receiving a fluid injected from surface via the wellbore system 10, for example for increasing formation pressure to improve production of hydrocarbons from the formation 14 or a neighbouring formation, for sequestration purposes, or the like.

Following drilling of the borehole 12, or following a period of production/injection, the formation 14 may require to be stimulated or treated to permit improved production or injection rates to be achieved or restored. Known stimulation techniques include hydraulic fracturing which involves injecting a fracturing fluid into the formation at high pressure and/or flow rates to create mechanical fractures within the geology. These fractures may increase the effective near-wellbore permeability and fluid connectivity between the formation and wellbore. The fracturing fluid may carry proppant material, which functions to prop open the fractures when the hydraulic fracturing pressure has been removed. Matrix stimulation provides a similar effect as hydraulic fracturing. This typically involves injecting a chemical such as an acid, for example hydrochloric acid, into the formation 14 to chemically create fractures or wormholes in the geology. Such matrix stimulation may have application in particular geology types, such as in carbonate reservoirs.

In most stimulation or treatment regimes it is necessary to provide the ability to inject a treatment fluid into the formation via wellbore tools and infrastructure. Embodiments of the present invention permit such injection to be achieved. In this respect, a tubular string 16 extends through the borehole 12 of FIG. 1, wherein the string 16 comprises a plurality of fracturing tools 18 according to the present invention distributed along its length at a desired interval spacing. Each tool 18 includes a plurality of circumferentially arranged ports 20, which are initially closed. Further, each tool 18 includes or is associated with a downhole actuator (not shown in FIG. 1) which is operable to actuate the tool 18 to open the associated ports 20 to allow injection of a treating fluid, such as a fracturing fluid or acid, from the string 16 into the surrounding formation 14 to create fractures 22. As will be described in more detail below, each tool 18 is operated by actuation objects, such as balls, which are delivered through the string 16 from surface.

The tools 18 are capable of being actuated in a desired sequence, thus allowing the formation 14 to be treated along the length of the wellbore 12 in stages. Such ability to actuate the tools 18 sequentially may be achieved via the associated downhole actuator, as will be described in further detail below. In the particular embodiment shown in FIG. 1 the tools 18 are arranged to be actuated in an uphole sequence or direction. This is shown in FIG. 1 in which the lowermost illustrated tool 18*a* has previously been actuated, with an adjacent tool 18*b* on the uphole side shown in an actuated state with fracturing fluid from the opened ports 20*b* being directed into the formation 14 in the direction of arrows 24. Once appropriate fracturing has been achieved via tool 18*b*, the next uphole tool 18*c* may then be actuated. However, in other embodiments any sequence of operation of the tools may be achieved.

In the exemplary embodiment shown the tools 18 include optional annular seals 26*a*, 26*b* (shown energised on actuated tool 18*b*) on opposing axial sides of the ports 20*b*. When the seals 26*a*, 26*b* are energised they provide isolation of an annular region 28 around the tools 18, thus focussing the fracturing fluid into the formation 14, which may assist with improving geological penetration. The seals 26*a*, 26*b* may be actuated or energised by the action of the fracturing fluid being injected from the tool ports 20. In some embodiments the seals 26*a*, 26*b* may comprise cup seals.

Figure 2:
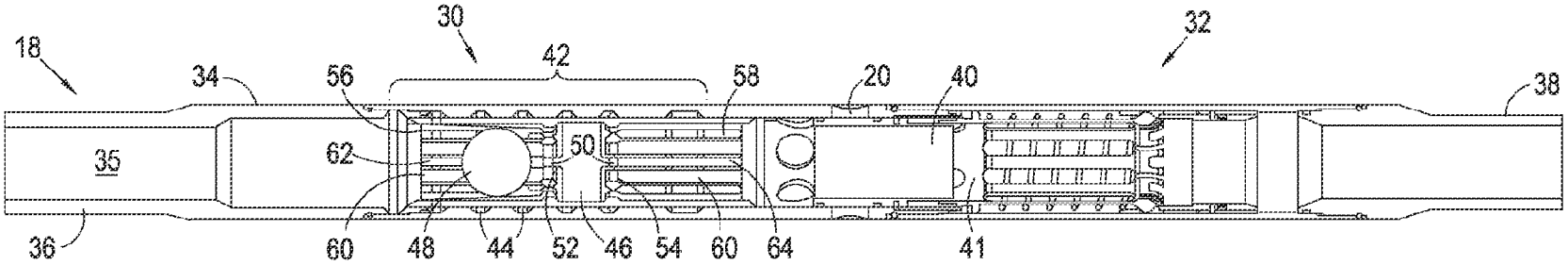
FIG. 2 is a longitudinal cross-sectional view of a downhole tool, specifically a downhole fracturing tool, according to an embodiment of the present invention.

A cross sectional view of a downhole tool 18, according to an exemplary embodiment of one or more aspects of the present invention is shown in FIG. 2. The tool 18 includes an actuator portion 30, provided according to an embodiment of an aspect of the present invention. The tool 18 also includes a tool portion 32 located on the downhole side of the actuator portion 30, wherein the tool portion 32 is provided according to an embodiment of an aspect of the present invention. In the embodiment shown, the actuator portion 30 and tool portion 32 and provided together to define a complete downhole tool 18. However, it should be recognised that the actuator and tool portions 30, 32 may be provided independently of each other. For example, the actuator portion 30 may be used to actuate any other downhole tool, such as a packer, ICD or the like. Further, the tool portion 32 may be actuated by any other suitable actuator arrangement.

The downhole tool 18 comprises a housing 34 which defines a central bore 35 and extends between an uphole connector 36 and a downhole connector 38. The connectors 36, 38 facilitate connection of the tool 18 within the tubular string 16 (FIG. 1).

Fluid ports 20 are provided radially through a wall of the housing 34 in the region of the tool portion 32, wherein the ports 20, when opened, facilitate outflow of a fluid from the central bore 35 of the housing 34. The tool portion 32 includes a valve member in the form of a sleeve 40 which is moveable axially along the housing 34 from a closed position in which the sleeve 40 blocks or closes the ports 20, as shown in FIG. 2, to an open position. Movement of the sleeve 40 towards its open position is achieved by the associated actuator portion 30, as described below.

The tool portion 32 further includes a catching sleeve 41 located downhole of the valve sleeve 40. The catching sleeve 41 illustrated is an embodiment of an aspect of the present invention. Although the catching sleeve 41 is illustrated as part of the present downhole tool, it should be understood that the catching sleeve 41 may be used in any other downhole tool.

The catching sleeve 41 is moveable from a free configuration, as shown in FIG. 2, in which a ball 48 may freely pass, to a catching configuration in which a ball 48 may be caught. In the present embodiment, the catching sleeve may function to catch a ball and establish diversion of any fluid from the central bore 35 outwardly through the fluid ports 20 when open. Further, in the present embodiment the catching sleeve 41 is operated to move to its catching configuration by movement of the valve sleeve 40 towards its open configuration. The form and operation of the valve sleeve 40 and catching sleeve 41 will be described in further detail below.

The actuator portion 30 defines an indexing profile 42 provided on the inner surface of the housing 34. The indexing profile 42 includes a plurality of axially spaced annular recesses 44 formed in the inner surface of the housing 34. An indexing sleeve 46 is mounted within the housing 34 and is configured to cooperate with the indexing profile 42 to be driven in a number of discrete linear movement steps through the housing 34 by passage of a corresponding number of actuation objects, specifically balls 48 in the present embodiment. The indexing sleeve 46 illustrated is an embodiment of an aspect of the present invention. The indexing sleeve 46 is driven in discrete movement steps until reaching an actuation site within the tool 18, where the indexing sleeve 46 engages and moves the valve sleeve 40 in a downhole direction to open the ports 20.

Figure 3:
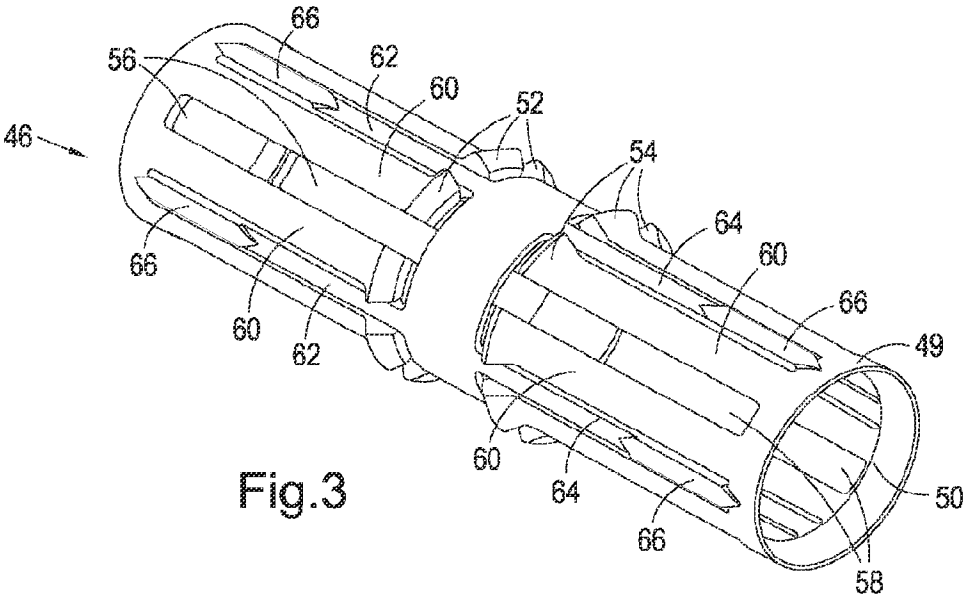
FIG. 3 is a perspective view of an indexing sleeve of the tool of FIG. 2.

A perspective view of the indexing sleeve 46 removed from the housing 34 is shown in FIG. 3, reference to which is additionally made.

The indexing sleeve 46 includes a tubular wall structure 49 which defines a central bore 50 corresponding with the central bore 35 of the housing 34. The central bore 50 is sized to permit an actuation object, specifically balls 48 to pass therethrough.

The indexing sleeve 46 also includes first and second circumferential arrays of engagement members 52, 54 which are arranged such that the array of first engagement members 52 are axially spaced apart from the array of second engagement members 54. The engagement members are arranged within slots 56, 58 formed through the wall structure 49. As will be described in more detail below, the arrays of engagement members 52, 54 cooperate with the indexing profile 42 of the housing 34 to be sequentially engaged by a passing ball 48 to drive the indexing sleeve 46 one discrete linear movement step. More specifically, the first and second arrays of engagement members 52, 54 are arranged to be moved radially within their associated slots 56, 58 such that each array of engagement members 52, 54 is moved in an alternating or out of phase manner relative to the other array of engagement members 52, 54 by cooperation with the indexing profile 42 during movement of the indexing sleeve 46 through the housing 34. Such alternating radial movement alternately moves the first and second arrays of engagement members 52, 54 radially inwardly and into the central bore 50 of the indexing sleeve 46, to thus be sequentially engaged by a passing ball 48. In this way, a passing ball 48 may engage the engagement members 52, 54 of one of the first and second arrays to move the indexing sleeve 46 a portion of a discrete movement step, and then subsequently engage the engagement members 52, 54 of the other one of the first and second arrays to complete the discrete movement step of the indexing sleeve 46.

The engagement members 52, 54 are mounted on the distal end of respective collet fingers 60 which are secured at their proximal ends to the tubular wall structure 49. The collet fingers 60 are resiliently deformable to facilitate radial movement of the engagement members 52, 54 by cooperation with the indexing profile 42. In the present embodiment the collet fingers 60 are unstressed when the engagement members 52, 54 are positioned radially outwardly and thus removed from the central bore 50. As such, the collet fingers 60 must be positively deformed by appropriate cooperation between the engagement members 52, 54 and the indexing profile 42 to move the engagement members 52, 54 radially inwardly into the central bore 50 to permit engagement by a ball 48. In such an arrangement, the collet fingers 60 may function to bias the engagement members 52, 54 in a direction to move radially outwardly from the central bore 50.

In the embodiment shown each slot 56, 58 of the indexing sleeve 46 accommodates two respective engagement members 52, 54. Further, the slots 56, 58 are defined between respective elongate ribs 62, 64. Each rib 62, 64 includes a spline feature or key 66 which are received in corresponding longitudinally extending slots or key-ways (not shown in the drawings) formed in the housing 34. Engagement between the keys 66 and the longitudinal slots or key-ways may function to rotationally lock the indexing sleeve 46 relative to the housing 34, while still permitting movement of the indexing sleeve 46 linearly through the housing 34. Such an arrangement may facilitate milling of the indexing sleeve 46, if ever required.

In some embodiments the indexing sleeve 46 may include a stand-off arrangement, permitting the indexing sleeve 46 to be mounted within the housing 34 with a desired clearance gap therebetween. For example, in some cases the keys 66 shown in FIG. 3 may in fact function to directly engage the inner surface of the housing 34, thus providing a stand-off clearance at least as large as the thickness of the keys 66. Providing such a stand-off with a clearance gap between the housing 34 and the indexing sleeve 46 may assist to minimise binding of the indexing sleeve 46 within the housing 34, for example by the accumulation of debris, such as proppant material.

A sequential operation of the indexing sleeve 46 to move one discrete step by passage of a ball 48 will now be described in detail with reference to FIGS. 4A to 4E, which each illustrate a portion of the tool 18 in the region of the actuator portion 30.

In the illustrated sequence the ball 48 travels in the direction of arrow 70, and thus functions to move the indexing sleeve 46 in the same direction. The direction of travel of the ball 48 in the present example is in the downhole direction. However, as will be described in more detail below, the indexing sleeve 46 may also be moved by passage of a ball in an opposite, uphole direction. As such, generally, the direction of travel of the ball 48 may be considered as in a downstream direction.

Figure 4A:
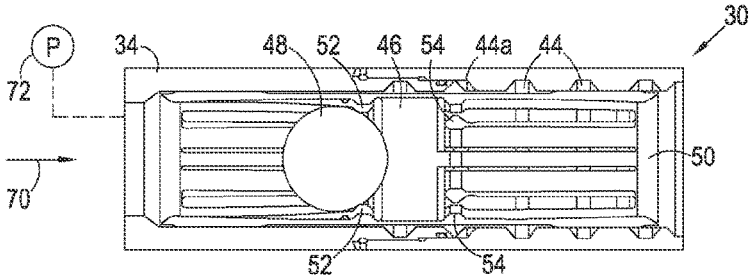
FIGS. 4A to 4E illustrate a sequence of operation of the indexing sleeve of the tool in FIG. 2 over one discrete linear movement step by passage of a single actuation object.

Prior to initiation of a discrete movement step, as shown in FIG. 4A, the indexing sleeve 46 is positioned within the housing 34 such that the engagement members 52 of the first array, which may be considered an upstream array, are positioned radially inwardly and thus presented into the central bore 50, whereas the engagement members 54 of the second array, which may be considered a downstream array, are positioned radially outwardly, and in fact received within an annular recess 44*a*. Such positioning of the engagement members 52, 54 is achieved by the relative axial spacing of the engagement members 52, 54 and the axial spacing, or pitch, of the annular recesses 44. That is, the axial spacing between the engagement members 52, 54 differs from, and specifically is larger than that of adjacent annular recesses 44. As such, when the engagement members 52, 54 of one of the first and second arrays are received within an annular recess 44 and outwardly positioned relative to the central bore 50, the engagement members 52, 54 of the other one of the first and second arrays will be positioned intermediate adjacent recesses 44 and thus positioned inwardly relative to the bore 50. Movement of the indexing sleeve 46 through the housing therefore permits the radial position of the engagement members 52, 54 to be cyclically varied, permitting sequential engagement by a ball.

Figure 4B:
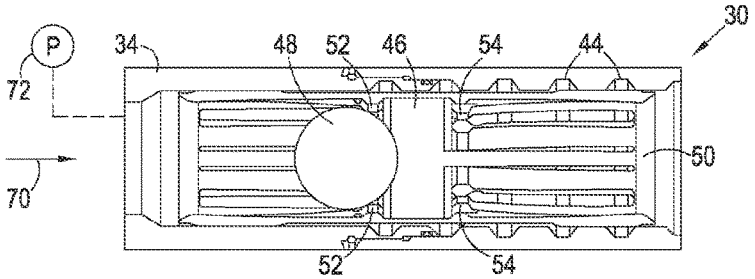
Figure 4C:
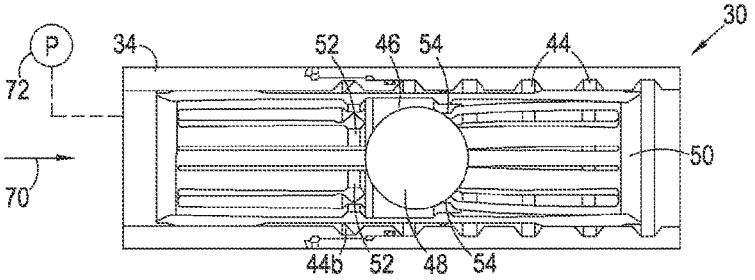
Figure 4D:
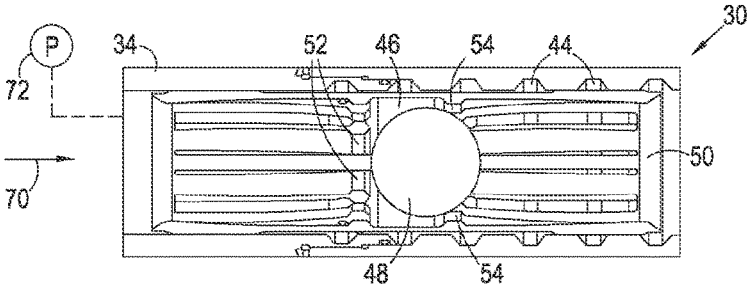

When the ball 48 reaches the indexing sleeve 46 the ball 48 will seat against the first or upstream array of engagement members 52, as shown in FIG. 4A, causing the indexing sleeve 46 to begin to move, as shown in FIG. 4B. Such movement will cause the first array of engagement members 52 to eventually become aligned with a recess 44*b*, and thus moved radially outwardly from the central bore 50, allowing the ball 48 to pass, as shown in FIG. 4C. However, at the same time the engagement members 54 of the second array will be deflected radially inwardly, to be positioned within the central bore 50, by misalignment with an annular recess 44. In this respect, in the embodiment shown the recesses 44 and the engagement members 52, 54 define corresponding ramped or tapered sides, for example of around 45 degrees, to facilitate or assist interaction during relative axial movement of the indexing sleeve 46 through the housing 34. As the engagement members 54 of the second array are now positioned radially inwardly the ball 48 will become seated against these engagement members 54, thus continuing to drive the indexing sleeve 48, as shown in FIG. 4D.

Figure 4E:
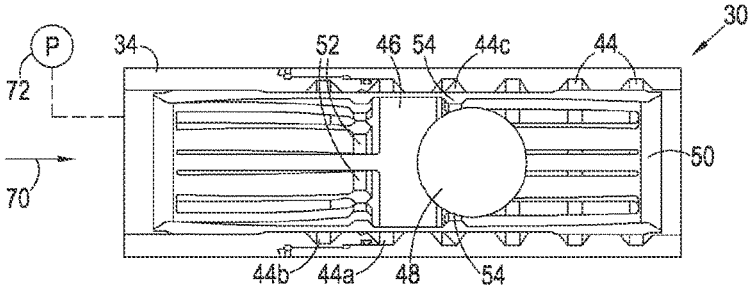

Eventually, the engagement members 54 of the second array will again become aligned with an annular recess 44*c*, thus permitting the ball 48 to be released and continue in the downstream direction, as shown in FIG. 4E. At the same time, the engagement members 52 of the first array will be positioned intermediate adjacent annular recesses 44*a*, 44*b*, becoming radially inwardly deflected, and positioned to be engaged by a subsequent ball.

The ball 48 may drive the indexing sleeve 46 primarily by impact against the engagement members 52, 54 when positioned within the bore 50. That is, the momentum of the ball 48 passing through the indexing sleeve 46 may drive said sleeve 46.

Alternatively, or additionally, the ball 48 may permit the indexing sleeve 46 to be driven by a pressure differential between upstream and downstream sides of the indexing sleeve 46. For example, the ball 48 may de driven by a fluid flow, and when the ball 48 seats against the engagement members a flow restriction may be created, which may permit a back pressure to be established, thus providing a desired pressure differential between upstream and downstream sides of the indexing sleeve 46. The flow restriction may be provided between the points of engagement of the ball 48 with individual engagement members 52, 54. Alternatively, or additionally, the flow restriction may be achieved by diversion of flow between the indexing sleeve and the housing 34 when the ball is seated against the engagement members 52, 54.

The use of a pressure differential to drive the indexing sleeve 46 may permit monitoring of the progress of the ball 48 to be achieved. For example, a monitoring system 72 may be provided which monitors the variation in pressure as the ball 48 progresses through the indexing sleeve. Such pressure variations may be associated with the particular positioning of the ball 48, which may provide useful information to an operator. Such an arrangement may be advantageous in cases where multiple actuators are provided in series within a tubular string, as illustrated in FIG. 1. In an alternative embodiment, an acoustic monitoring system may be used, which monitors acoustic signals generated during interaction between the ball 48 and the indexing sleeve 46.

As noted above, the indexing sleeve is operable to be driven by a ball in opposing directions. Such an arrangement will now be exemplified with reference to FIG. 4E. In FIG. 4E the indexing sleeve 46 is positioned such that the first and second arrays of engagement members 52, 54 will be sequentially engaged by a ball passing in a downhole direction. That is, the first array of engagement members 52 are positioned radially inwardly to be first engaged by a passing ball 48, while the second array of engagement members 54 are positioned radially outwardly. When in such a configuration, in the event of the ball 48 now travelling in an opposite, uphole direction, the ball 48 will pass the second array of engagement members 54 (which will now become the upstream engagement members), and will engage the first array of engagement members 52 (which will now become the downstream engagement members). Upon engagement with the first array of members 52 the indexing sleeve 46 will be driven in an uphole direction until the first array of members 52 become aligned with and received into the annular recess 44*b*, permitting the ball 48 to be released and continue to travel in the uphole direction. At the same time, the second array of engagement members 54 will become misaligned with a recess 44 and thus moved radially inwardly. Thus, when in this reconfigured position the first and second arrays of engagement members 52, 54 may now be sequentially engaged with a further ball passing in the uphole direction. As such, a first ball passing in the uphole direction may reconfigure the indexing sleeve 46 to permit sequential engagement of the members 52, 54 by a subsequent passing ball.

In the exemplary wellbore system of FIG. 1 a number of tools 18 are arranged in series and configured to be actuated in a desired sequence. Such a desired sequence may be achieved by appropriate initial positioning of the indexing sleeve 46 in each tool 18, such that the tools 18 are operated in response to the passage of a different number of balls. Such ability to create a system which allows a desired actuation sequence to be achieved based on the initial positioning of respective indexing sleeves will be described in further detail below. However, as the sequential operation of individual tools 18 may be reliant on passage of individual balls, it is important that each ball is registered upon passing through an indexing sleeve and reliably moves the indexing sleeve a required discrete step. If a ball were to pass without driving an indexing sleeve a corresponding discrete step then this may upset a desired actuation sequence. The present inventors have identified a potential for such ball passage without registering a count if two balls were ever to pass through an indexing sleeve in quick succession. If such an occasion were not addressed a trailing ball could potentially pass behind a leading ball without registering corresponding separate discrete movement steps.

In the present embodiment the first and second arrays of engagement members 52, 54 are arranged relative to each other (specifically the axial spacing of the members 52, 54) to permit only a single ball 48 to be positioned therebetween at any time. As such, the axial region between the first and second arrays of engagement members 52, 54 may define a ball trap. As shown in FIG. 4C, when the ball 48 initially enters this ball trap region between the first and second arrays of engagement members 52, 54, the ball 48 will engage the members 54 of the second array. While in this position the members 52 of the first array are positioned radially outwardly. However, any subsequent or trailing ball arriving at the indexing sleeve 46 at this time will not be permitted to progress due to engagement with the ball 48 which is positioned within the ball trap. As the indexing sleeve 46 progresses the members 54 of the second array will eventually move radially outwardly and thus permit the ball to be released, as shown in FIG. 4E. However, at the same time the members 52 of the first array will be moved radially inwardly and thus will prevent progression of any trailing ball, at least without the trailing ball now acting to drive the indexing sleeve 46 a corresponding discrete movement step.

The tool portion 32 of the downhole tool 18 will now be described in further detail with reference to FIG. 5, which is an enlarged view of the tool 18 of FIG. 2 in the region of tool portion 32. The tool portion 32 is illustrated in an initial configuration, with the valve sleeve 40 in a closed position and the catching sleeve 41 in a free configuration. The following description will describe the various features of the tool portion 32 when in this initial configuration. A sequential operation to permit the tool portion 32 to be reconfigured from this initial configuration will then be provided.

The valve sleeve 40 defines a central bore 45, and the catching sleeve 41 also defines a central bore 47, wherein the bores 45, 47 correspond to each other and with a central bore 35 of the housing 34.

When in its closed position the valve sleeve 40 blocks the fluid ports 20, with o-ring seals 80 positioned on opposing axial sides of the fluid ports 20 to facilitate sealing. The valve sleeve 40 is axially secured relative to the housing 34 via a number of shear screws 82 (only one shown in the particular cross-section of FIG. 5). The valve sleeve 40 includes a plurality of ports 84. As will be described in more detail below, to move the valve sleeve 40 towards its open position an axial actuation force is applied by the indexing sleeve 46 (not shown in FIG. 5) to initially shear the screws 82 and aligned the sleeve ports 84 with the ports 20 in the housing 34. The valve sleeve 40 includes a key member 86 in an outer surface thereof which is received within a longitudinal key slot 88 provided in the inner surface of the housing 34. Interaction between the key 86 and slot 88 prevents relative rotation between the valve sleeve 40 and the housing 34, thus maintaining the sleeve ports 84 in the correct circumferential alignment relative to the ports 20 in the housing 34.

The valve sleeve 40 includes an annular recess 90 in an outer surface thereof, extending upwardly from a downhole axial end 92 and terminating at an annular load shoulder 93. Such a recess 90 defines an annular shroud 94 which in the illustrated configuration extends into the central bore 47 of the catching sleeve 41, and specifically is positioned inside an uphole axial end 96 of the catching sleeve 41, such that the uphole end 96 of the catching sleeve 41 is positioned within the annular recess 90 of the valve sleeve 40. In this arrangement the shroud 94 physically isolates an uphole end face 98 of the catching sleeve 41, and thus functions to prevent a passing ball, or other object, from engaging the uphole end face 98 which may otherwise damage the catching sleeve 41, accidentally or prematurely cause actuation of the catching sleeve 41, or the like. That is, it has been recognised by the present inventors that a passing ball may not follow a perfect linear path through the tool 18, and in fact may continuously impact or ricochet off the inner surfaces of the tool 18. If such an impact were to occur against the end face 98 of the catching sleeve 41 then the impact force may be sufficient to cause actuation of the catching sleeve 41, and/or may cause damage to the catching sleeve 41.

Figure 5:
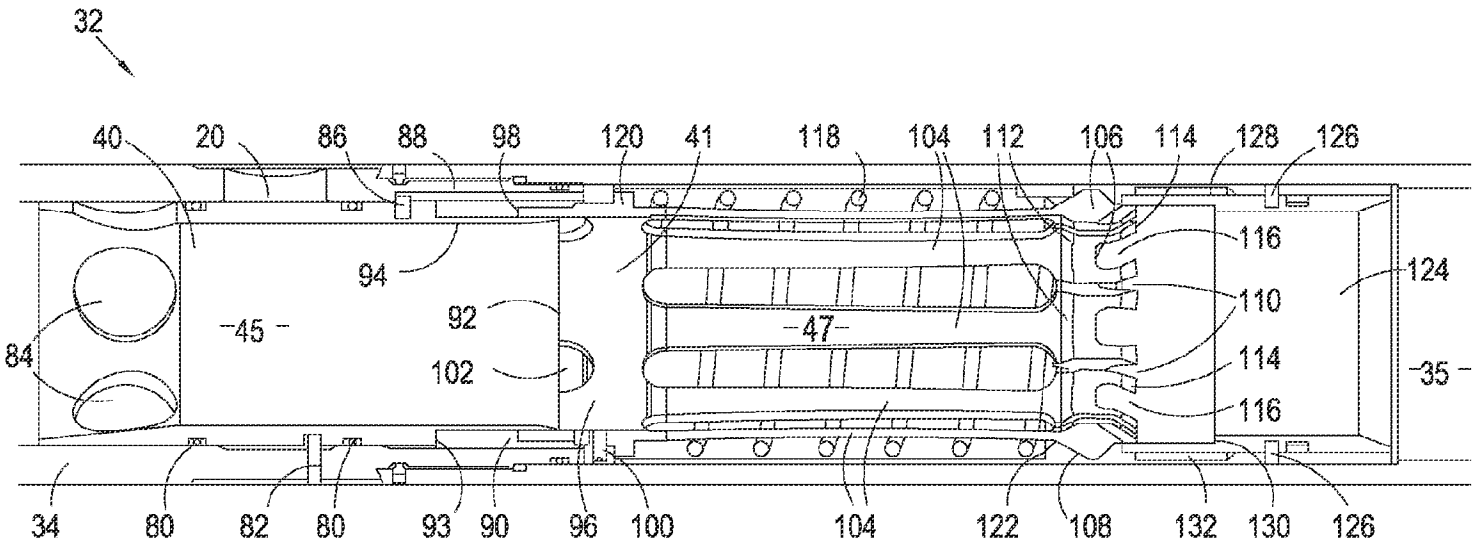
FIG. 5 is an enlarged view of the tool of FIG. 2 in the region of a valve and ball catching arrangement.

The catching sleeve 41 is initially secured relative to the housing 34 via a number of shear screws 100 (only one shown in FIG. 5). When in this initial configuration the catching sleeve 41 is positioned relative to the valve sleeve 40 such that an axial spacing or separation gap is defined between the load shoulder 93 of the valve sleeve 40 and the uphole end face 98 of the catching sleeve 41. Such initial separation may define a lost motion arrangement within the tool portion 32. That is, when axial movement of the valve sleeve 40 is initiated the separation gap will be closed before eventual engagement between the load shoulder 93 of the valve sleeve 40 and the end face 98 of the catching sleeve 41, wherein subsequent axial load applied by the valve sleeve 40 may shear the screws 100, and then cause axial movement of the catching sleeve 41 towards its catching configuration, as will be described in further detail below.

The uphole end 96 of the catching sleeve 41 defines an uphole tubular portion which includes a number of ports 102. These ports 102 may function to permit circulation of fluid behind the catching sleeve 41, for example to facilitate circulation or removal of debris. These ports 102 may also function to prevent hydraulic lock by avoiding a pressure differential between the interior and exterior of the valve sleeve 40.

The catching sleeve 41 includes a plurality of collet fingers 104 extending longitudinally from the uphole tubular portion 96, wherein each collet finger 104 supports a seat member 106 on a distal end thereof. The collet fingers 104 are resiliently deformable, by longitudinal bending, to permit the seat members 106 to be selectively radially moveable relative to the central bore 47 of the catching sleeve 41. Further, the collet fingers 104 define a tapering thickness along their length, which functions to provide more uniform bending therealong, with an associated uniform stress distribution being achieved. In the embodiment shown the fingers 104 reduce in thickness from the uphole tubular portion 96 towards the seat member 106.

When the seat members 106 are positioned radially outwardly, as shown in FIG. 5, a ball may pass with minimal engagement with the seat members 106. However, when the seat members 106 are positioned radially inwardly, as will be described in more detail below, the seat members 106 collectively define a restriction within the central bore 47, and thus may be engaged by a passing ball. When the seat members 106 are positioned radially inwardly with the catching sleeve 41 configured in its catching configuration, a ball may engage and seat against the seat members 106 and thus be caught within the catching sleeve 41.

The tool portion 32 further comprises an annular recess 108 which is profiled to receive the seat members 106 when said seat members 106 are positioned radially outwardly. In the present embodiment, the collet fingers 104 provide a bias force such that the seat members 106 are biased radially outwardly and received within the annular recess 108, and thus positioned to permit passage of a ball. When the seat members 106 are positioned radially outwardly and located within the recess 108, a circumferential gap 110 is provided between adjacent seat members 106. When the seat members 106 are moved radially inwardly, these circumferential gaps 110 are closed, and in some embodiments adjacent seat members 106 are engaged or are positioned in very close proximity relative to each other, defining a substantially continuous annular structure.

Each seat member 106 includes an uphole seat surface 112 configured to be engaged by a ball when travelling in a downhole direction. The uphole seat surfaces 112 may be configured to provide a substantially complete or continuous engagement with a ball. Such an arrangement may facilitate sealing between a ball and the seat members 106. Such sealing may permit a ball to be sealingly engaged within the catching member 41 and thus substantially seal the central bore 47. This may allow appropriate fluid diversion from the central bore through the fluid ports 20. Also, in some embodiments such sealing against the seat members 106 may permit control of pressure uphole of the catching sleeve 41. Further, such sealing of a ball within the catching sleeve 41 may permit the catching sleeve 41 to be actuated, for example by a pressure differential established between uphole and downhole sides of the catching sleeve 41.

In the present embodiment the uphole seat surfaces 112 are generally convex in shape, which provides significant advantages when engaging a ball which also has a convex surface, as will be described in more detail below.

Each seat member 106 includes a downhole seat surface 114 configured to be engaged by a ball when travelling in an uphole direction. Such an arrangement may permit one or more balls to be engaged with the seat members 106 when reverse flowed through the tool, for example to permit return of the balls to surface, to permit reverse actuation of the tool, for example to close the valve sleeve 40. Further, such reverse flow may be permitted or initiated to assist in clearing a blockage within the tool or associated string.

The downhole seat surfaces 114 in the embodiment shown include respective slots 116 which permit fluid to bypass a ball when engaged against the downhole seat surfaces 116. Such fluid bypass may be advantageous in an event that a ball may become trapped against the downhole seat surfaces 114. This may be particularly advantageous in production wells, as production may still be achieved even in the event of a ball becoming stuck. The slots 116 define discontinuities within the seat surfaces 114, such that when a ball is engaged therewith the discontinuities may permit a degree of fluid by-pass.

The catching sleeve 41 is biased to move in an uphole direction by a coil spring 118 which acts between an annular lip 120 formed on an outer surface of the uphole tubular portion 96 of the catching sleeve 41, and an annular region 122. The coil spring 118 also functions to rotationally lock the catching sleeve 41 relative to the housing 34. That is, a downhole end of the spring 118 may be rotationally secured relative to the housing 34, and an uphole end of the spring 118 may be rotationally secured relative to the catching sleeve 41. Rotationally securing the catching sleeve 41 relative to the housing 34 may permit the catching sleeve 41 to be machined, for example milled, which may be required as part of a remedial operation, for example in the event of the catching sleeve 41 failing to release a ball.

The tool portion 32 further comprises a release sleeve 124 which is initially secured in the position shown in FIG. 5 via a plurality of shear screws 126. The release sleeve 124 includes a cylindrical inner support surface 128 which defines a region of reduced inner diameter relative to the annular recess 108.

When the catching sleeve 41 is moved axially in a downhole direction, which will be caused by axial movement of the valve sleeve 40 towards its open position, the seat members 106 will be displaced from the annular recess 108 and engaged with the inner support surface 128 of the release sleeve 124, and thus deflected radially inwardly, into the central bore 47 and presented in a position to be engaged by a ball. As the seat members 106 in this position are radially supported by the release sleeve 124, the engaged ball will become caught in the catching sleeve 41.

The release sleeve 124 includes an annular shoulder 130 which, as will be described in further detail below, is engaged by the seat members 106 such that the catching sleeve 41 may apply an axial load in a downhole direction on the release sleeve 124.

The housing 34 defines or includes a release recess 132 which is initially covered by the release sleeve 124. When a suitable axial load is applied on the release sleeve 124 by the catching sleeve 41 to shear the screws 126, the release sleeve 124 may be moved axially to uncover the release recess 132. When uncovered, the release recess 132 may receive the seat members 106, thus allowing the catching sleeve 41 to be configured in a release configuration.

Reference is now made to FIGS. 6A to 6D which provide perspective views of the catching sleeve 41 in sequential stages of manufacture. A cylindrical component 41*a*, such as a metal component, is provided as in FIG. 6A, and the catching sleeve 41 is initially machined as a complete component to the form illustrated in FIG. 6B. As such, the catching sleeve 41 includes the uphole tubular portion 96 with ports 102, with the annular lip 120 for engaging the coil spring 118 (FIG. 5). In this respect the annular lip 120 includes circumferential gaps 140. In use at least one gap 140 receives an axial portion of the coil spring 118 to rotationally secure the catching sleeve and coil spring 118 together.

Figure 6B:
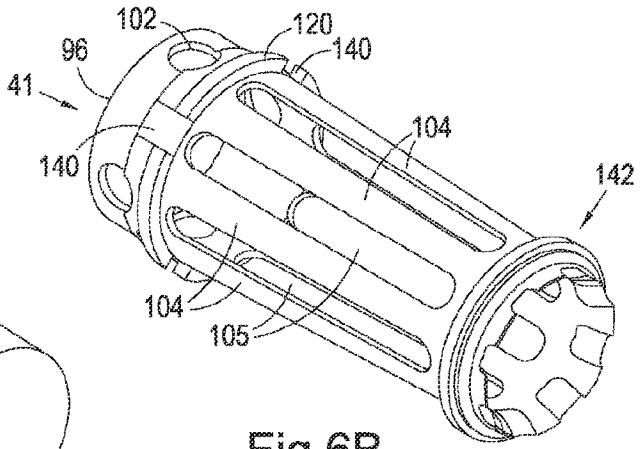
FIGS. 6A to 6D are perspective views of a catching sleeve component of the tool of FIG. 2, shown in different stages of manufacture.
Figure 6A:
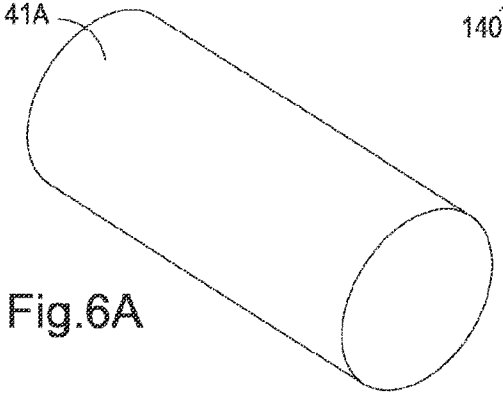
Figure 6D:
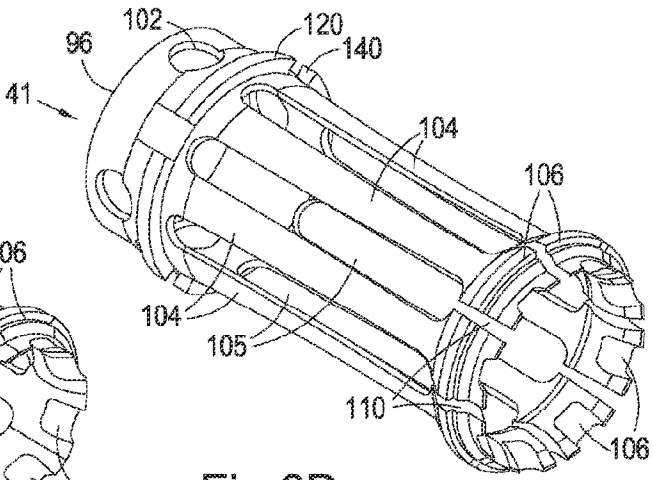
Figure 6C:
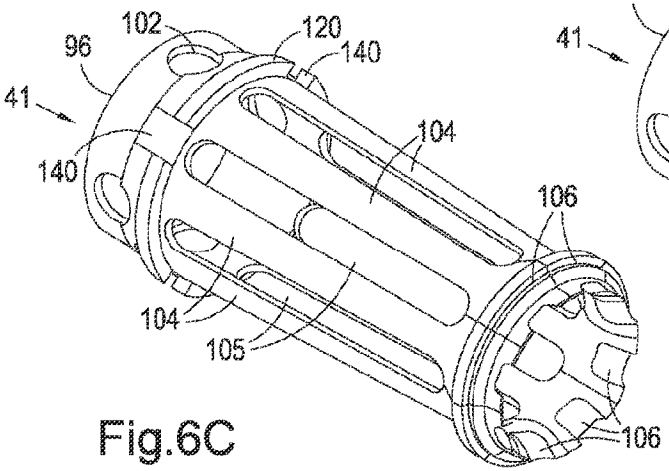

The seat members 106 are initially formed as a complete annular structure 142, in the form that the seat members 106 adopt when positioned radially inwardly to catch a ball. The collet fingers 104 are provided as longitudinal ribs which extend, at a slight inward taper, from the uphole tubular portion 96 to the complete annular structure 142. The ribs define slots 105 therebetween. Once formed in this way the annular structure 142 is divided by wire cutting to form the individual seat members 106, as illustrated in FIG. 6C. Following this division, collet fingers 104 are plastically deformed radially outwardly, to the form shown in FIG. 6D, by pressing over a mandrel, for example.

However, in an alternative embodiment the catching sleeve 41 may be installed within the tool in the form of FIG. 6C. As such, passage of a ball may cause the seat members 106 to be deflected radially outwardly, until the seat members 106 become radially supported by the release sleeve 124, such that a ball will no longer be able to deflect the seat members 106 and thus will become caught in the catching sleeve 41.

Reference is now made to FIGS. 7A to 7I in which a complete operation cycle of the tool 18 of FIG. 2 will be described. In this respect, FIGS. 7A to 7I provide a sequential illustration of a ball 48 driving the indexing sleeve 46 over its final discrete linear movement step to actuate the valve sleeve 40 and catching sleeve 41 to perform a fracturing operation, and then subsequently permit the ball 48 to be released.

Figures 7A, 7B, 7C, 7D:
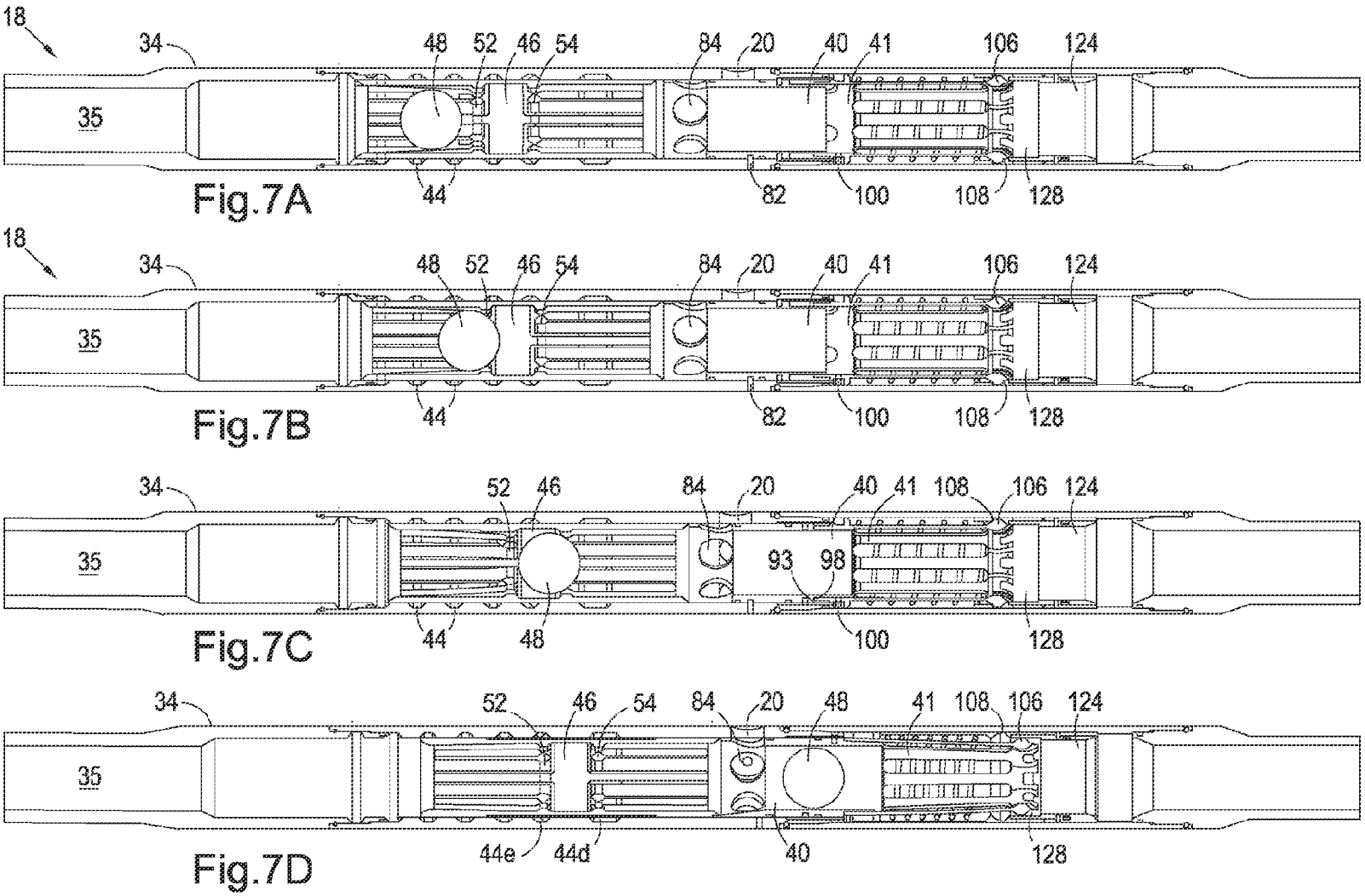
FIGS. 7A to 7E illustrate a sequence of operation by an actuation object to reconfigure the tool into an operational state.

Referring initially to FIG. 7A the indexing sleeve 46 is positioned in non-contact relationship with the valve sleeve 40, wherein the first array of engagement members 52 are positioned radially inwardly in preparation to be engaged by an approaching ball 48. Further, the valve sleeve 40 is located in its closed position to close the ports 20, and the catching sleeve 41 is located in its free configuration such that the seat members 106 are positioned radially outwardly.

In FIG. 7B the ball 48 engages the first array of engagement members 52 to drive the indexing sleeve 46 into engagement with the valve sleeve 40, thus applying an axial load on the valve sleeve 40 and shearing the screws 82 which initially hold the valve sleeve 40 in its closed position. The ball 48 will continue to drive the indexing sleeve 46 and the valve sleeve 40 until the first array of engagement members 52 become aligned with a recess 40, permitting the ball 48 to progress and engage the second array of engagement members 54, which have become deflected radially inwardly, as illustrated in FIG. 7C. As such, the indexing sleeve 46 and valve sleeve 40 may continue to be driven through the housing 34 by the ball 48 until the load shoulder 93 of the valve sleeve 40 comes into engagement with the uphole axial end face 98 of the catching sleeve 41, permitting an axial load to be applied on the catching sleeve 41 to shear the screws 100 initially holding the catching sleeve 41 in its free configuration.

The ball 48 may continue to drive the indexing sleeve 46 by engagement with the second array of engagement members 54, and thus also drive the valve sleeve 40 and the catching sleeve 41. As illustrated in FIG. 7D the valve sleeve 40 will eventually reach its fully open position in which the sleeve ports 84 become aligned with the fluid ports 20. Further, the catching sleeve 41 will eventually be configured in its catching configuration, also shown in FIG. 7D, in that the seat members 106 of the catching sleeve 41 are displaced from the corresponding recess 108 and onto the support surface 128 of the release sleeve 124, thus deflecting the seat members 106 radially inwardly as shown in FIG. 7D.

As shown in FIG. 7D, eventually the second array of engagement members 54 will become aligned with an annular recess 44 within the housing 34, specifically lowermost annular recess 44*d*, allowing the ball 48 to be released from the indexing sleeve 46 and continue in the downhole direction. In this respect it should be noted that the two lowermost annular recesses, 44*d*, 44*e* are provided at an axial spacing which matches the axial separation of the first and second arrays of engagement members 52, 54. This permits all the engagement members 52, 54 to become positioned within a recess 44*d*, 44*e* following the final discrete linear movement step of the indexing sleeve 46, thus effectively disabling the indexing sleeve 46. Further, when in this position the indexing sleeve 46 functions to lock the valve sleeve 40 in its open position.

Figure 7E:
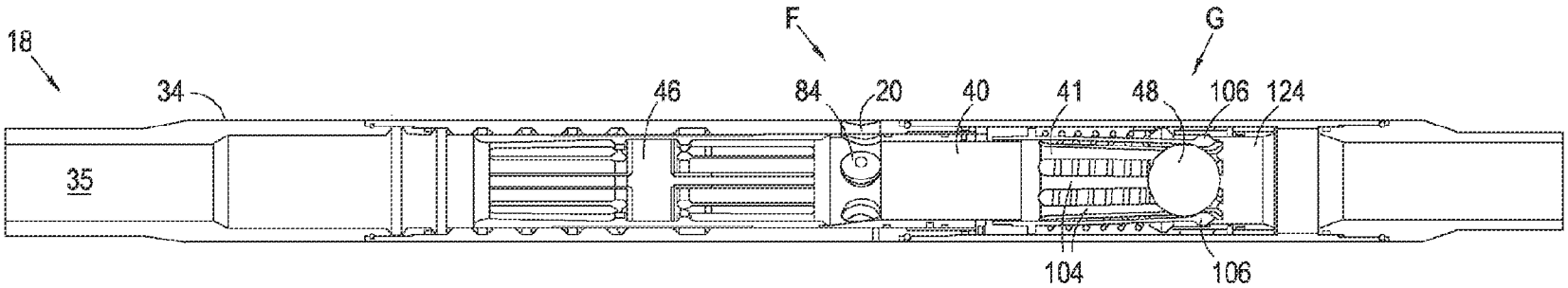

As shown in FIG. 7E, the released ball 48 will eventually be caught by the reconfigured seat members 106 of the catching sleeve 41, thus establishing a blockage below the opened ports 20, functioning as a diverter to cause substantially all fluid flowing through the central bore 35 of the tool 18 to flow radially outwardly from the ports 20 to fracture a surrounding formation, as illustrated in FIG. 1. Further, the blockage achieved by the ball 48 may permit an appropriate fluid pressure above the ball 48 to be achieved, which may be necessary to achieve appropriate fracturing of the surrounding formation.

In the specific embodiment disclosed the ports 20 become opened before the ball 48 lands in the catching sleeve 41, as illustrated in FIG. 7D. In such an arrangement the ball 48 will suddenly arrest or substantially arrest a column of fluid positioned above the ball 48 when the ball 48 lands against the seat members 106 of the catching sleeve 41, as in FIG. 7E. If the ports 20 are arranged to immediately provide full flow such fast arrest of the fluid column above the ball 48 may result in initial rapid ejection of fluid through the ports 20. This may provide an initial fluid hammer effect which could be advantageous in improving initial geological penetration of the ejected fluid.

However, in some situations this initial arrest of a fluid column may provide a significant impulse load on the catching sleeve 41 and thus on the release sleeve 124. This initial impulse force may be of sufficient magnitude to actuate the release sleeve 124, perhaps causing premature release of the ball 48, before sufficient fracturing within the surrounding formation has been achieved. To address this situation the present invention may employ a choking arrangement which functions to initially choke the outflow of fluid through the ports 20 when initially opened.

Figure 7G:
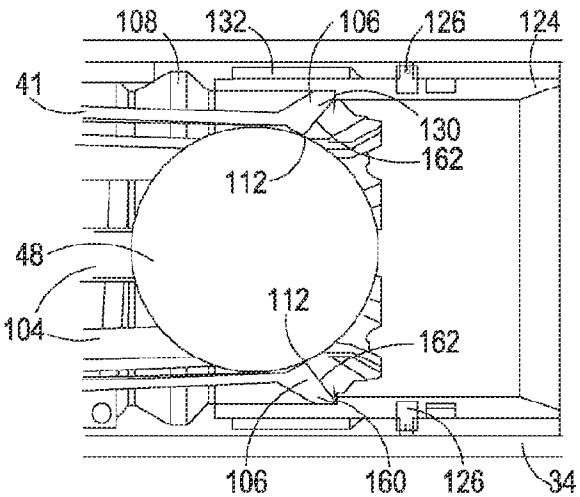
FIG. 7G provides an enlarged view of region G in FIG. 7E.
Figure 7F:
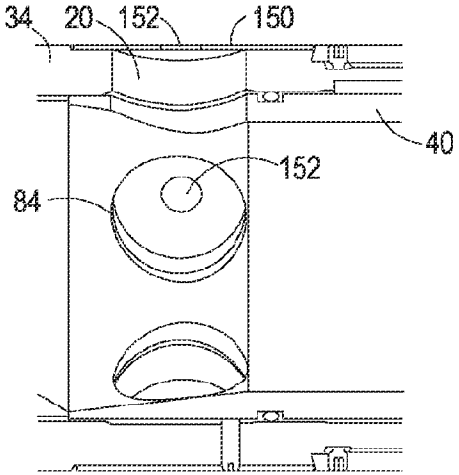
FIG. 7F provides an enlarged view of region F in FIG. 7E.

In the present exemplary embodiment such a choking arrangement comprises an erodible sleeve 150, illustrated most clearly in the enlarged view of FIG. 7F, which is mounted on the outer surface of the housing 34 at the location of the ports 20. The sleeve 150, which may be formed from aluminium, includes a plurality of orifices 152 which are aligned with a respective port 20. When flow through the ports 20 is initiated the orifices 152 function to choke the flow. However, over time the orifices 152 become enlarged by erosion, which may be significant in embodiments where the fluid comprises a proppant material, such that the choking effect will decrease, until a full flow condition is established.

An enlarged view of the tool 18 in FIG. 7E in the region of the ball 48 and seat members 106 of the catching sleeve 41 is provided in FIG. 7G. In the illustrated configuration the seat members 106 are engaged with the load shoulder 130 of the release sleeve 124. Each seat member 106 includes a notch 160 formed in a radially outer surface which is configured to permit engagement with the load profile 130 of the release sleeve 124.

As noted above, the uphole seat surfaces 112 of the seat members 106 define a convex profile. Such a convex profile permits a small region of contact to be achieved with the ball 48, and specifically a small circumferential contact region to be established. This small contact region may permit improved control over the load path from the ball 48 through the seat members 106 to be achieved. In particular, a load vector 162 established by the engaged ball 48 may be controlled to be aligned with the notches 160 formed in the seat members 106, such that the load from the ball 48 may be directly transferred to the release sleeve 124 via the load shoulder 130 of the release sleeve 124. Such an arrangement may minimise the creation of bending moments on the associated collet fingers 104.

Furthermore, minimising the region of contact between the ball 48 and the seat members 106 may reduce the risk of the ball 48 becoming swaged or otherwise deformed into the seat members 106, which might otherwise cause the ball 48 to become stuck within the catching sleeve 41.

Figure 7H:
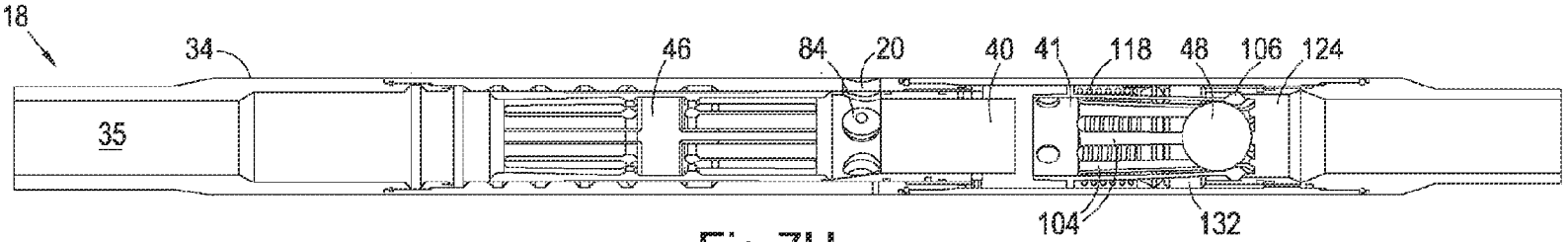
FIGS. 7H and 7I illustrate a subsequent sequence of operation to permit an actuation object to be released from the tool.
Figure 7I:
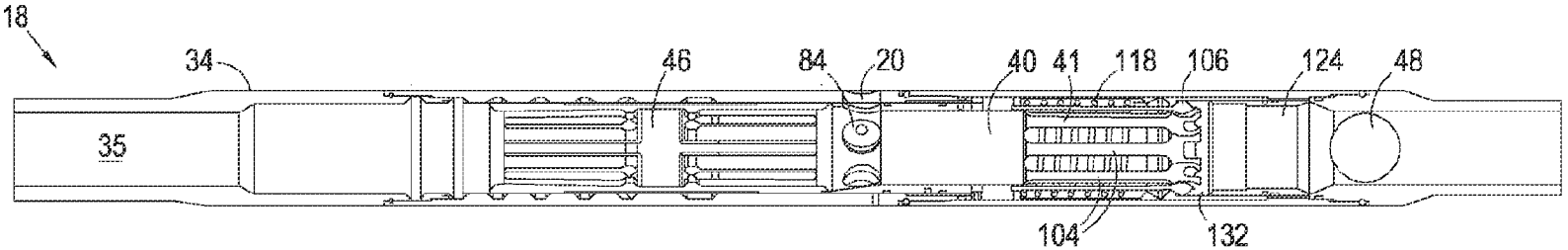

When the catching sleeve 41 is to be reconfigured to its release configuration to permit release of a caught ball 48, it is necessary to displace the release sleeve 124 and expose the associated release recess 132. In the present embodiment this is achieved by increasing the pressure on the uphole side of the ball 48 to increase the load applied on the release sleeve 124 via the seat members 106, until the shear screws 126 holding the release sleeve 124 in place are sheared, such that the pressure uphole of the ball 46 may act to drive the catching sleeve 41 and the release sleeve 124 downwardly, as illustrated in FIG. 7H. When in this configuration the spring 118 is compressed by the catching sleeve 41, such that relieving pressure uphole of the ball 48 will cause the bias force of the spring 118 to force the catching sleeve 41 in an uphole direction until the seat members 106 become aligned with the uncovered release recess 132, as shown in FIG. 7I. When aligned as such, the collet fingers 104 will relax and thus move the seat members 106 radially outwardly to be received within the release recess 132, causing the ball 48 to be released.

Figure 8C:
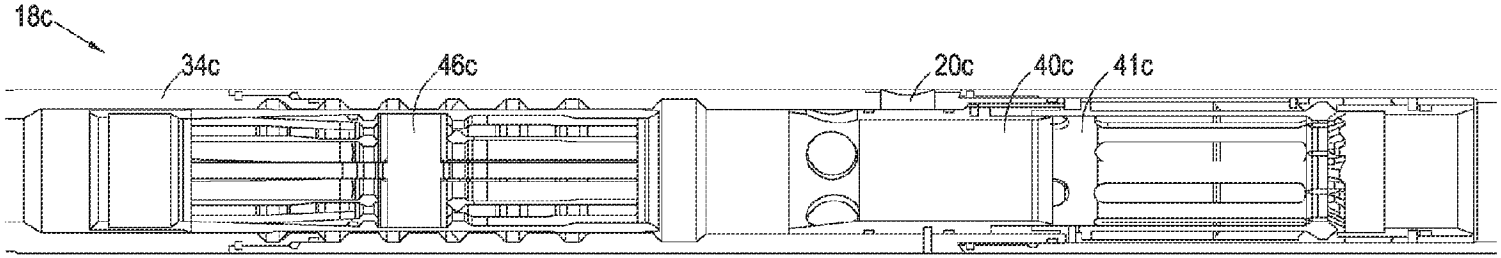
FIGS. 8A, 8B and 8C illustrate individual fracturing tools to be arranged within a completion/fracturing string, such as shown in FIG. 1, wherein each tool is provided with the respective indexing sleeves in a different commission position.
Figure 8B:
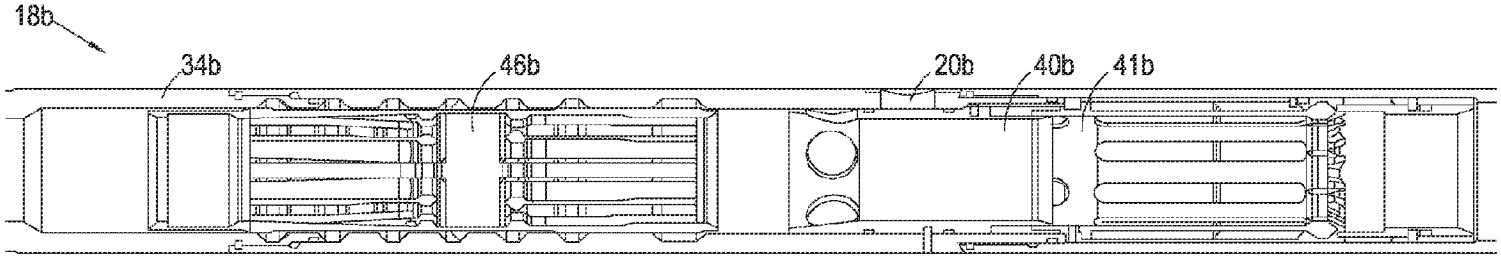
Figure 8A:
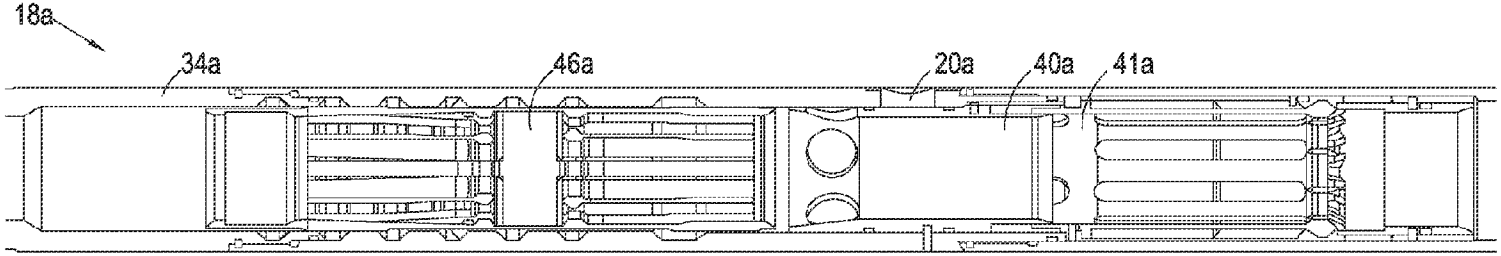

As described above and generally illustrated in FIG. 1, multiple tools 18 according to the invention may be provided as part of a downhole system, such as a fracturing system, wherein the tools are initially configured to be actuated upon passage of a different number of balls. The individual tools 18 may be initially configured by appropriate placement of the associated indexing sleeves 46 relative to the housing 34, and specifically relative to the indexing profile 42 of the housing 34. This is exemplified in FIGS. 8A, 8B and 8C. FIG. 8A provides a cross-section view of the tool 18*a* of FIG. 1, FIG. 8B provides a cross-sectional view of the immediate uphole tool 18*b* of FIG. 1, and FIG. 8C provides a cross-sectional view of tool 18*c* of FIG. 1.

The indexing sleeve 46*a* of tool 18*a* is positioned within housing 34*a* such that the indexing sleeve 46*a* must be driven by one discrete movement step by passage of a single ball to actuate the associated valve sleeve 40*a* and catching sleeve 41*a*.

The indexing sleeve 46*b* of tool 18*b* is positioned within housing 34*b* such that the indexing sleeve 46*b* must be driven by two discrete movement steps by passage of two balls to actuate the associated valve sleeve 40*b* and catching sleeve 41*b*.

The indexing sleeve 46*c* of tool 18*c* is positioned within housing 34*c* such that the indexing sleeve 46*c* must be driven by three discrete movement steps by passage of three balls to actuate the associated valve sleeve 40*c* and catching sleeve 41*c*.

Accordingly, an initial ball dropped through the complete system will sequentially engage the indexing sleeves 46*c*, 46*b*, 46*a* of each tool 18*c*, 18*b*, 18*a* to move a discrete movement step, with only the valve sleeve 40*a* and catching sleeve 41*a* of the lowermost tool 18*a* being actuated. A second ball will move each indexing sleeve 46*c*, 46*b* a single discrete movement step, with only the valve sleeve 40*b* and catching sleeve 41*b* of tool 18*b* being actuated. A third ball may then actuate tool 18*c*. This arrangement may be used to accommodate a significant number of individual tools within a common system, for example between two and fifty, and even more if necessary.

Figure 9:
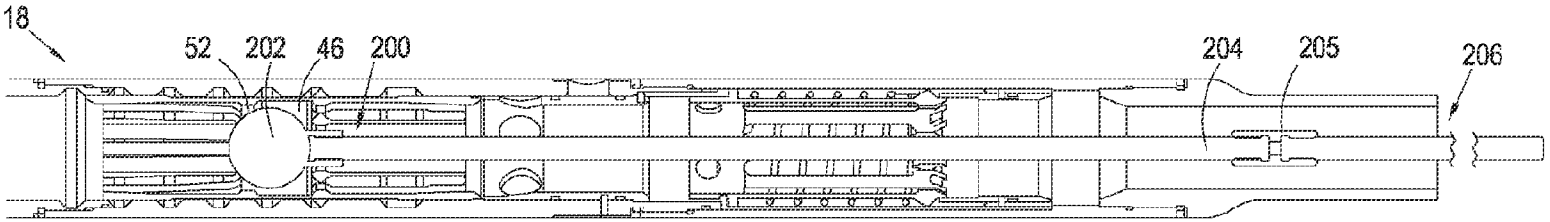
FIG. 9 illustrates the tool of FIG. 2 in combination with an inspection apparatus for use in determining the position of an indexing sleeve

In embodiments where multiple tools 18 are used in series within a common system it is important to ensure that the associated indexing sleeves 46 are positioned at the correct initial locations within the housing 34. Aspects of the present invention may permit inspection of the location of the indexing sleeves 46 prior to deploying the associated tools 18 into a wellbore. In this respect, an inspection apparatus 200 in accordance with an embodiment of aspects of the present invention is illustrated in FIG. 9, in use with a tool 18 first shown in FIG. 2.

The inspection apparatus 200 comprises an inspection object 202 provided in the form of a ball, which is similar to a ball used to drive the indexing sleeve 46. The inspection apparatus further comprises an elongate member 204, wherein the inspection object is mounted on one end of the elongate member 204. The elongate member may be provided in sections coupled together via a connector 205. The elongate member 204 includes one or more markings 206. In use, the inspection object 202 is inserted into the downhole end of the tool 18 until it contacts the first array of engagement members 52 of the indexing sleeve 46, with the elongate member 204 extending from the tool 18. In such an arrangement the markings 206 may provide a visible reference which permits a user to identify or determine the position of the indexing sleeve 46.

Figure 10:
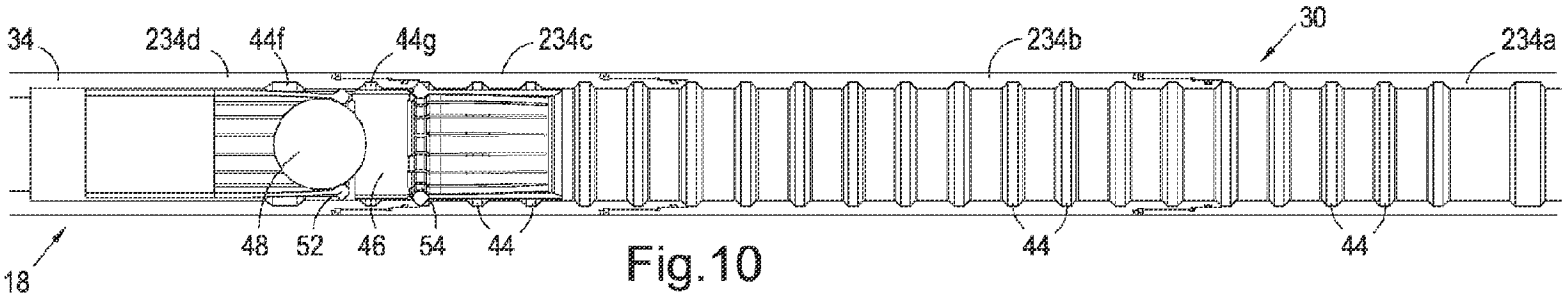
FIG. 10 is a cross-sectional view of a downhole tool in accordance with an embodiment of the present invention.

Reference is now made to FIG. 10 in which there is shown a modified embodiment of the downhole tool 18 first shown in FIG. 2. In particular, FIG. 10 provides a cross-sectional view of the modified tool 18 in the region of the actuator portion 30. In this modification the housing 34 includes a plurality of housing modules 234*a*, 234*b*, 234*c*, 234*d* which are secured together in end-to-end relation via conventional threaded connectors to define the complete housing 34. Each housing module 234*a*, 234*b*, 234*c*, 234*d* comprises a number of annular recesses 44 which collectively define the complete indexing profile of the tool 18. Such a modular arrangement of the tool 18 may minimise the requirement for bespoke systems, and may allow multiple specific situations to be accommodated with a basic inventory of individual modules 234*a*, 234*b*, 234*c*, 234*d*, for example containing five or ten recesses 44 each.

Figure 11:
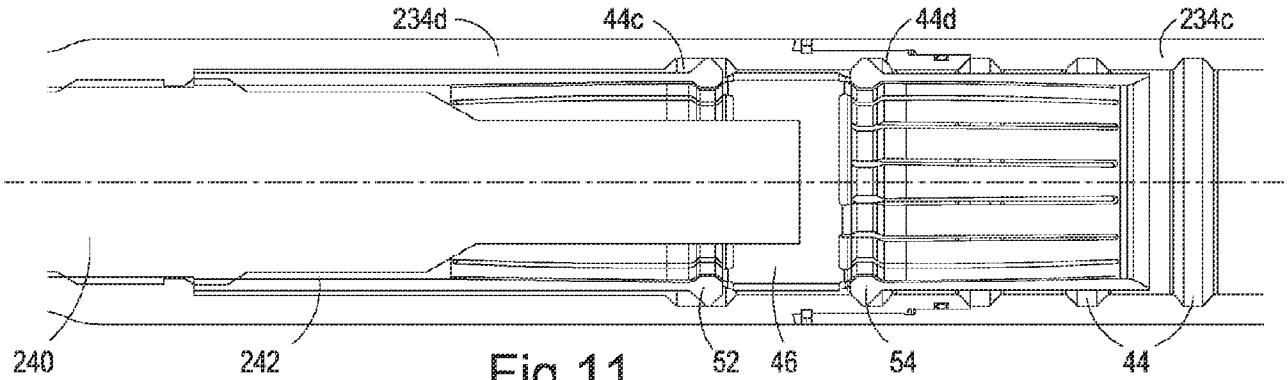
FIG. 11 is a cross-sectional view in the region of an indexing sleeve of a downhole tool in accordance with an embodiment of the present invention, and also provides a diagrammatic representation of a shifting tool for shifting the indexing sleeve.

In the modified embodiment of FIG. 10 the two uppermost annular recesses 44*f*, 44*g* are provided at an axial spacing which matches the axial spacing of the first and second arrays of engagement members 52, 54 provided on the indexing sleeve 46. Such an arrangement may permit the indexing sleeve to become disabled prior to actuation of the tool. For example, as illustrated in FIG. 11, a shifting tool 240 may be deployed into the tool to engage a shifting profile 242 on the indexing sleeve 46 to pull the indexing profile in an uphole direction until the engagement members 52, 54 are located within a corresponding recess 44*f*, 44*g*.

As described above in relation to FIG. 1, individual tools 18 may optionally include seals 26*a*, 26*b* to assist to focus fracturing fluid into the surrounding formation 14. Such seals may be provided in accordance with flow restrictors or packers as disclosed in UK patent application GB1112744.6 and/or PCT application no. PCT/GB2012/051788.

Figure 12:
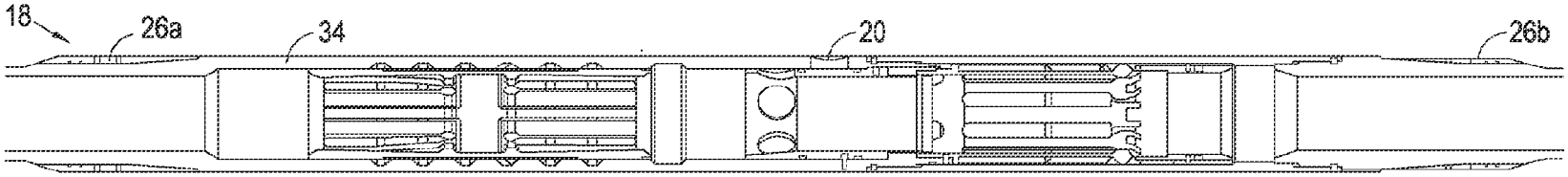
FIG. 12 is a cross-sectional view of a downhole tool in accordance with an embodiment of the present invention, wherein the tool includes associated sealing arrangements.

An exemplary embodiment of such seal members 26*a*, 26*b* is illustrated in FIG. 12, in which the seal members 26*a*, 26*b* are mounted, for example by slipping onto, the tool 18.

Figure 13:
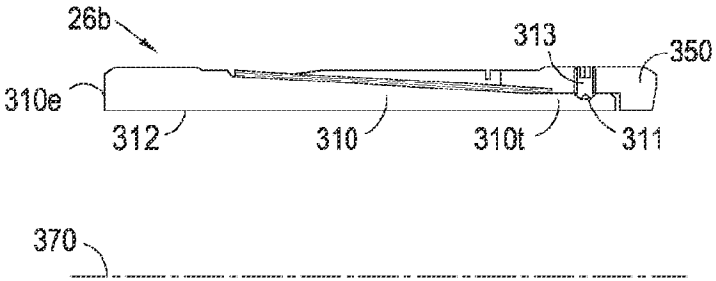
FIG. 13 is an enlarged view of a sealing arrangement of FIG. 12.
Figure 13:
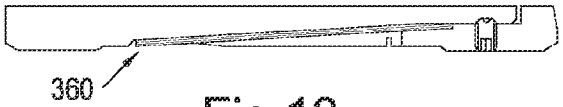

FIG. 13 shows seal 26*b* in a run-in configuration (it should be noted that seal 26*a* corresponds). The seal 26*b* is generally cylindrical, defining a central axis 370 and having a throughbore 380. The seal 26*b* is made up from several components: a mandrel 310; a restrictor assembly in the form of a swabbing assembly 360; and a seal backup 350, each of these components being arranged coaxially around the central axis 370.

The mandrel 310 is provided as a body or shaft for the seal 26*b* and is tapered towards one end 310*t*. At an opposing end, the mandrel 310 has an end face 310*e* perpendicular to the central axis 370. A cylindrical inner surface 312 of the mandrel 10 surrounds the throughbore 80 and enables the mandrel 310 to be slotted onto another tubular (not shown) as part of a tubing string. However, in some embodiments the mandrel 310 may form part of the housing 34 of the tool 18.

Towards the tapered end 310*t*, an outer surface of the mandrel 310 has a cylindrical annular groove 311 formed therein, for receiving an end of a set screw 313 that secures the swabbing assembly 360 to the mandrel 310.

Figure 14A:
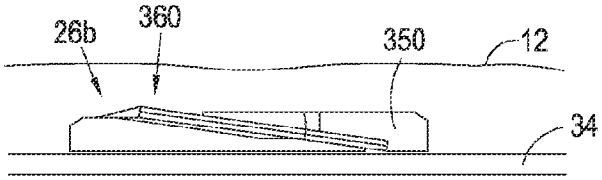
FIGS. 14A and 14B show a seal arrangement of FIG. 12 in a run-in and set configuration, respectively.

Once the seal 26*b* has been correctly assembled, it occupies the relatively compact run-in configuration shown in FIGS. 12 and 13 (or schematically in FIG. 14A).

Figure 14B:
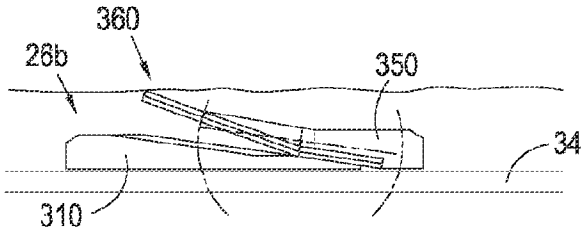

When flow is initiated through ports 20 of the tool 18, the seal 26*b* (and also 26*a*) will be actuated. Initially fluid flow over the seal 26*b* causes a frictional drag over the swabbing assembly 360. The frictional effect of a sufficiently high rate of fluid flow above a threshold drags the swabbing assembly 360 outwardly in the direction of flow. Flow may then act on the underside of the swabbing assembly 360 and further urge this radially outwardly until engagement with the wall of the borehole 12, as shown in FIG. 14B. By arranging the seals 26*a*, 26*b* facing each other, the flow from the ports 20 of the tool 18 may act to actuate both seals 26*a*, 26*b*.

Reference is now made to FIGS. 15A to 15D in which there is shown a tool portion 432 of a downhole tool 418 having a coupling arrangement according to an embodiment of the present invention.

The downhole tool 418 and tool portion 432 are similar to the downhole tool 18 and tool portion 32 described above and like features of the downhole tool 418 and tool portion 432 are represented by like numerals incremented by 400.

The downhole tool portion 432 comprises a housing 434 having a number of lateral fluid ports 420 (two lateral fluid ports 420 are shown), a valve sleeve 440 slidably disposed within the housing 434 and also having a number of lateral fluid ports 484 (two lateral fluid ports 484 are shown), a catching sleeve 441 slidably disposed within the housing 434 and a coupling arrangement C.

Figure 15A:
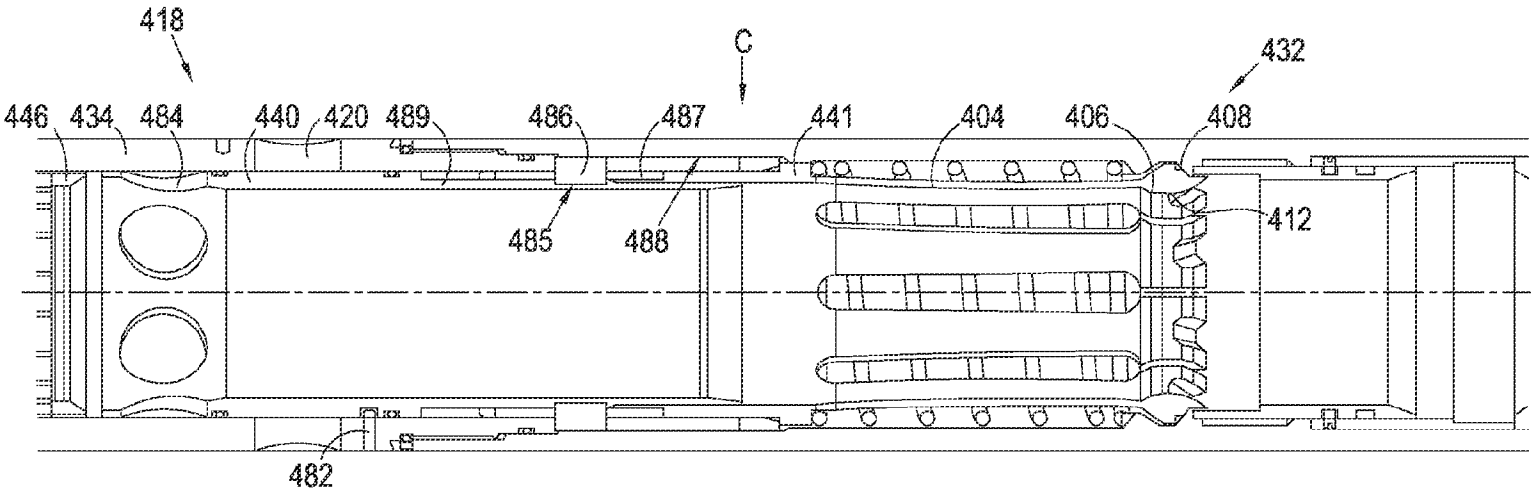
FIGS. 15A to 15D are cross-sectional views of a portion of a downhole tool in accordance with a further embodiment of the present invention, shown in different stages of operation.

In use, the valve sleeve 440 is actuatable between a closed configuration in which fluid flow through the ports 420, 484 is prevented and an open configuration in which fluid flow is permitted while the catching sleeve 441 is actuatable by the valve sleeve 440 between a free configuration (as shown in FIG. 15A) and a catching configuration (as shown in FIG.

15B) suitable for catching an object such as a ball. Rotational movement of the valve sleeve 440 is transmitted to the catching sleeve 441 and the housing 434 via the coupling arrangement C and provides a rotational lock and/or ensures rotational alignment of the valve sleeve 440, catching sleeve 441 and housing 434 while also permitting relative axial movement between the valve sleeve 440, the catching sleeve 441 and the housing 434.

The coupling arrangement C in the illustrated embodiment comprises radially extending keys 486 disposed in recesses 485 provided in a stepped outer surface portion 489 of the valve sleeve 441, the keys 486 extending radially from the valve sleeve 441 and through corresponding slots 487 in the catching sleeve 441 and into a plurality of recesses 488 provided in an inner wall surface of the housing 434.

In use, the coupling arrangement C provides a rotary coupling between the valve sleeve 440, the catching sleeve 441 and the housing 434 since the interaction between the keys 486, slots 487 and recesses 488 prevents relative rotation between the valve sleeve 440, the catching sleeve 441 and the housing 434, maintaining the sleeve ports 484 in the correct circumferential alignment relative to the ports 420 in the housing 434. Since the keys 486 can translate axially in the slots 487 of the catching sleeve 441 and the recesses 488 of the housing 434, relative axial movement of the valve sleeve 440 and the catching sleeve 441 relative to the housing 434 is permitted, the maximum stroke or length of axial travel permitted substantially defined by the length of the housing recesses 488.

The tool portion 432 is illustrated in an initial configuration in FIG. 15A, with the valve sleeve 440 in a closed position and the catching sleeve 441 in a free configuration. In this position, the valve sleeve 440 is initially axially secured relative to the housing 434 via a number of shear screws 482 (one screw 482 is shown). The keys 486 are disposed at the upper end of the housing recesses 488 and at a position intermediate the ends of the slots 487 of the catching sleeve 441.

Figure 15B:
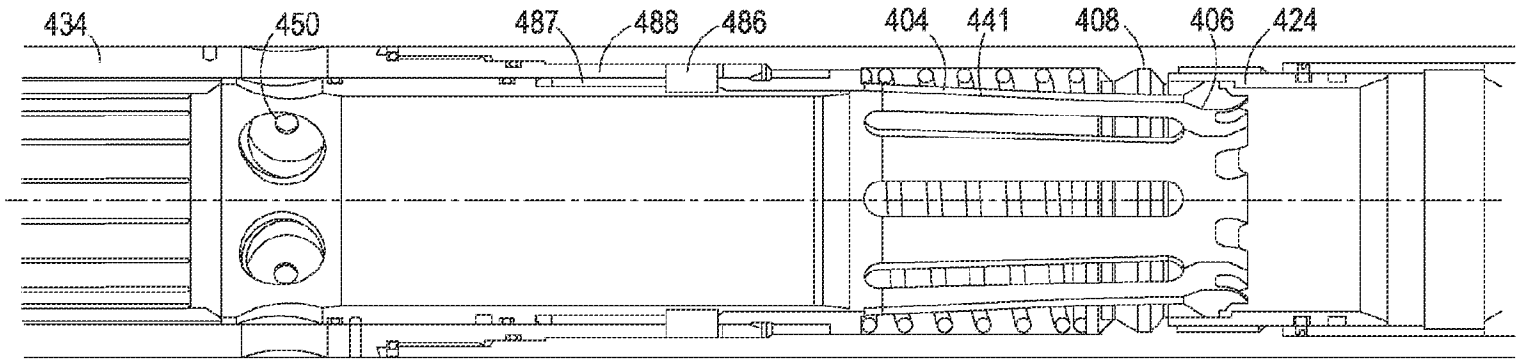

In order to move the valve sleeve 440 towards its open position, that is from the position shown in FIG. 15A to the position shown in FIG. 15B, an axial actuation force is applied to the valve sleeve 440 by an indexing sleeve 446 to shear the screws 482 and substantially align the sleeve ports 484 with the ports 420 in the housing 434 in a similar manner to that described above.

As can be seen from FIGS. 15A to 15D, the slots 487 of the catching sleeve 441 and the recesses 488 of the housing 434 partially axially overlap, such that axial movement of the valve sleeve 441 does not immediately result in axial movement of the catching sleeve 441 from the free configuration shown in FIG. 15A to the catching configuration shown in FIG. 15B; axial movement of the valve sleeve 440 and catching sleeve 441 occurring when the keys 486 impinge on the lower end of the slots 487 of the catching sleeve 441.

It is noted that in the position shown in FIG. 15B, the catching sleeve 441 has been moved to its catching configuration but the ports 420, 484 are not fully aligned and the keys 486 are not yet in abutment with the lower end of the housing recesses 488.

As with the catching sleeve 41 described above, the catching sleeve 441 includes a plurality of longitudinally extending collet fingers 404, wherein each collet finger 404 supports a seat member 406 on a distal end thereof. When the seat members 406 are positioned radially outwardly, as shown in FIG. 15A, an object such as a ball may pass without any contact or with minimal engagement with the seat members 406. However, when the catching sleeve 441 is moved axially in a downhole direction, which will be caused by axial movement of the valve sleeve 440 towards its open position (to the right as shown in the figures), the seat members 406 will be displaced from an annular recess 408 in the housing 434 and engaged with a release sleeve 424, and thus deflected radially inwardly, and presented in a position to be engaged by a ball. Thus, when the seat members 406 are positioned radially inwardly with the catching sleeve 441 configured in its catching configuration as shown in FIG. 15B, a ball may engage and seat against the seat members 406 and thus be caught within the catching sleeve 441.

Each seat member 406 includes an uphole seat surface 412 configured to be engaged by a ball when travelling in a downhole direction. The uphole seat surfaces 412 may be configured to provide a substantially complete or continuous engagement with a ball, permitting a ball to be sealingly engaged within the catching member 441. Such sealing of a ball within the catching sleeve 441 permits the catching sleeve 441 to be actuated, for example by a pressure differential established between uphole and downhole sides of the catching sleeve 441, to move the tool 418 from the position shown in FIG. 15B to the position shown in FIG. 15C In the position shown in FIG. 15C, the keys 486 abut the lower end of the housing recesses 488 and the ports 420 are now fully open. By virtue of the coupling arrangement C, the catching sleeve 441 is free to move axially relative to the valve sleeve 440 under the influence of the pressure differential created across the ball to actuate the release sleeve 424 of the downhole tool 418 without disturbing the condition of the ports 420.

Figure 15C:
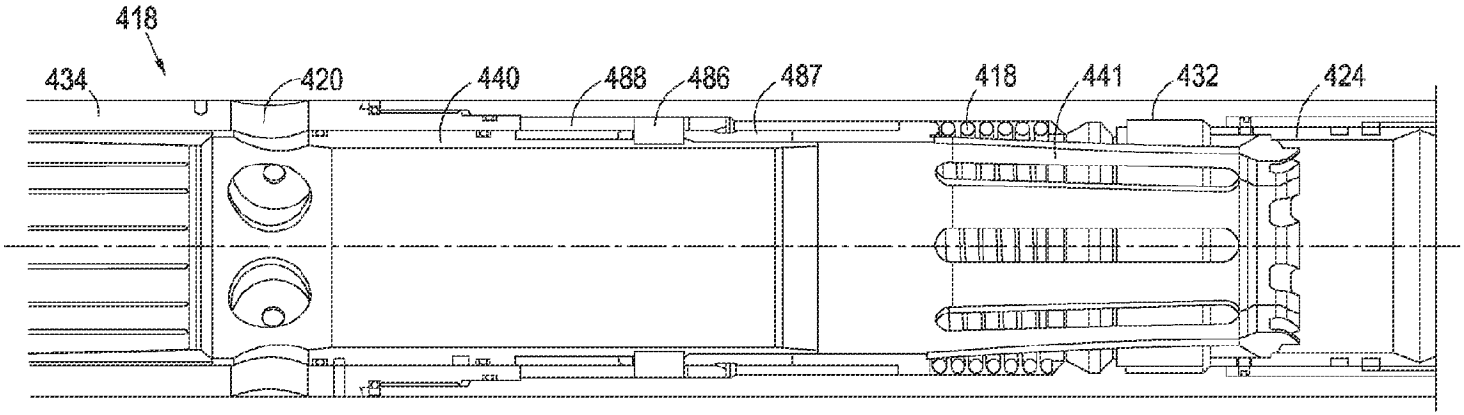
Figure 15D:
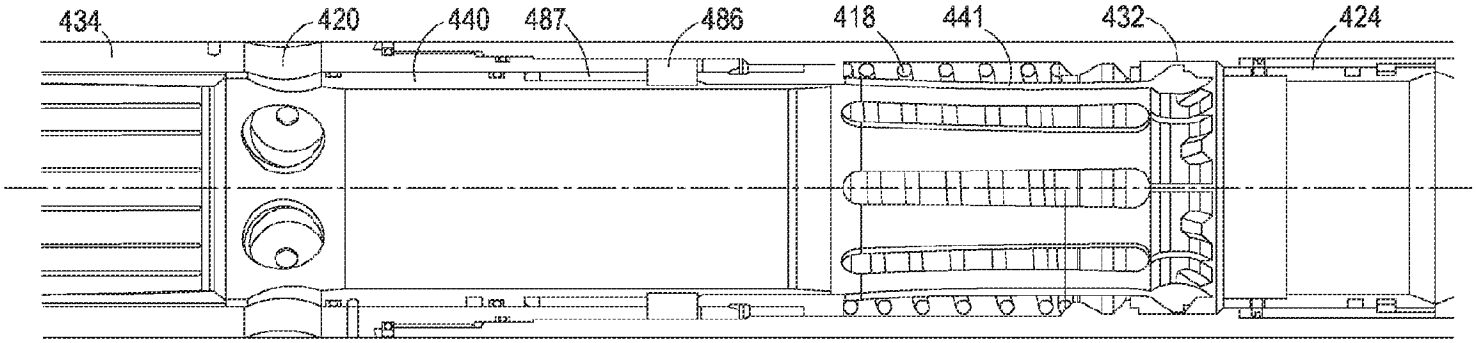

The housing 434 defines or includes a release recess 432 which is initially covered by the release sleeve 424. However, when a suitable axial load is applied on the release sleeve 424 by the catching sleeve 441, the release sleeve 424 is moved axially to uncover the release recess 432, as shown in FIG. 15C. In the position shown in FIG. 15C, the keys 486 abut the lower end of the slots 487 and the housing recesses 488.

With reference in particular to FIGS. 15B and 15C, it can be seen that movement of the tool 418 from the position shown in FIG. 15B to the position shown in FIG. 15C compresses a coil spring 418 interposed between the catching sleeve 441 and the housing 434. The coil spring 418 is biased to move the catching sleeve 441 in an uphole direction (to the left as shown in the figures) and under the influence of the coil spring 418 the catching sleeve 441 moves from the position shown in FIG. 15C to the position shown in FIG. 15D, such that the seat members 408 are received in the uncovered release recess 432. In this position, the catching sleeve 441 is configured in a release configuration which permits the ball to be released.

Reference is now made to FIGS. 16A to 16E in which there is shown a tool portion 532 of a downhole tool 518 having a coupling arrangement C' according to another embodiment of the present invention. In this embodiment, the tool 518 provides a positive indication at surface that an activation event, for example opening of ports 520, has occurred.

The downhole tool 518 and tool portion 532 are similar to the downhole tools 18, 418 and tool portions 32, 432 described above and like features of the downhole tool 518 and tool portion 532 are represented by like numerals incremented by 500.

Figure 16A:
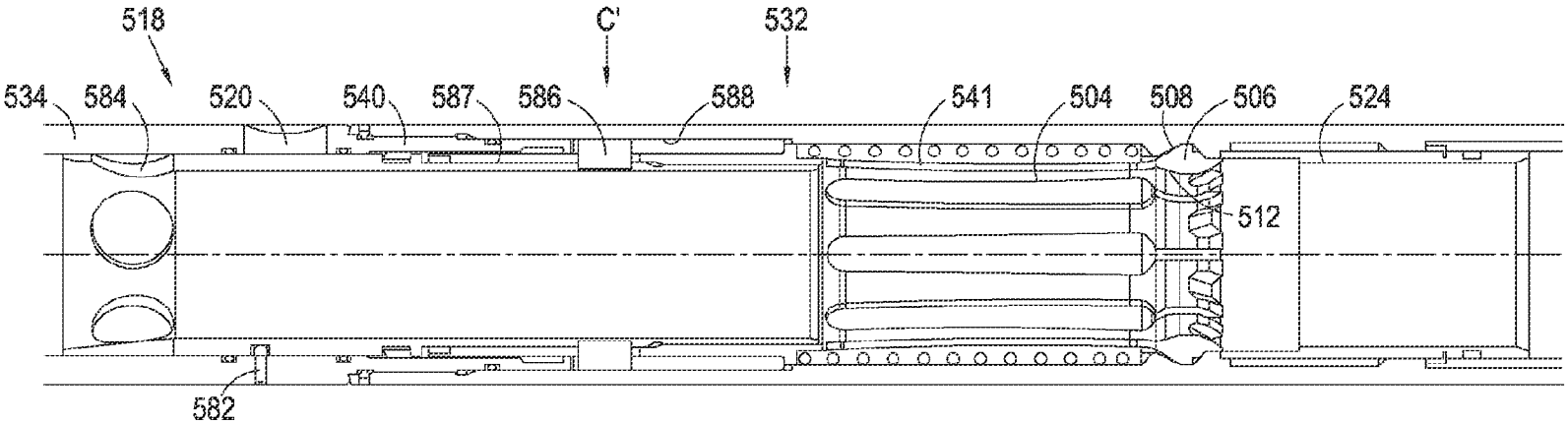
FIGS. 16A to 16E are cross-sectional views of a portion of a downhole tool in accordance with a further embodiment of the present invention, shown in different stages of operation.

As shown in FIG. 16A, the downhole tool portion 532 comprises a housing 534 having a number of lateral fluid ports 520 (two lateral fluid ports 520 are shown), a valve sleeve 540 slidably disposed within the housing 534 and also having a number of lateral fluid ports 584 (two lateral fluid ports 584 are shown), a catching sleeve 541 slidably disposed within the housing 534 and a coupling arrangement C'.

As in the coupling arrangement C, the coupling arrangement C' provides a rotary coupling between the valve sleeve 540, the catching sleeve 541 and the housing 534 by virtue of the interaction between keys 586, slots 587 and recesses 588 while permitting relative axial movement of the valve sleeve 540 and the catching sleeve 541 relative to the housing 534.

The tool portion 532 is illustrated in an initial configuration in FIG. 16A, with valve sleeve 540 in a closed position and catching sleeve 541 in a free configuration.

In this position, the valve sleeve 540 is initially axially secured relative to housing 534 via a number of shear screws 582 (one screw 582 is shown) and the keys 586 are disposed adjacent an upper end of the housing recesses 588 and at a position adjacent to the lower end of the slots 587 of the catching sleeve 541.

Figure 16B:
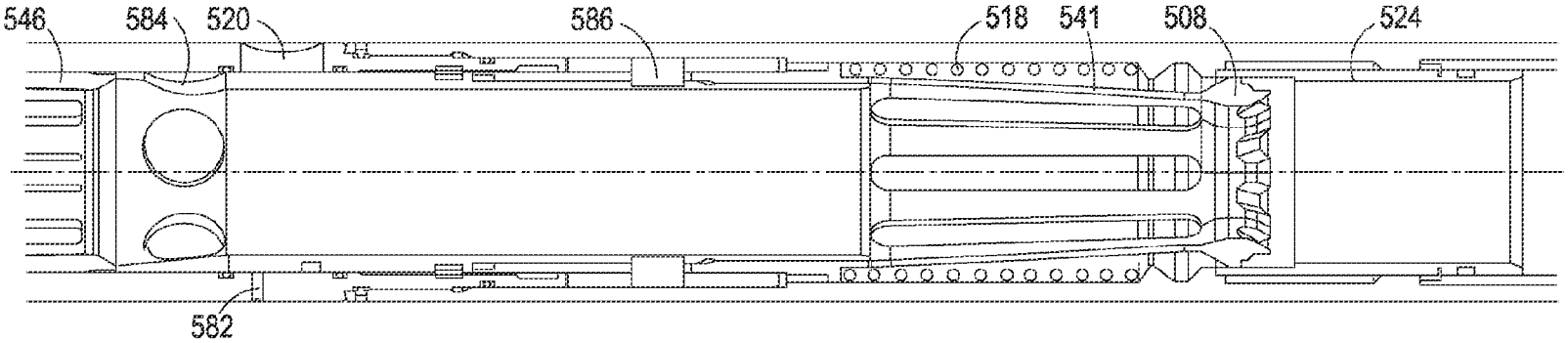

In order to move the catching sleeve 541 from its free configuration shown in FIG. 16A to its catching configuration shown in FIG. 16B, an axial actuation force is applied to the valve sleeve 540 by an indexing sleeve 546 to shear the screws 582, permitting the valve sleeve 540 to move in a downhole direction (to the right as shown in the figures). In this embodiment, when the catching sleeve 541 is moved by the valve sleeve 540 from the position shown in FIG. 16A to the position shown in FIG. 16B, the valve sleeve 540 is not moved to a fully open configuration but to an intermediate position in which the ports 520 are still closed (ports 584 and 520 are not aligned).

As with the catching sleeve 441 described above, the catching sleeve 541 includes a plurality of longitudinally extending collet fingers 504, wherein each collet finger 504 supports a seat member 506 on a distal end thereof. When the seat members 506 are positioned radially outwardly, as shown in FIG. 16A, an object such as a ball may pass without any contact or with minimal engagement with the seat members 506. However, when the catching sleeve 541 is moved axially in a downhole direction, which will be caused by axial movement of the valve sleeve 540 (to the right as shown in the figures), the seat members 506 will be displaced from an annular recess 508 in the housing 534 and engaged with a release sleeve 524, and thus deflected radially inwardly, and presented in a position to be engaged by a ball. Thus, when the seat members 506 are positioned radially inwardly with the catching sleeve 541 configured in its catching configuration as shown in FIG. 16B, a ball may engage and seat against the seat members 506 and thus be caught within the catching sleeve 541.

Each seat member 506 includes an uphole seat surface 512 configured to be engaged by a ball when travelling in a downhole direction. The uphole seat surfaces 512 may be configured to provide a substantially complete or continuous engagement with a ball, permitting a ball to be sealingly engaged within the catching member 541. Such sealing of a ball within the catching sleeve 541 permits the catching sleeve 541 to be actuated, for example by a pressure differential established between uphole and downhole sides of the catching sleeve 541, to move the tool 518 from the position shown in FIG. 16B to the position shown in FIG. 16C.

Figure 16C:
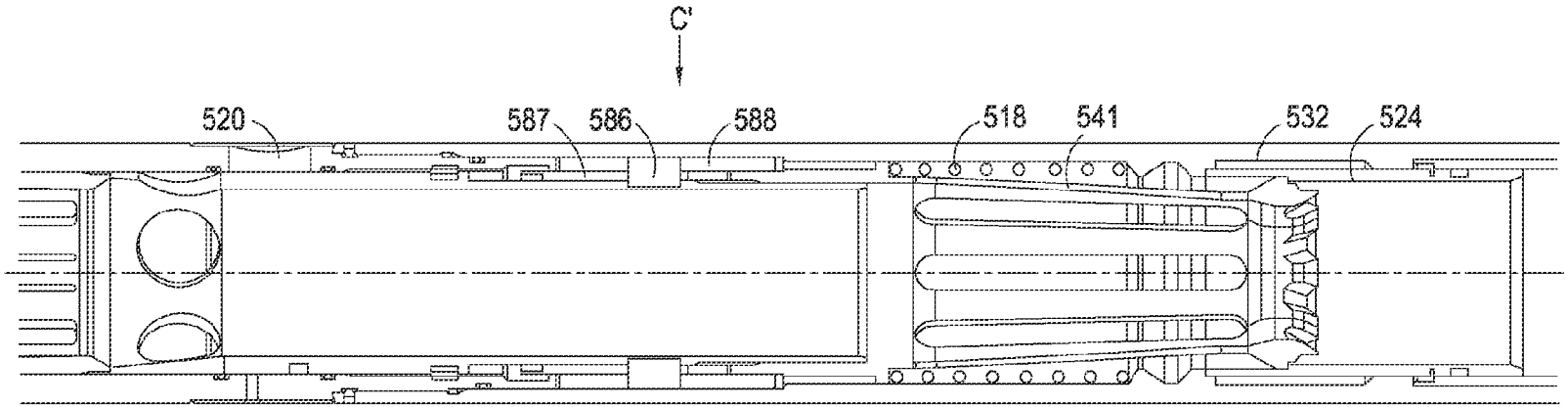

In the position shown in FIG. 16C, the keys 586 are at an intermediate position in the housing recesses 588 and the ports 520 remain closed. By virtue of the coupling arrangement C', the catching sleeve 541 is free to move axially relative to the valve sleeve 540 under the influence of the pressure differential created across the ball to actuate the release sleeve 524 of the downhole tool 518 without disturbing the condition of the ports 520.

The housing 534 defines or includes a release recess 532 which is initially covered by the release sleeve 524. However, when a suitable axial load is applied on the release sleeve 524 by the catching sleeve 541, the release sleeve 524 is moved axially to uncover the release recess 532, from the position shown in FIG. 16C to the position shown in FIG. 16D. In this position, the keys 586 abut the upper end of the slots 587 and are disposed adjacent the lower end of the recesses 588.

Figure 16D:
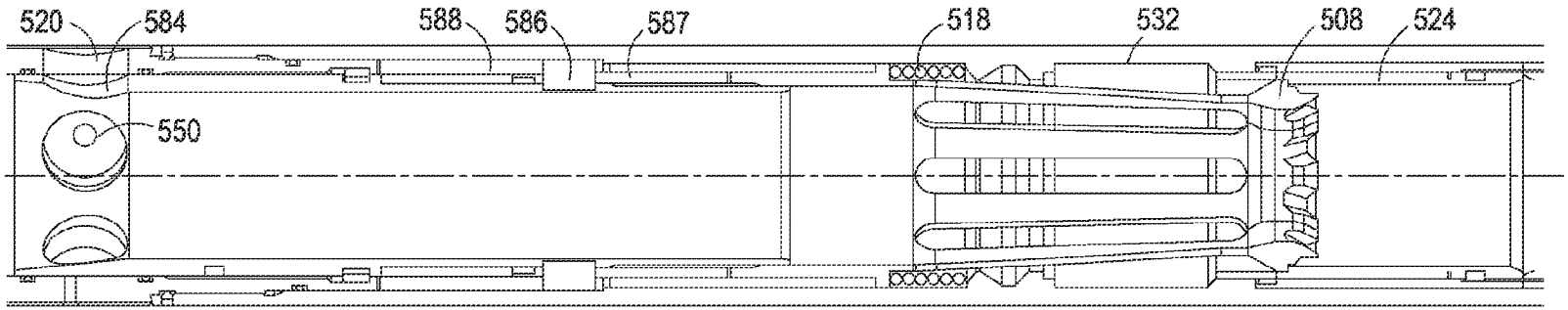
Figure 16E:
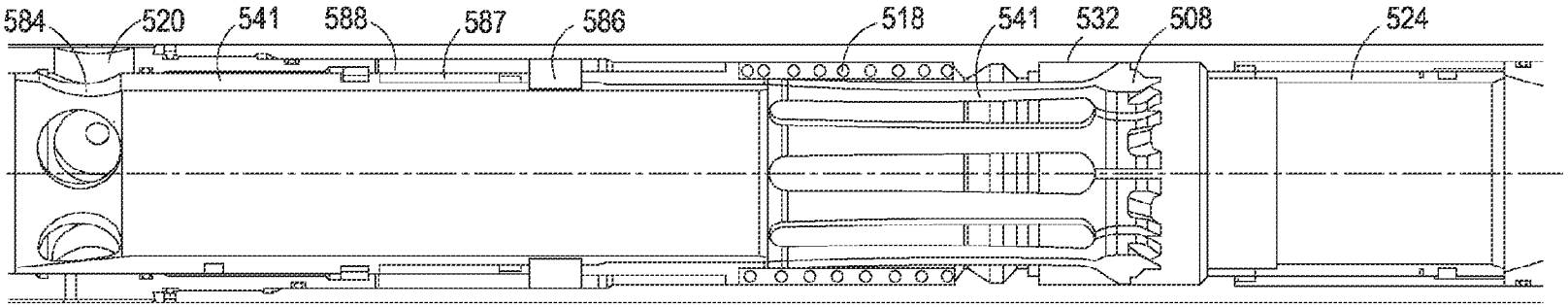

As in previous embodiments, movement of the tool 518 from the position shown in FIG. 16C to the position shown in FIG. 16D compresses a coil spring 518 interposed between the catching sleeve 441 and the housing 434. The coil spring 518 is biased to move the catching sleeve 541 in an uphole direction (to the left as shown in the figures) and under the influence of the coil spring 518 the catching sleeve 541 moves from the position shown in FIG. 16D to the position shown in FIG. 15E, such that the seat members 508 of the catching sleeve 541 are received in the uncovered release recess 532. In this position, the catching sleeve 541 is configured in a release configuration which permits the ball to be released and the valve sleeve 541 has been moved to the open configuration (ports 520 and 584 are fully aligned). With the ports 520 open, a pressure drop detectable at surface provides a positive indication that the ports 520 have been opened correctly. In this position, the keys 586 are disposed adjacent the bottom of the recesses 588 and the slots 587.

As in other embodiments, the tools 418, 518 may further include an optional choke 450, 550, the choke 450, 550 associated with the fluid port 420, 520 to choke flow through the fluid port 420, 520 once opened as described above.

Figure 17A:
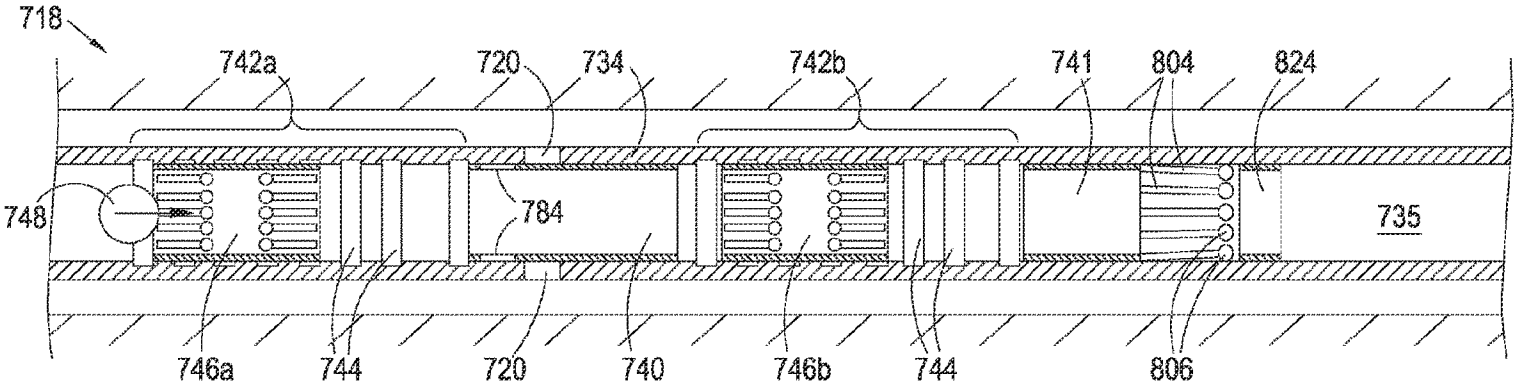
FIGS. 17A and 17B are schematic illustrations of a downhole system in accordance with an embodiment of the present invention, shown in different stages of operation.

In the various embodiments described above, downhole tools are provided with a catching arrangement which is operated to move between free and catching configurations by an associated valve member. However, in other embodiments such a catching arrangement may be operated independently of a valve member. Such an arrangement is illustrated in FIG. 17A, reference to which is now made. The embodiment shown in FIG. 17A is similar in many respects to the embodiment first shown in FIG. 2, and as such like features share like reference numerals, incremented by 700.

The downhole tool, generally identified by reference numeral 718, includes a tool housing 734 which includes a plurality of ports 720 through a wall thereof. The tool 718 includes a valve sleeve 740 which includes a plurality of ports 784, wherein the sleeve 740 is illustrated in FIG. 17A in a closed position, such that the ports 720 in the housing 734 are initially closed.

The housing 734 defines first and second indexing profiles 742*a*, 742*b*, which each include a plurality of annular recesses 744. A first indexing sleeve 746*a* is arranged within the housing 734 relative to the first indexing profile 742*a* and uphole of the valve sleeve 740. As will be described in more detail below, the first indexing sleeve 746*a* is configured to operate the valve sleeve 740 to be moved to an open position following the passage of a predetermined number of balls 748.

The tool 718 further includes a catching sleeve 741, which includes a plurality of fingers 804 and associated seat member 806, wherein the catching sleeve 741 is arranged adjacent a release sleeve 824, in a similar manner as defined above. In the arrangement shown in FIG. 17A, the catching sleeve 741 is positioned within a free configuration, such that any balls are free to pass therethrough, wherein the catching sleeve 741 is capable of being reconfigured into a catching configuration in which any passing balls may become caught. The precise form and operation of the catching sleeve 741 is similar to that described in connection with other embodiments, and as such no further detailed description will be given.

A second indexing sleeve 746*b* is arranged within the housing 734 relative to the second indexing profile 742*b* and uphole of the catching sleeve 741. As will be described in more detail below, the second indexing sleeve 746*b* is configured to operate the catching sleeve 741 to move to its catching configuration following the passage of a number of balls 748.

Figure 17B:
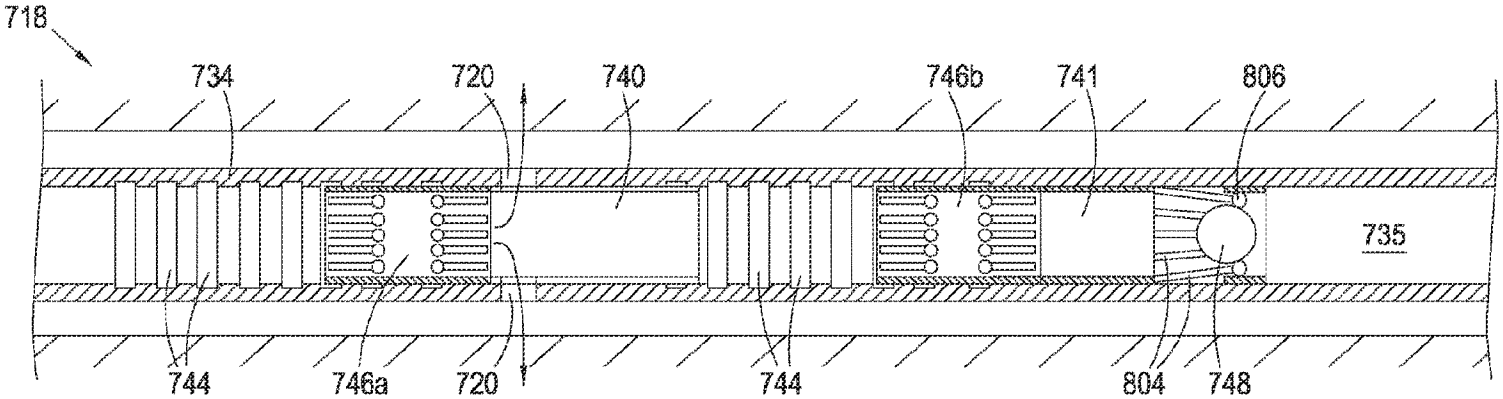

In the arrangement shown in FIG. 17A, each indexing sleeve 746*a*, 746*b* is initially arranged to be moved in the same number of discrete movement steps before reaching an actuation site. Thus, as illustrated in FIG. 17B, when a predetermined number of balls 748 have passed, the first indexing sleeve 746*a* will have moved to actuate and move the valve sleeve 740 to open the fluid ports 720, and the second indexing sleeve 746*b* will have moved to actuate and move the catching sleeve 741 to radially collapse the seat members 806 to permit the ball 748 to become caught. The ball 748 may then function to block the central bore 735 of the tool 718, allowing substantially all flow to be diverted through the open ports 720.

Figure 18A:
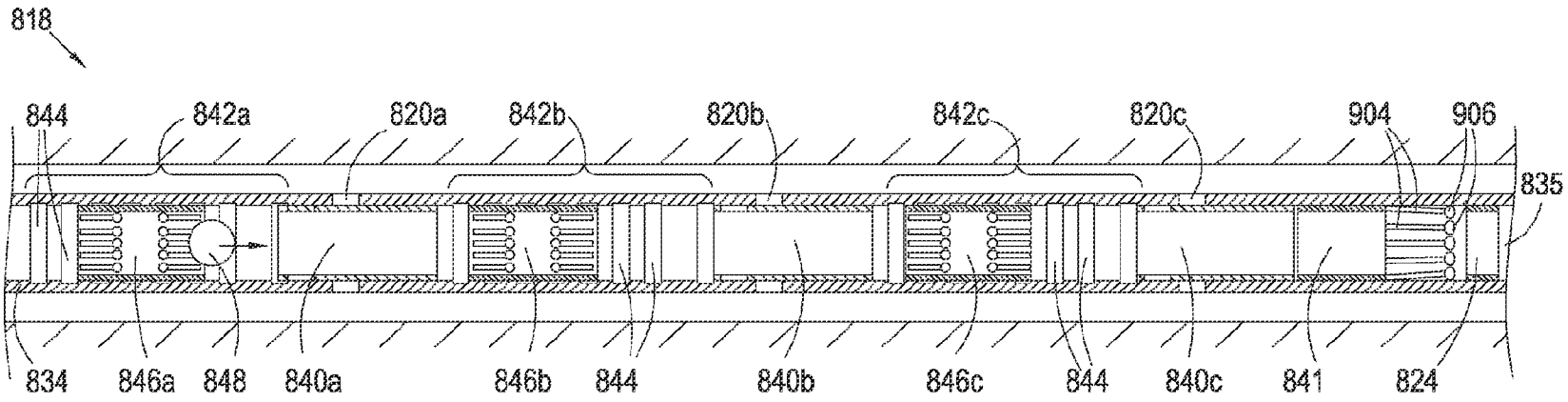
FIGS. 18A and 18B are schematic illustrations of a downhole system in accordance with an alternative embodiment of the present invention, shown in different stages of operation.
Figure 18B:
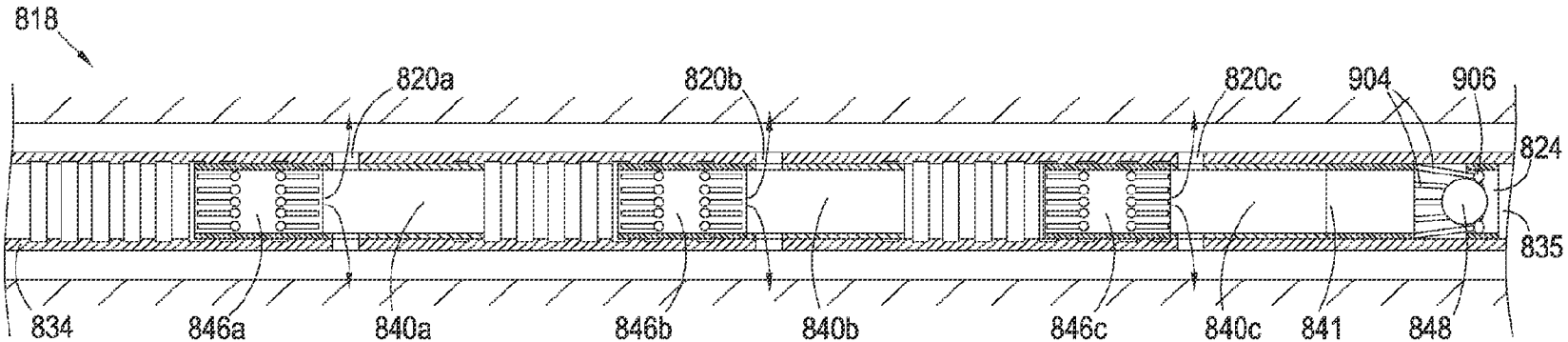

Reference is now made to FIGS. 18A and 18B which show different stages of operation of a downhole tool, generally identified by reference numeral 818, in accordance with an alternative embodiment of the present invention. Tool 818 is similar in many respects to tool 18 shown in FIG. 2, and as such like features share like reference numerals.

Tool 818 includes a housing 834 which includes first, second and third sets of ports 820*a*, 820*b*, 820*c* through a wall thereof. The tool 818 includes first, second and third valve sleeves 740 each arranged within the housing 834, and each positioned relative to a respective set of ports 820*a*, 820*b*, 820*c*, wherein the sleeves 840*a*, 840*b*, 840*c* are illustrated in FIG. 18A in a closed position, such that the ports 820*a*, 820*b*, 820*c* in the housing 834 are initially closed.

The housing 834 defines first, second and third indexing profiles 842*a*, 842*b*, 842*c* which each include a plurality of annular recesses 844. A first indexing sleeve 846*a* is arranged within the housing 834 relative to the first indexing profile 842*a* and uphole of the first valve sleeve 840*a*. A second indexing sleeve 846*b* is arranged within the housing 834 relative to the second indexing profile 842*b* and uphole of the second valve sleeve 840*b*. Similarly, a third valve sleeve 840*c* is arranged within the housing 834 relative to the third indexing profile 842*c* and uphole of the third valve sleeve 840*b*. As will be described in more detail below, the indexing sleeves 846*a*, 846*b*, 846*c* are each configured to operate the respective valve sleeve 840*a*, 840*b*, 840*c* to be moved to an open position following the passage of a predetermined number of balls 848.

The tool 818 includes a single catching sleeve 841 located downhole of the third valve sleeve 840*c*, wherein the catching sleeve 841 includes a plurality of fingers 904 and associated seat members 906, and is arranged adjacent a release sleeve 924, in a similar manner as defined above. In the arrangement shown in FIG. 18A, the catching sleeve 841 is positioned within a free configuration, such that any balls are free to pass therethrough, wherein the catching sleeve 841 is capable of being reconfigured into a catching configuration in which any passing balls may become caught. The precise form and operation of the catching sleeve 841 is similar to that described in connection with other embodiments, and as such no further detailed description will be given.

In use, each passing ball 848 will cause each indexing sleeve 846*a*, 846*b*, 846*c* to progress in discrete steps of movement towards their associated valve sleeves 840*a*, 840*b*, 840*c*. When a predetermined number of objects have passed the valve sleeves 840*a*, 840*b*, 840*c* will be actuated to move towards their open positions to open the respective ports 820*a*, 820*b*, 820*c*, as illustrated in FIG. 18B. Further, actuation of the third valve sleeve 840*c* will cause the catching sleeve 841 to become configured into its catching configuration, such that a passing object 848 becomes caught. In such an arrangement the central bore 835 may become blocked, such that substantially all flow is diverted through the open ports 820*a*, 820*b*, 820*c*.

Although the embodiment shown in FIG. 18A has three valve members, it will be appreciated that any number may be used, for example two or more.

In the embodiments described above the present invention provides for actuation of either a valve sleeve and/or a catching sleeve. However, it will be appreciated that in alternative embodiments features of the present invention may be utilised to operate any type of downhole tool, in any downhole operation and in any required sequence. An example of one such alternative embodiment is schematically illustrated in FIGS. 19A to 19D, which show the sequential operation of a downhole system, generally identified by reference numeral 900.

Figure 19A:
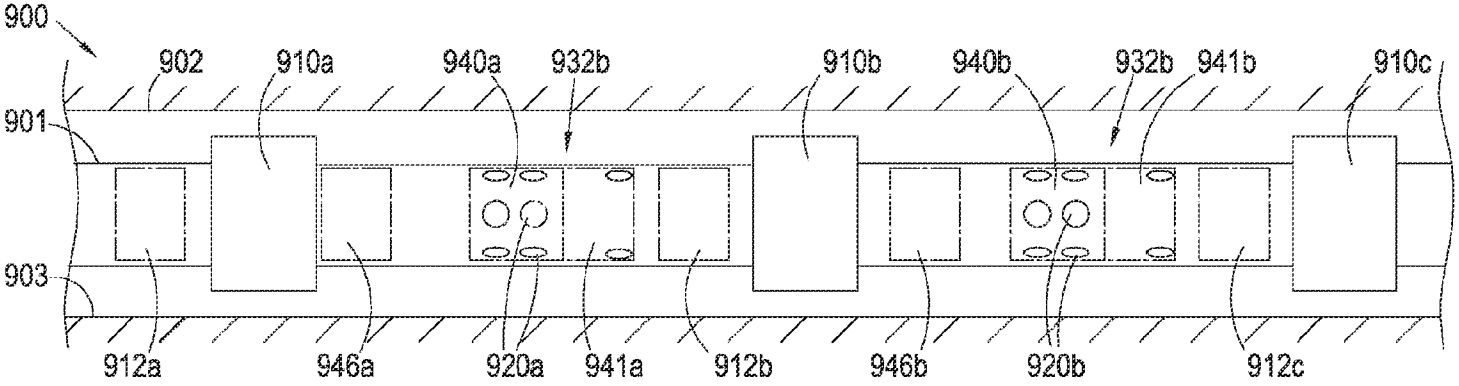
FIGS. 19A to 19D are schematic illustrations of a downhole system in accordance with a further embodiment of the present invention, shown in different stages of operation.

Referring initially to FIG. 19A, the downhole system 900 includes a tubing string 901 which is shown positioned within a wellbore 902. The tubing string 901 includes a number of tools and tool components along its length.

More specifically, the tubing string 901 includes first, second and third axially arranged packers 910*a*, 910*b*, 910*c*. Each packer 910*a*, 910*b*, 910*c* includes an associated actuator, which each includes an indexing sleeve 912*a*, 912*b*, 912*c*. The indexing sleeves 912*a*, 912*b*, 912*c* are provided in a similar form to indexing sleeve 46 first shown in FIG. 2, and as such no further detailed description will be give. Each indexing sleeve 912*a*, 912*b*, 912*c* is arranged within the tubing string 901 to cooperate with respective indexing profiles (not illustrated) on the inner surface of the tubing string 901, to be moved in a number of discrete steps of movement towards an actuation site upon passage of a corresponding number of objects, such as balls. Upon reaching the respective actuation sites, the indexing sleeves 912*a*, 912*b*, 912*c* actuate the respective packers 910*a*, 910*b*, 910*c*, as will be described in more detail below.

A first valve assembly 932*a* is positioned between the first and second packers 910*a*, 910*b*, and a second valve assembly 932*b* is positioned between the second and third packers 910*b*, 910*c*. Each valve assembly 932*a*, 932*b* is configured in the same manner as tool portion 32 first shown in FIG. 2, and as such no further detailed description will be given. Thus, each valve assembly 932*a*, 932*b* includes a valve member 940*a*, 940*b* initially arranged in FIG. 19A to block fluid ports 920*a*, 920*b* through a wall of the tubing string 901. Further, each valve assembly 932*a*, 932*b* includes a catching sleeve 941*a*, 941*b* which is configurable from a free configuration in which an object may freely pass therethrough, to a catching configuration in which an object may be caught.

Each valve assembly 932*a*, 932*b* includes an associated actuator, which each includes an indexing sleeve 946*a*, 946*b*. The indexing sleeves 946*a*, 946*b* are provided in a similar form to indexing sleeve 46 first shown in FIG. 2, and as such no further detailed description will be give. Each indexing sleeve 946*a*, 946*b* is arranged within the tubing string 901 to cooperate with respective indexing profiles (not illustrated) on the inner surface of the tubing string 901, to be moved in a number of discrete steps of movement towards an actuation site upon passage of a corresponding number of objects, such as balls. Upon reaching the respective actuation sites, the indexing sleeves 946*a*, 946*b* actuate the respective valve assemblies 932*a*, 932*b* to move the valve members 940*a*, 940*b* to open the respective ports 920*a*, 920*b*, and to reconfigured the respective catching sleeves 941*a*, 941*b* to their catching configurations.

In a similar manner to the embodiments described above, the required number of passing objects to cause the various indexing sleeves 912*a*, 912*b*, 912*c*, 946*a*, 946*b* to reach their respective actuation sites is determined by the initial positioning of said indexing sleeves. In this respect, a significant advantage of the present invention is the ability to provide an operator with significant flexibility in terms of setting any desired sequence of operation of downhole tools. However, in the present exemplary embodiments, the various indexing sleeves 912*a*, 912*b*, 912*c*, 946*a*, 946*b* are initially arranged such that the packers 910*a*, 910*b* are caused to be set upon passage of a first object, the second valve assembly 932*b* is actuated upon passage of a second object, and the first valve assembly 932*a* is actuated upon passage of a third object. Such operation will now be described with reference to FIGS. 19B, 19C and 19D.

Figure 19B:
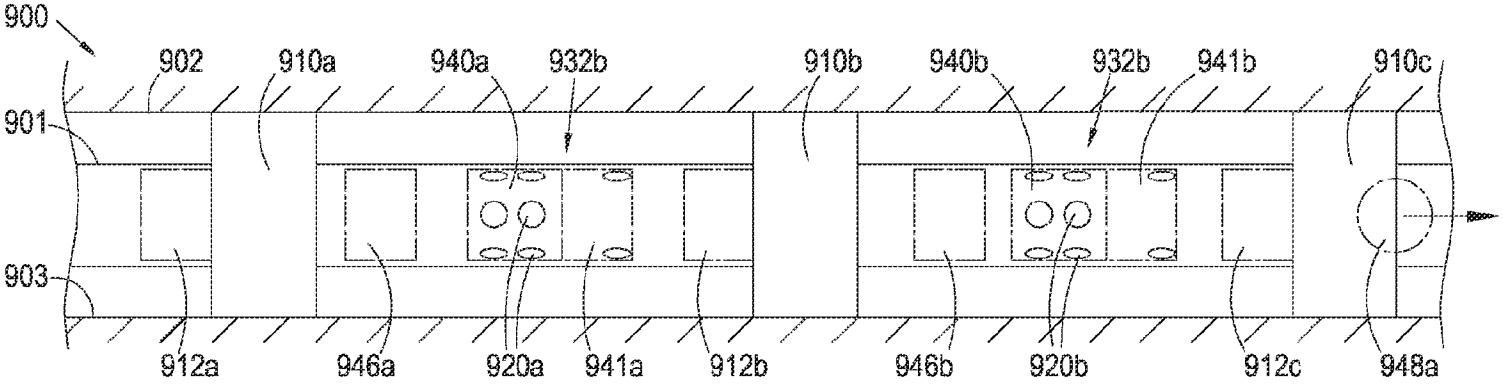

Referring first to FIG. 19B, a first object, specifically a first ball 948*a* is passed along the tubing string 901, moving each indexing sleeve 912*a*, 912*b*, 912*c*, 946*a*, 946*b* a single discrete step. This single discrete step is sufficient to cause the indexing sleeves 912*a*, 912*b*, 912*c* to actuate the respective packers 910*a*, 910*b*, 910*c*, to establish sealing engagement with a wall 903 of the wellbore 903 and achieve zonal isolation. The indexing sleeves 912*a*, 912*b*, 912*c* may provide any suitable actuation of the packers 910*a*, 910*b*, 910*c*. For example, the indexing sleeves 912*a*, 912*b*, 912*c* may axially compress the respective packers 910*a*, 910*b*, 910*c*. Alternatively, the indexing sleeves 912*a*, 912*b*, 912*c* may establish fluid communication with a source of hydraulic power which may be used to actuate the packers 910*a*, 910*b*, 910*c*. For example, the indexing sleeves 912*a*, 912*b*, 912*c* may open one or more ports which provide fluid communication with hydrostatic pressure within the annulus 904 between the tubing string 901 and the wall 903 of the wellbore 902.

Figure 19C:
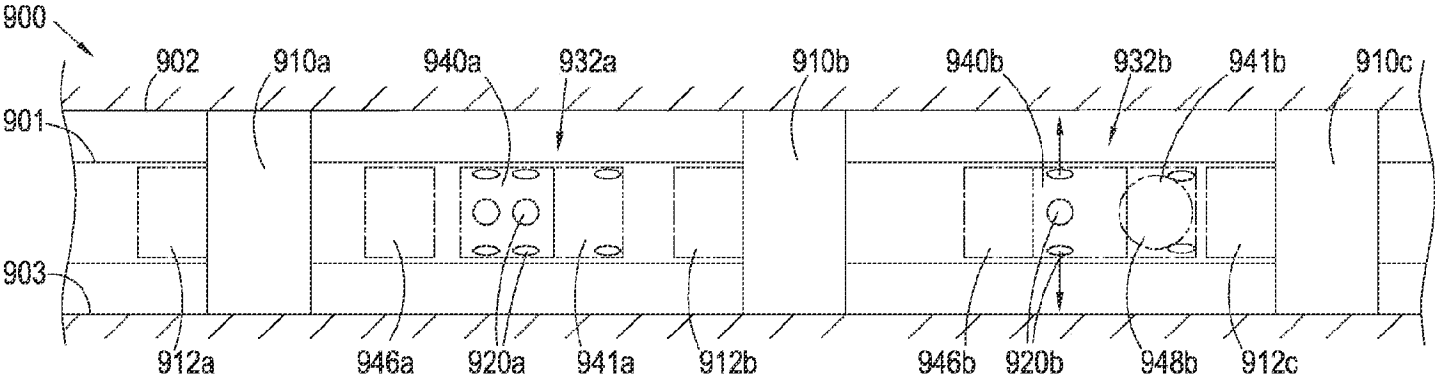

Upon passage of a second ball 948*b*, as shown in FIG. 19C, indexing sleeves 946*a*, 946*b* are each caused to move a further single discrete step. Such movement is sufficient to cause indexing sleeve 946*b* to drive the valve member 940*b* of the second valve assembly 932*b* to open the ports 920*b*, and also reconfigure the catching sleeve 941*b* so that the ball 948*b* may become caught. In such a configuration a fluid, such as a fracturing fluid, flowing along the tubing string 901 may be diverted outwardly through the opened ports 920*b* to treat a surrounding formation in the zone defined between the second and third packers 910*b*, 910*c*. In a similar manner to that described above in other embodiments, the catching sleeve 941*b* may eventually be configured to release the ball 948*b*, again allowing full bore access along the tubing string 901.

Figure 19D:
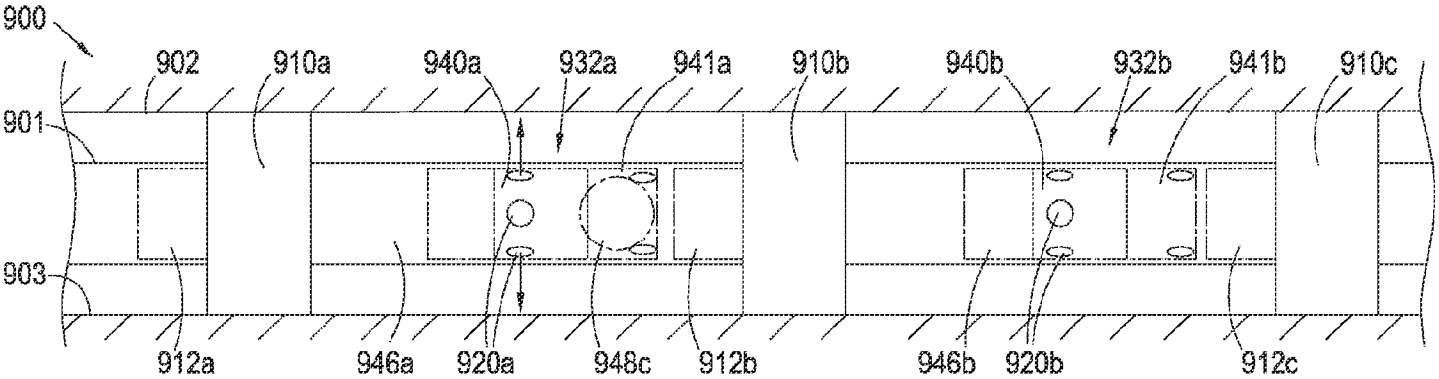

Upon passage of a third ball 948*c*, as shown in FIG. 19D, indexing sleeve 946*a* is caused to move a further single discrete step, to now engage and drive the valve member 940*a* of the first valve assembly 932*a* to open the ports 920*a*, and also reconfigure the catching sleeve 941*a* so that the ball 948*c* may become caught. In such a configuration a fluid, such as a fracturing fluid, flowing along the tubing string 901 may be diverted outwardly through the opened ports 920*c* to treat a surrounding formation in the zone defined between the first and second packers 910*a*, 910*b*. In a similar manner to that described above in other embodiments, the catching sleeve 941*c* may eventually be configured to release the ball 948*c*, again allowing full bore access along the tubing string 901.

As noted above, the present invention can permit downhole tools to be actuated in any desired sequence. In the system 900 of FIG. 19A, the indexing sleeves 912*a*, 912*b*, 912*c* are initially arranged to set the associated packers 910*a*, 910*b*, 910*c* upon passage of a single actuation object. However, in a modified embodiment indexing sleeve 912*c* may be arranged to set packer 910*c* upon passage of a first object, indexing sleeve 912*b* may be arranged to set packer 910*b* upon passage of a second object, and indexing sleeve 912*a* may be arranged to set packer 910*a* upon passage of a third object. In such an arrangement a passing object may only be required to actuate a single packer. This may provide advantages, in terms of maximising the available energy of an object for actuating a single packer, rather than requiring the object to have sufficient energy to actuate a number of downhole tools. In such an arrangement there might be the possibility that the available actuation energy of an object is dissipated before all target tools or packers are actuated.

Figure 20A:
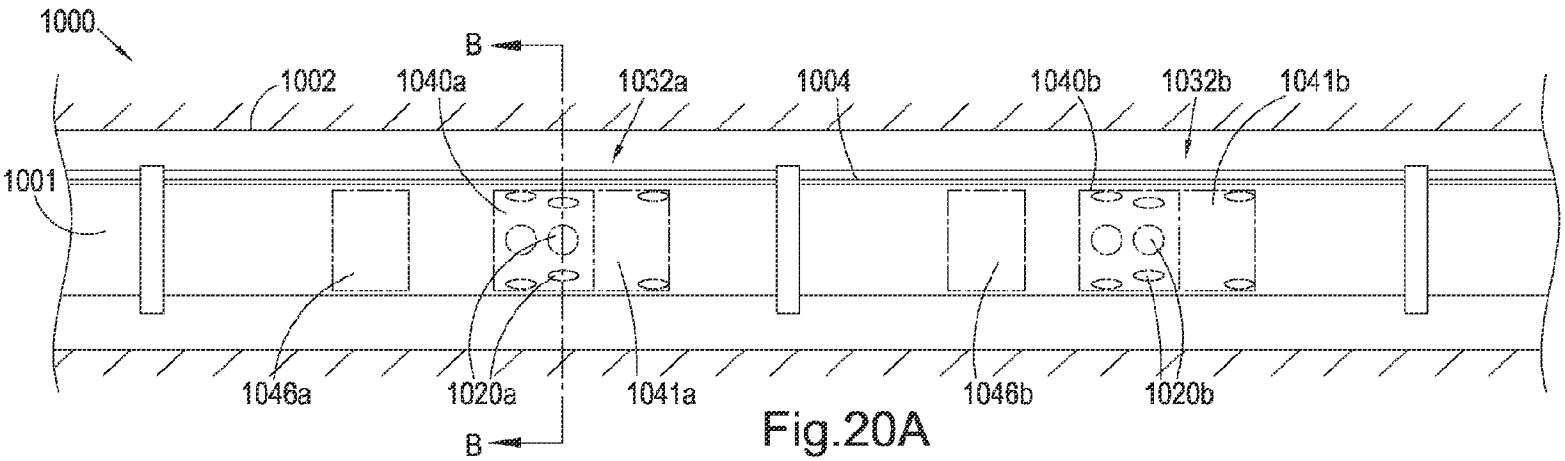
FIG. 20A is a schematic illustration of a downhole system in accordance with an further alternative embodiment of the present invention.

Reference is now made to FIG. 20A in which there is shown a downhole system, generally identified by reference numeral 1000, in accordance with an embodiment of the present invention. The downhole system 1000 includes a tubing string 1001 which is shown positioned within a wellbore 1002. The tubing string 1001 includes a number of tools and tool components along its length.

More specifically, the tubing string 901 includes first and second valve assemblies 1032*a*, 1032*b*, wherein each valve assembly 1032*a*, 1032*b* is configured in the same manner as tool portion 32 first shown in FIG. 2, and as such no further detailed description will be given. Thus, each valve assembly 1032*a*, 1032*b* includes a valve member 1040*a*, 1040*b* initially arranged in FIG. 20A to block fluid ports 1020*a*, 1020*b* through a wall of the tubing string 1001. Further, each valve assembly 1032*a*, 1032*b* includes a catching sleeve 1041*a*, 1041*b* which is configurable from a free configuration in which an object may freely pass therethrough, to a catching configuration in which an object may be caught.

Each valve assembly 1032*a*, 1032*b* includes an associated actuator, which each includes an indexing sleeve 1046*a*, 1046*b*. The indexing sleeves 1046*a*, 1046*b* are provided in a similar form to indexing sleeve 46 first shown in FIG. 2, and as such no further detailed description will be give. Each indexing sleeve 1046*a*, 1046*b* is arranged within the tubing string 1001 to cooperate with respective indexing profiles (not illustrated) on the inner surface of the tubing string 1001, to be moved in a number of discrete steps of movement towards an actuation site upon passage of a corresponding number of objects, such as balls. Upon reaching the respective actuation sites, the indexing sleeves 1046*a*, 1046*b* actuate the respective valve assemblies 1032*a*, 1032*b* to move the valve members 1040*a*, 1040*b* to open the respective ports 1020*a*, 1020*b*, and to reconfigured the respective catching sleeves 1041*a*, 1041*b* to their catching configurations.

In a similar manner to the embodiments described above, the required number of passing objects to cause the indexing sleeves 1046*a*, 1046*b* to reach their respective actuation sites is determined by the initial positioning of said indexing sleeves.

A conduit 1004 runs alongside the tubing string 1001. The conduit may be of any suitable form and provide any required function. For example, the conduit 1004 may be configured to provide fluid, electrical, optical communication or the like along the tubing string 1001.

Figure 20B:
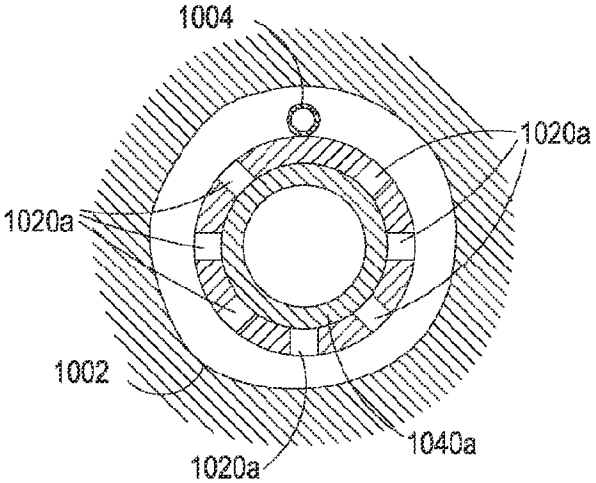
FIG. 20B is a lateral cross-sectional view of the system of FIG. 20A, taken through line B-B.

In the present embodiment illustrated, the conduit 1004 extends along the outer surface of tubing string 1001 at a circumferential location which is absent from any fluid ports, as illustrated in FIG. 20B, which is a sectional view of the system 1000 of FIG. 20A, taken through line B-B. In this respect, the ports 1020*a* are evenly circumferentially distributed around the tubing string 1001, with the exception that a port is absent from the circumferential region (the 12 o'clock position in the illustrated embodiment) at which the conduit 1004 is located. Accordingly, the conduit 1004 may be protected from direct exposure to any fluids, such as a fracturing fluid, exiting the ports 1020*a*.

It should be understood that the embodiments described herein are merely exemplary and that various modifications may be made thereto without departing from the scope of the invention.

The invention claimed is:

1. A downhole tool, comprising:

a housing;

a catching arrangement mounted within the housing and comprising one or more radially moveable seat members, and being configurable from a free configuration in which the seat members permit an object to pass through the tool, to a catching configuration in which the seat members catch an object passing through the tool; and a release member comprising an axially moveable sleeve mounted within the housing and being moveable axially by the catching arrangement between a supporting position in which the release member permits the catching arrangement to be configured in its catching configuration by the release member radially supporting the seat members in a radially inward or retracted position, towards a de-supporting position in which the release member permits the catching arrangement to be configured in a release configuration by removing the radial support to the seat members provided by the release member, allowing the seat members to be moved radially outwardly to permit release of a previously caught object.

2. The downhole tool according to claim 1, wherein the housing defines a release recess and the release member covers this release recess when said release member is located within its supporting position, and the release member is movable within the housing towards its de-supporting position to uncover the release recess and thus permit the seat members to be moved radially outwardly and received within the release recess to permit release of an object.

3. The downhole tool according to claim 1, wherein the release member defines a load profile, and the catching arrangement defines a load profile configured to engage a load profile on the release member to permit the catching arrangement to apply a force on the release member to move the release member towards its de-supporting position.

4. The downhole tool according to claim 1, wherein at least one seat member comprises a load profile configured to engage a load profile on the release member to permit the release member to be moved by the catching arrangement.

5. The downhole tool according to claim 1, wherein each seat member comprises a load profile, wherein when said seat members are moved radially inwardly the individual load profiles define a substantially circumferentially continuous load profile.

6. The downhole tool according to claim 1, wherein the catching arrangement is biased in a direction opposite to the direction in which the release member is moved to be positioned within its de-supporting position.

7. The downhole tool according to claim 1, wherein the housing defines a central bore and includes a fluid port, and the downhole tool further comprises a valve member mounted within the housing and being moveable from a closed position in which the fluid port is blocked to an open position in which the fluid port is opened.

8. The downhole tool according to claim 7, wherein the catching arrangement is reconfigured by movement of the valve member towards its open position.

9. The downhole tool according to claim 7, wherein the catching arrangement is configured to catch an object passing through the tool to at least partially block flow through the central bore and divert flow through the fluid port when opened.

10. The downhole tool according to claim 7, wherein the valve member is moveable from its closed position towards its open position in response to an object passing through the downhole tool in a downstream direction.

11. The downhole tool according to claim 10, wherein the catching arrangement catches the same object which causes movement of the valve member towards its open position.

12. The downhole tool according to claim 7, wherein the valve member is axially moveable by an indexing sleeve of a downhole actuator.

13. The downhole tool according to claim 12, wherein the indexing sleeve is located on an upstream side of the valve member, and functions to move the valve member in a downstream direction.

14. The downhole tool according to claim 12, wherein the indexing sleeve is operated to move linearly through the housing in a predetermined number of discrete movement steps to actuate the valve member by passage of a corresponding number of objects.

15. The downhole tool according to claim 14, wherein a final discrete movement step of the indexing sleeve initiates movement of the valve member towards its open position.

16. The downhole tool according to claim 15, wherein the catching arrangement catches an object which caused the final discrete movement step of the indexing sleeve.

17. The downhole tool according to claim 7, wherein the valve member is arranged to axially engage the catching arrangement to move the catching arrangement within the housing, wherein the valve member and catching arrangement comprise respective load profiles which are arranged to abut each other in an axial direction.

18. The downhole tool according to claim 7, comprising a lost motion arrangement between the valve member and the catching arrangement to permit the valve member to move a desired distance relative to the catching arrangement before initiating axial movement of the catching arrangement.

19. The downhole tool according to claim 7, wherein the valve member comprises an axially extending shroud which extends into the catching arrangement from one axial end thereof such that an end region of the catching arrangement sits radially outside of the valve member shroud and isolated from the central bore.

20. The downhole tool according to claim 19, wherein the shroud extends only partially through the catching arrangement.

21. The downhole tool according to 19, wherein the shroud extends into the catching arrangement at least when the catching arrangement is configured in its free configuration.

22. The downhole tool according to claim 1, wherein the downhole tool defines a first region within the housing having a first inner diameter which permits the seat members to move radially outwardly when aligned with said first region, and the catching arrangement is provided in its free configuration when the seat members are aligned with the first region.

23. The downhole tool according to claim 22, wherein the downhole tool defines a second region within the housing having a second inner diameter which permits the seat members to be radially supported when positioned radially inwardly, when aligned with said second region, and the catching arrangement is provided in its catching configuration when the seat members are aligned with the second region.

24. The downhole tool according to claim 23, wherein the catching arrangement is axially moveable within the housing to realign the seat members from the first region to the second region, and thus present the catching arrangement in its catching configuration.

25. The downhole tool according to claim 1, wherein the seat members collectively define a substantially complete annular structure when positioned radially inwardly.

26. The downhole tool according to claim 1, wherein the catching arrangement comprises a tubular portion and a plurality of collet fingers supported by the tubular portion, wherein each collet finger supports a respective seat member.

27. The downhole tool according to claim 26, wherein each collet finger is radially deformable to permit the respective seat members to be moved radially outwardly and inwardly.

28. The downhole tool according to claim 26, wherein at least one collet finger defines a tapering radial width.

29. The downhole tool according to claim 1, comprising a lost motion arrangement between the catching arrangement and the release member to permit the catching arrangement to move a desired distance relative to the release member before initiating axial movement of the release member towards its de-supporting position.

30. A method for catching and releasing an object in a wellbore using a downhole tool, comprising:

configuring a catching arrangement which is located within a housing in a free configuration such that one or more radially moveable seat members of the catching arrangement permit an object to pass through the tool;

reconfiguring the catching arrangement in a catching configuration in which the seat members catch an object passing through the tool; and axially moving a release member comprising a sleeve using the catching arrangement between a supporting position in which the release member permits the catching arrangement to be configured in its catching configuration by the release member radially supporting the seat members in a radially inward or retracted position, towards a de-supporting position in which the release member permits the catching arrangement to be configured in a release configuration by removing the radial support to the seat members provided by the release member, allowing the seat members to be moved radially outwardly to permit release of the caught object.

31. A downhole tool, comprising:

a housing;

a catching arrangement mounted within the housing and comprising one or more radially moveable seat members, and being configurable from a free configuration in which the seat members permit an object to pass through the tool, to a catching configuration in which the seat members catch an object passing through the tool; and a release member mounted within the housing and being moveable axially by the catching arrangement between a supporting position in which the release member permits the catching arrangement to be configured in its catching configuration by radially supporting the seat members in a radially inward or retracted position, towards a de-supporting position in which the release member permits the catching arrangement to be configured in a release configuration by removing the radial support to the seat members, allowing the seat members to be moved radially outwardly to permit release of a previously caught object, wherein the release member defines a load profile, and the catching arrangement defines a load profile configured to engage a load profile on the release member to permit the catching arrangement to apply a force on the release member to move the release member towards its de-supporting position.

32. The downhole tool according to claim 31, wherein at least one seat member of the catching arrangement defines a portion of the load profile of the catching arrangement.

33. A downhole tool, comprising:

a tool housing defining a central bore and including a fluid port;

a valve member mounted within the housing and being moveable from a closed position in which the fluid port is blocked to an open position in which the fluid port is opened;

a catching arrangement mounted within the housing and comprising one or more radially moveable seat members, and being configurable from a free configuration in which the seat members permit an object to pass through the tool, to a catching configuration in which the seat members catch an object passing through the tool; and a lost motion arrangement between the valve member and the catching arrangement to permit the valve member to move a desired distance relative to the catching arrangement before initiating axial movement of the catching arrangement.

34. The downhole tool according to claim 33, comprising a release member mounted within the housing and being moveable axially by the catching arrangement between a supporting position in which the release member permits the catching arrangement to be configured in its catching configuration by radially supporting the seat members in a radially inward or retracted position, towards a de-supporting position in which the release member permits the catching arrangement to be configured in a release configuration by removing the radial support to the seat members, allowing the seat members to be moved radially outwardly to permit release of a previously caught object.

35. A downhole tool, comprising:

a housing;

a catching arrangement mounted within the housing and comprising one or more radially moveable seat members, and being configurable from a free configuration in which the seat members permit an object to pass through the tool, to a catching configuration in which the seat members catch an object passing through the tool;

a release member mounted within the housing and being moveable axially by the catching arrangement between a supporting position in which the release member permits the catching arrangement to be configured in its catching configuration by the release member radially supporting the seat members in a radially inward or retracted position, towards a de-supporting position in which the release member permits the catching arrangement to be configured in a release configuration by removing the radial support to the seat members provided by the release member, allowing the seat members to be moved radially outwardly to permit release of a previously caught object; and a lost motion arrangement between the catching arrangement and the release member to permit the catching arrangement to move a desired distance relative to the release member before initiating axial movement of the release member towards its de-supporting position.

* * * * *